US006495299B2

(12) United States Patent
Levy et al.

(10) Patent No.: US 6,495,299 B2
(45) Date of Patent: Dec. 17, 2002

(54) PACKAGED COLOR PHOTOGRAPHIC FILM CAPABLE OF ALTERNATIVELY DRY OR WET-CHEMICAL PROCESSING

(75) Inventors: David H. Levy, Rochester, NY (US); James H. Reynolds, Rochester, NY (US); David T. Southby, Rochester, NY (US); Paul D. Zimmerman, Rochester, NY (US); Mark E. Irving, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/865,901

(22) Filed: May 25, 2001

(65) Prior Publication Data

US 2002/0018956 A1 Feb. 14, 2002

Related U.S. Application Data

(60) Provisional application No. 60/211,058, filed on Jun. 13, 2000.

(51) Int. Cl.[7] ..... G03C 1/42; G03C 1/498; G03C 7/305; G03C 7/413

(52) U.S. Cl. ..... 430/21; 430/351; 430/380; 430/543; 430/551; 430/612; 430/619; 430/955; 430/959

(58) Field of Search ..... 430/352, 380, 430/612, 619, 955, 959, 543, 551, 566, 21, 467

(56) References Cited

U.S. PATENT DOCUMENTS 4,128,557 A * 12/1978 Knight et al. ..... 430/619
4,138,265 A * 2/1979 Shiao ..... 430/619
4,157,915 A * 6/1979 Hamaoka et al. ..... 430/959
4,732,846 A * 3/1988 Aono et al. ..... 430/619
4,789,623 A * 12/1988 Sato et al. ..... 430/351
5,391,443 A 2/1995 Simons et al.
6,004,736 A * 12/1999 Taguchi et al. ..... 430/543
6,013,420 A * 1/2000 Wingender et al. ..... 430/351
6,242,166 B1 * 6/2001 Irving et al. ..... 430/351
6,306,551 B1 * 10/2001 Owczarczyk et al. ..... 430/351
6,319,640 B1 * 11/2001 Slusarek et al. ..... 430/351
6,350,566 B2 * 2/2002 Irving et al. ..... 430/351

FOREIGN PATENT DOCUMENTS

EP 0 762 201 A1 12/1997
JP 98078638 3/1998

OTHER PUBLICATIONS

Research Disclosure No. 17029, vol. 170, Jun. 1978, p. 9.

* cited by examiner

*Primary Examiner*—Richard L. Schilling
(74) *Attorney, Agent, or Firm*—Chris P. Konkol

(57) ABSTRACT

This invention relates to packaged photographic film that is capable of being alternately processed, according to individual consumer choice, by either (1) a traditional wet-chemistry process with a developer solution followed by desilvering in one or more subsequent solutions to obtain a color negative film, or (2) a dry thermal process without the use of aqueous solutions in which a blocked developing agent located within the photographic element is thermally activated or unblocked, optionally followed by electronic scanning of the developed film without desilvering. This invention enables a single film stock to be developed in both a conventional deep tank process and in a dry thermal process.

14 Claims, 2 Drawing Sheets

PACKAGED COLOR PHOTOGRAPHIC FILM CAPABLE OF ALTERNATIVELY DRY OR WET-CHEMICAL PROCESSING

This application claims the benefit of Provisional application Ser. No. 60/211,058, filed Jun. 13, 2000.

FIELD OF THE INVENTION

This invention relates to a packaged film and a method of processing the film such that, after imagewise exposure, the film is capable of being color developed either (1) by sequential immersion of the film in a wet-chemical multi-tank process at a temperature of 60° C. or less by immersion in a phenylenediamine-containing developer solution or its equivalent, followed by desilvering in one or more subsequent solutions, to obtain a color negative film with the silver and silver halide removed from the film, or alternatively, (2) by thermal treatment of the film, by heating the film at a temperature greater than 80° C., preferably greater than 100° C., more preferably greater than 120° C., without liquid saturation of the film, preferably in an essentially dry process without the addition of any aqueous solutions. When dry developed, the imaged film may be electronically scanned without removing the silver and/or silver-halide.

BACKGROUND OF THE INVENTION

With the remarkable advances in the fields of solid-state imaging devices and various hard-copy printing technologies made in recent years, the comparison between electronic imaging systems and the silver-halide photographic system has become a frequent subject of discussion. Nevertheless, the superiority of the silver halide photographic system with respect to high sensitivity and high image quality, particularly with respect to affordable consumer products, will not be threatened for some time in the future. One particular shortcoming of the silver-halide system, however, in comparison to electronic imaging systems is that the photographic element requires a so-called wet-development process that typically requires substantial volumes of solutions such as developing, fixing, and bleaching solutions. For the people engaged in the development of silver-halide photographic techniques, the development of a "dry" development process for the silver-halide color photographic system has been a goal for many years.

A dry development process can be accomplished by the use of photothermographic elements described in Research Disclosure 17029 (Research Disclosure I). Generally, in these kinds of systems, development occurs by reduction of silver ions in the photosensitive silver halide to metallic silver as in conventional non-thermal systems, but the developing agent is contained within the element, so that it is unnecessary to immerse the photographic element in an aqueous solution containing a developing agent. Various types of photothermographic elements have been proposed and patented. Research Disclosure I discloses a type A and a B photothermographic system. Type B elements, the subject of this invention, contain in reactive association a binder, a photosensitive silver halide (prepared in situ or ex situ) and an oxidation-reduction image forming combination comprising (1) a metallic salt or complex of an organic compound as an oxidizing agent, and (2) an organic reducing agent or developing agent. A problem has been to achieve a commercially viable system that produces a quality of image comparable, in the eyes of the average film consumer, to traditional silver-halide film.

A practical color photothermographic system for general use with respect to consumer cameras would have significant advantages. Such film might be amenable to development at kiosks, with the use of dry equipment. Thus, it is envisioned that a consumer could bring an imagewise exposed photothermographic film, for development and printing, to a kiosk located at any one of a number of diverse locations, optionally independent from a wet-development lab, where the film could be developed and printed without any manipulation by third-party technicians. It is also envisioned that a consumer might be more prone to owning and operating such film development equipment in a home, particularly if it was dry and did not involve the use of complex chemicals. Thus, the development of a successful photothermographic system could open up new opportunities for greater convenience and speed of development, even immediate development in the home for a wider cross-section of consumers.

In order to maintain the dry aspect of a photothermographic system, various possibilities exist. One, for example, is to fix/bleach (remove the silver and silver halide) in effect by a diffusion transfer. See, for example EP 0762 201 to Matsumoto et al assigned to Fuji Photo Film Co. The patent is primarily addressed to dye-diffusion processes requiring some amount of water, albeit relatively small amounts of aqueous solutions not containing complex chemicals. Although disclosing an example of a dry system, it may not provide acceptable image quality or may not be sufficiently enabled for practical or wide-spread use, since commercialization of a dry system has not taken place. On the other hand, in view of the advance of scanning technologies, it has now become natural and practical for photothermographic color film such as disclosed in EP 0762 201 to be scanned, which can be accomplished without the necessity of removing the silver or silver-halide from the negative, although special arrangements for such scanning can be made to improve its quality. See, for example, Simons U.S. Pat. No. 5,391,443.

Dry photothermographic film elements would offer significant advantages in processing ease and convenience, since they could be developed only by the application of heat and require no wet processing solutions. However, this advantage comes at a price, since the films must be developed in a thermal processor that may not be (at least initially) as available as conventional C-41 processors, which are widely available as an mature industry standard. The unavailability of thermal processors and associated equipment can hinder the adoption of dry photothermographic films by the consumer. For example, accessibility of thermal processors or processing may vary with the geographical location of the consumer. Photothermographic films that can also be processed by C-41 chemistry or the like overcome this disadvantage or problem. Photothermographic films that are backwards compatible permit the consumer to enjoy the benefits unique to thermal processing (kiosk processing, low environmental impact, and the like) when thermal processing is accessible, but also allow the consumer to take advantage of the current ubiquity of C-41 processing when thermal processing may not be accessible.

It would be desirable if a dry photothermographic system could be made that was backwards compatible for use with a conventional wet-development process. Applicants have encountered serious obstacles to obtaining a dry photothermographic system that is backwards compatible. Such photothermographic systems, in which an organic silver salt plays the role of a silver ion source but does not function as the photosensor and memory, was not found not to be readily backwards compatible because of the antifoggants typically contained and thought necessary in such film. In other words, because such photothermographic films contain blocked developers, and in the absence of processing solutions, require high temperatures for development, agents for preventing fog or increased Dmin during thermal processing are believed necessary, which agents would block development in conventional processing, for example, C-41 processing.

Japanese kokai patent publication 10-78638 (Mar. 24, 1998) claims the use of a color photographic element that is backwards compatible by means of using a special combination of two yellow dye couplers with an unblocked ballasted sulfonamidophenol or sulfonyl hydrazide type developing agent. The pair of yellow dye couplers consist of one having a detachable cationic group and one having a detachable anionic group, the latter coupler preferably also containing a dye suppressant. It was found that, in the absence of one of the couplers, the color sensitivity during conventional wet-development was relatively poor, and that in the absence of the other of the two couplers, the granularity during conventional wet-development was relatively poor. As mentioned above, the photothermographic developing agent in Japanese kokai patent publication 10-78638 to Matsumoto et al was unblocked, and this fact may have adversely affected wet-development processing with conventional combinations of couplers and developing agents. Another disadvantage of the ballasted sulfonamidophenol developing agents or ballasted sulfonylhydrazide developing agents in kokai 10-78638 is that they generally react with couplers to form dyes of low extinction or to form dyes which differ in hue from those formed with phenylenediamine color developing agents, resulting in unwanted color variations. This fact also limits the ability of the developed color negative image, after scanning, to provide visually editable and previewable images.

In order to be acceptable for commercial application, it is necessary that a photothermographic system be stable before exposure, while avoiding desensitizing of the silver halide during storage, resulting in increased fog and/or decreased Dmax after development. At the same time, the system must capable of sufficiently fast kinetics (including unblocking of the developing agent) when the exposed film is being developed by thermal activation. In the case of the same photothermographic film designed for alternatively (at the discretion of the consumer) traditional wet-processing or dry thermal processing, it is surmised that another requirement might be that the components in the photothermographic film, designed exclusively for the dry photothermographic development (for example the blocked developing agent and antifogging agents) do not adversely affect or interfere with obtaining the results otherwise achieved by traditional wet-processing. In the case of sequential development, in which an initial dry photothermographic film is followed by a conventional wet process, the requirements are somewhat different. The photothermographically developed film image must not be affected by the development step in the traditional wet-processing, but must be effectively subjected with subsequent post-development steps such as fixing and bleaching.

Problem to be Solved by the Invention

A photothermographic color film, in which a silver-halide-containing color photographic element after image-wise exposure can be developed merely by the external application of heat by thermal treatment of the film, by heating the film at a temperature greater than 80° C., without liquid saturation of the film, preferably in an essentially dry process without the addition of any aqueous solutions, but which same film is also amenable to development in an automated kiosk, preferably not requiring third-party manipulation, would have significant advantages. Assuming the availability and accessibility of such kiosks, such photothermographic films could potentially be developed at any time of day, "on demand," in a matter minutes, without requiring the participation of third-party processors, multiple-tank equipment and the like. Such photothermographic processing could potentially be done on an "as needed" basis, even one roll at a time, without necessitating the high-volume processing that would justify, in a commercial setting, equipment capable of high-throughput. The kiosks thus envisioned would be capable of heating the film to develop a negative color image and then subsequently scanning the film on an individual consumer basis, with the option of generating a display element corresponding to the developed color image.

SUMMARY OF THE INVENTION

The invention relates to a color photographic film element comprising a support bearing at least two (preferably three) light-sensitive silver-halide emulsion units each having in reactive association at least one dye-forming coupler, a blocked color developing agent, a photosensitive silver halide and an oxidation-reduction image forming combination comprising (a) at least one metallic salt or complex of an organic compound as an oxidizing agent, and (b) an organic reducing agent or developing agent. The application of heat converts the latent color-developing agent to reactive form. In one embodiment, the photothermographic element is a multilayer, multicolor element having red, green and blue color recording units each formed from like light sensitive layers respectively having cyan dye-forming, magenta dye-forming and yellow dye-forming couplers. In all cases, the latent color developing agent can be in the same layer as a light-sensitive emulsion or it can be in a light insensitive layer. This photographic film is designed to enable a single film stock to be developed in either (1) a conventional wet-chemical process, for example a C-41 deep-tank process, or (2) a dry process. For example, an individual consumer, at his or her discretion, could potentially take the film to a kiosk to be thermally developed, or alternatively, submit the film to a wet-processing lab. Thus, depending on various factors, including the availability of thermal processing facilities in a given geography over a give period of time, it can be expected that, a portion of such film will, in fact, be developed by a conventional wet-chemical process, and a portion of such film will be developed by a dry thermal process.

The feature of the present photothermographic films that make them backwards compatible is the complexing of the fog inhibitor as its silver ligand. This silver complex has little inhibitory effect on the chemical development that occurs in conventional C-41 processing.

In one embodiment of the present invention, a packaged photographic film element has at least two (preferably three) light-sensitive layers which have their individual sensitivities in different wavelength regions, each of the layers comprising a light-sensitive silver-halide emulsion, a binder, a dye-providing coupler, and a blocked developing agent. The package (inclusive of its package insert) includes indicia indicating that the consumer may direct the film to be alternatively processed and developed in either of two routes. These two routes correspond (at least in fact by means of consumer processing selection, if not explicitly stated) to, respectively (1) a conventional wet-chemical processing, for example, a C-41 process, and (2) a dry thermal process utilizing essentially no aqueous solutions or externally applied developing agent.

DETAILED DESCRIPTION OF THE INVENTION

Figure 1:
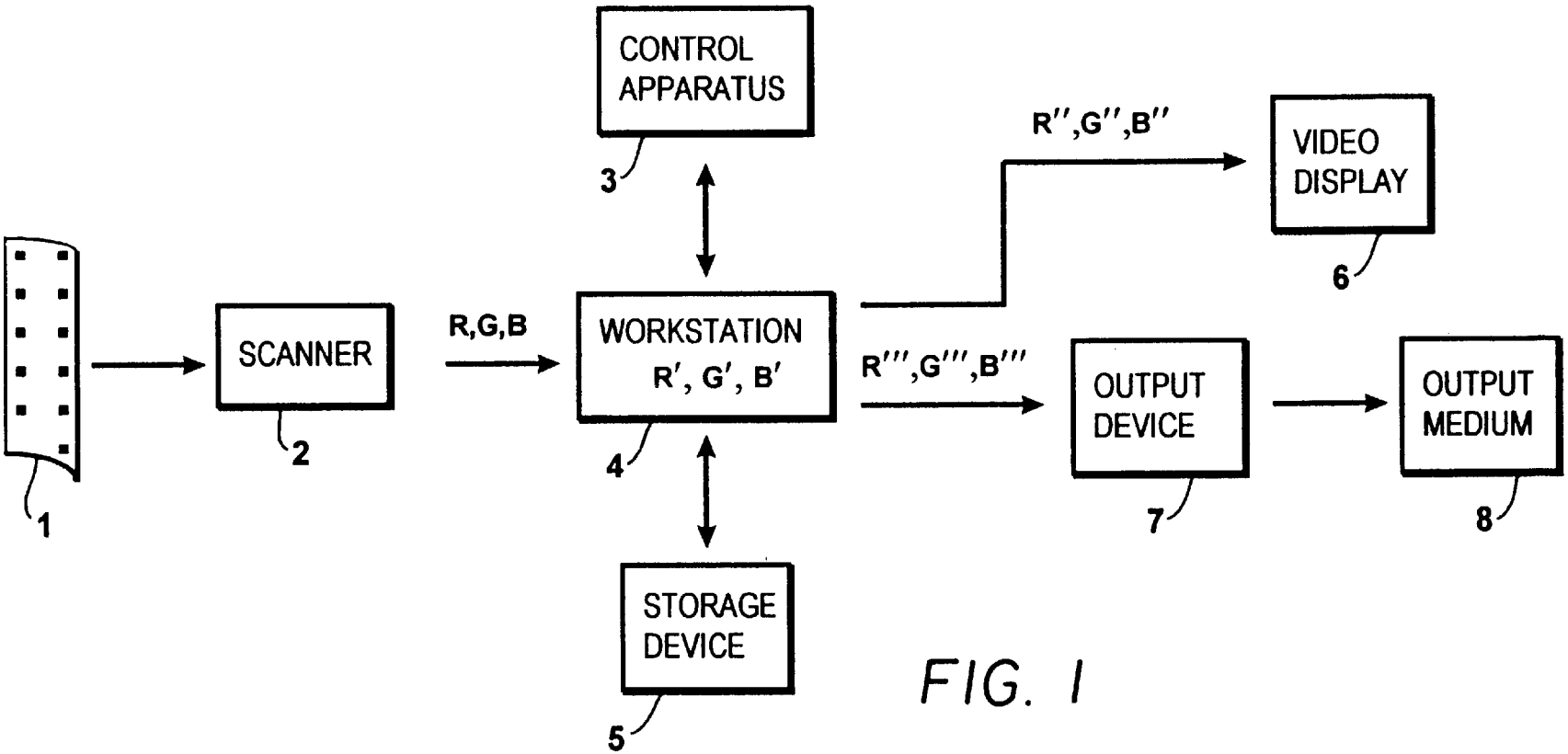
FIG. 1 shows in block diagram form an apparatus for processing and viewing image formation obtained by scanning the elements of the invention.

As mentioned above, the present invention is directed to a packaged silver-halide-containing color photographic element that is capable of being alternatively developed in either of two diverse ways, either a dry thermal process involving only internally supplied developing agent or a traditional kind of wet-chemical process involving a sufficient amount of externally supplied developing agent for complete development.

By "traditional kind of wet-chemical processing" or, synonymously, "wet-chemical processing" is herein meant herein a commercially standardized process in which the imagewise exposed color photographic element is completely immersed in a solution containing a developing agent, preferably phenylenediamine or its equivalent under agitation at a temperature of under 60° C., preferably 30 to 45° C., in order to form a color image from a latent image, wherein said developer solution comprises an unblocked developing agent that is a phenylenediamine compound which compound (after oxidation) forms dyes by reacting with the dye-providing couplers inside the silver-halide emulsions.

By "dry thermal process" or "thermal process" is herein meant a process involving the use of heat to raise the temperature of the photothermographic element or film to a temperature of at least about 80° C., preferably at least about 100° C., more preferably at about 120° C. to 180° C., without liquid saturation of the film, preferably in an essentially dry process without the addition of any aqueous solutions. When dry developed, the imaged film may be electronically scanned without removing the silver and/or silver-halide. Thus, contrary to photothermographic processing involving low-volume liquid processing, the amount of water required is less than 0.1 times the amount required for maximally swelling total coated layers of the film excluding a back layer. Preferably no water is required or applied.

In the dry process, a blocked developing agent in the photothermographic element becomes unblocked to form a developing agent such as phenylenediamine, preferably the similar to the non-blocked developing agent used in the alternative wet-chemical process, whereby the unblocked developing agent can form a color negative image from a latent image in the film, which color negative image can be optionally scanned without desilvering (for example, without fixing or bleaching), to provide a digital electronic record corresponding to the color negative image. The digital electronic record can optionally be used (immediately or later) to provide a color positive image in a display element, for example, by thermal-diffusion printing, ink-jet printing, or the like. Typically, as described below, the volume of aqueous solution utilized in the low-volume thermal process is relatively less than the volume of aqueous solution utilized in the alternative wet chemical process.

As indicated above, the color photographic element which can be subjected to either dry thermal or conventional wet-chemical processing comprises a support bearing at least two (preferably three) light-sensitive silver-halide emulsion units each having in reactive association at least one dye-forming coupler, a blocked color developing agent, a photosensitive silver halide and an oxidation-reduction image forming combination comprising (a) at least one silver salt or complex of an organic compound as an oxidizing agent, also referred to as a silver donor and (b) an organic reducing agent or developing agent. The photographic element further comprises a second silver salt or complex of an organic compound that is not, or at least not primarily, an oxidizing agent, but which prevents fogging of the film during thermal development, and which may be referred to as a thermal fog inhibitor.

In one embodiment of the invention, the color photothermographic element comprises at least three imaging layers comprising a blocked developer, a coupler, silver halide, and a mixture of at least two organic silver salts, wherein the first organic silver ligand exhibits a cLogP of 0.1 to 10 and a $pK_{sp}$ of 7 to 14 and wherein the second organic silver ligand exhibits a cLogP of 0.1 to 10 and a $pK_{sp}$ of 14 to 21. Both organic silver salts are present at levels above 5 g/mol of silver halide in the emulsion or imaging layer. In this embodiment, the first organic silver salt, which may be referred to as the silver donor, which is its primary function, is present, at levels in the range of 5 to 3,000/mol of imaging silver. The second organic silver salt, which may be referred to as the thermal fog inhibitor, which is its primary function, is present at levels in the range of 5 to 3,000 g/mol of imaging silver.

The log of the partition coefficient, clogP, characterizes the octanol/water partition equilibrium of the compound in question. Partition coefficients can be experimentally determined. As an estimate, clogP values can be calculated by fragment additivity relationships. These calculations are relatively simple for additional methylene unit in a hydrocarbon chain, but are more difficult in more complex structural variations. An expert computer program, MEDCHEM, Pomona Medchem Software, Pomona College, Calif. (ver. 3.54), permits consistent calculation of partition coefficients as the log value, clogP, from molecular structure inputs and is used in the present invention to calculate these values as a first estimate.

The activity solubility product or $pK_{sp}$ of an organic silver salt is a measure of its solubility in water. Some organic silver salts are only sparingly soluble and their solubility products are disclosed, for example, in Chapter 1 pages 7–10 of The Theory of the Photographic Process, by T. H. James, Macmillan Publishing Co. Inc., New Your (fourth edition 1977). Many of the organic silver salts consist of the replacement of a ligand proton with Ag+. The silver salts derived from mercapto compounds are relatively less soluble. The compound PMT has a $pK_{sp}$ of 16.2 at 25° C. as reported by Z. C. H. Tan et al., *Anal. Chem.,* 44, 411(1972); Z. C. H. Tan, *Phototgr. Sci. Eng.,* 19,17 (1975). In comparison, benzotriazole, for example, has a $pK_{sp}$ of 13.5 at a temperature of 25° C. as reported by C. J. Battaglia, *Photogr. Sci. Eng.,* 14, 275 (1970).

In one embodiment of the invention, the organic silver donor is a silver salt of a nitrogen acid (imine) group, which can optionally be part of the ring structure of a heterocyclic compound, in which case aliphatic and aromatic carboxylic acids such as silver behenate or silver benzoate, in which the silver is associated with the carboxylic acid moiety, are specifically excluded as the organic silver donor compound. In this embodiment, compounds that have both a nitrogen acid moiety and carboxylic acid moiety may be included as donors of this invention only insofar as the silver ion is associated with the nitrogen acid rather than the carboxylic acid group. The donor can also contain a mercapto residue, provided that the sulfur does not bind silver too strongly, and is preferably not a thiol or thione compound.

Preferably, a silver salt of a compound containing an imino group can be used. Preferably, the compound contains a heterocyclic nucleus. Typical preferred heterocyclic nuclei include triazole, oxazole, thiazole, thiazoline, imidazoline, imidazole, diazole, pyridine and triazine.

The first organic silver salt may also be the derivative of a tetrazole. Specific examples include but are not limited to 1H-tetrazole, 5-ethyl-1H-tetrazole, 5-amino-1H-tetrazole, 5–4'methoxyphenyl-1H-tetrazole, and 5–4'carboxyphenyl-1H-tetrazole.

The first organic silver salt may also be a derivative of an imidazole. Specific examples include but are not limited to benzimidazole, 5-methyl-benzimidazole, imidazole, 2-methyl-benzimidazole, and 2-methyl-5-nitro-benzimidazole.

The first organic silver salt may also be a derivative of a pyrazole. Specific examples include but are not limited to pyrazole, 3,4-methyl-pyrazole, and 3-phenyl-pyrazole.

The first organic silver salt may also be a derivative of a triazole. Specific examples include but are not limited to benzotriazole, 1H-1,2,4-trazole, 3-amino-1,2,4 triazole, 3-amino-5-benzylmercapto-1,2,4-triazole, 5,6-dimethyl benzotriazole, 5-chloro benzotriazole, and 4-nitro-6-chloro-benzotriazole.

Other silver salts of nitrogen acids may also be used. Examples would include but not be limited to o-benzoic sulfimide, 4-hydroxy-6-methyl-1,3,3A,7-tetraazaindene, 4-hydroxy-6-methyl-1,2,3,3A,7-pentaazaindene, urazole, and 4-hydroxy-5-bromo-6-methyl-1,2,3,3A,7-pentaazaindene.

Most preferred examples of the organic silver donor compounds include the silver salts of benzotriazole, triazole, and derivatives thereof, as mentioned above and also described in Japanese patent publications 30270/69 and 18146/70, for example a silver salt of benzotriazole or methylbenzotriazole, etc., a silver salt of a halogen substituted benzotriazole, such as a silver salt of 5-chlorobenzotriazole, etc., a silver salt of 1,2,4-triazole, a silver salt of 3-amino-5-mercaptobenzyl-1,2,4-triazole, a silver salt of 1H-tetrazole as described in U.S. Pat. No. 4,220,709.

Silver salt complexes may be prepared by mixture of aqueous solutions of a silver ionic species, such as silver nitrate, and a solution of the organic ligand to be complexed with silver. The mixture process may take any convenient form, including those employed in the process of silver halide precipitation. A stabilizer may be used to avoid flocculation of the silver complex particles. The stabilizer may be any of those materials known to be useful in the photographic art, such as, but not limited to, gelatin, polyvinyl alcohol or polymeric or monomeric surfactants.

The photosensitive silver halide grains and the organic silver salt are coated so that they are in catalytic proximity during development. They can be coated in contiguous layers, but are preferably mixed prior to coating. Conventional mixing techniques are illustrated by Research Disclosure, Item 17029, cited above, as well as U.S. Pat. No. 3,700,458 and published Japanese patent applications Nos. 32928/75, 13224/74, 17216/75 and 42729/76.

In the preferred embodiment of the invention, the second silver organic salt, or thermal fog inhibitor, according to the present invention include silver salts of thiol or thione substituted compounds having a heterocyclic nucleus containing 5 or 6 ring atoms, at least one of which is nitrogen, with other ring atoms including carbon and up to two hetero-atoms selected from among oxygen, sulfur and nitrogen are specifically contemplated. Typical preferred heterocyclic nuclei include triazole, oxazole, thiazole, thiazoline, imidazoline, imidazole, diazole, pyridine and triazine. Preferred examples of these heterocyclic compounds include a silver salt of 2-mercaptobenzimidazole, a silver salt of 2-mercapto-5-aminothiadiazole, a silver salt of 5-carboxylic-1-methyl-2-phenyl-4-thiopyridine, a silver salt of mercaptotriazine, a silver salt of 2-mercaptobenzoxazole.

The second organic silver salt may be a derivative of a thionamide. Specific examples would include but not be limited to the silver salts of 6-chloro-2-mercapto benzothiazole, 2-mercapto-thiazole, naptho(1,2-d)thiazole-2(1H)-thione, 4-methyl-4-thiazoline-2-thione, 2-thiazolidinethione, 4,5-dimethyl-4-thiazoline-2-thione, 4-methyl-5-carboxy-4-thiazoline-2-thione, and 3-(2-carboxyethyl)-4-methyl-4-thiazoline-2-thione.

Preferably, the second organic silver salt is a derivative of a mercapto-triazole. Specific examples would include, but not be limited to, a silver salt of 3-mercapto-4-phenyl-1,2,4 triazole and a silver salt of 3-mercapto-1,2,4-triazole.

Most preferably the second organic salt is a derivative of a mercapto-tetrazole. In one preferred embodiment, a mercapto tetrazole compound useful in the present invention is represented by the following structure:

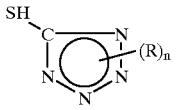

wherein n is 0 or 1, and R is independently selected from the group consisting of substituted or unsubstituted alkyl, aralkyl, or aryl. Substituents include, but are not limited to, C1 to C6 alkyl, nitro, halogen, and the like, which substituents do not adversely affect the thermal fog inhibiting effect of the silver salt. Preferably, n is 1 and R is an alkyl having 1 to 6 carbon atoms or a substituted or unsubstituted phenyl group. Specific examples include but are not limited to silver salts of 1-phenyl-5-mercapto-tetrazole, 1-(3-acetamido)-5-mercapto-tetrazole, or 1-[3-(2-sulfo)benzamidophenyl]-5-mercapto-tetrazole.

In one embodiment of the invention, the first organic silver salt is a benzotriazole or derivative thereof and the second organic silver salt is a mercapto-functional compound, preferably mercapto-heterocyclic compound. The second organic silver salt, at levels in the range of 5 to 3,000 g/mol of imaging silver, can effectively inhibit fog during thermal processing of chromogenic photothermographic films comprising a silver donor.

A particularly preferred thermal fog inhibitor is 1-phenyl-5-mercapto-tetrazole (PMT). In contrast, if such levels of PMT were incorporated in a film system intended to be processed conventionally, the film would show unacceptable speed and suppression of image formation. Surprisingly, in a photothermographic system, however, the thermal fog inhibitor succeeds in effectively suppressing the formation of Dmin with little or no penalty in imaging speed or Dmax formation. In many instances, enhancement of Dmax can even be shown by the use of the thermal fog inhibitor, an effect completely unexpected in comparison to the conventional system.

The use of a thermal fog inhibitor of the present invention has been found to allow conventional wet processing of the photothermographic material to proceed. Such thermal fog inhibitor tends to be present in the film as a solid particle dispersion.

Without wishing to be bound by theory, the organic silver salt that inhibits thermal fog is believed not to function as a conventional fog inhibitor, by absorption to the silver halide particles, but rather by modulating the concentration of silver ion or Ag+ that becomes available from the silver donor during thermal activation. Accordingly, the thermal fog inhibitor is believed to hold back the halide ion pump rather than poisoning the silver metal. Since the thermal fog inhibitor has a lower water solubility (higher $pK_{sp}$) than the organic compound in the silver donor, the thermal fog inhibitor holds back the silver ion more strongly than the organic compound in the silver donor.

In general, the organic silver salt form of the thermal fog inhibitor is formed by mixing silver nitrate and other salts with the free base of the PMT of the like. By raising the pH sufficiently with alkaline base, the silver salt of PMT can be precipitated, typically in spheroids 20 nm in diameter or larger. The silver salt of PMT can optionally be ball milled to form a dispersion and added to the gelatin and silver-halide containing emulsion at a pH of 5–7.

One aspect of the invention is directed to a method of processing an imagewise exposed color photographic element such as described above (containing a blocked color developing agent, a silver donor), which method comprises contacting the imagewise exposed color photographic element with a developer solution containing a developing agent, under agitation at a temperature of less than 60° C., preferably 30 to 45° C., in order to form a color negative image from a latent image, wherein the oxidized form of the developing agent forms dyes by reacting with the dye-providing couplers of a photographic element such as a multilayer pack. The dyes formed from the dye-providing couplers in the three light-sensitive units of the multilayer pack are different in hue. The film element is then desilvered, for example bleached and fixed, to remove unwanted silver and silver halide, thereby forming a color negative film capable of use to make a positive-image print. The internally located blocked developing agent and other components used when photothermographically developing the film in the three light-sensitive units, intended for the optional alternative thermal development, does not interfere with the wet-chemical processing.

The invention is also directed to a packaged article of manufacture comprising a photographic element as described above capable of being developed without any externally supplied developing agent, merely by heating to raise the temperature of the photographic element to a temperature above 80° C., preferably above 100° C., under essentially dry conditions, such that the blocked developing agent becomes unblocked to form a developing agent, whereby the developing agent can form a color negative image from a latent image, which color negative image optionally may be scanned, optionally without desilvering the developed photographic element, to provide a digital electronic record corresponding to a color image for later transfer to a display element. The packaged article of manufacture includes indicia for dual processing of the film.

According to another aspect of the invention, the inventive photographic element (II) and a comparative (conventional) photographic element (I) produce substantially identical density deposits when imagewise exposed to a common graduated density test target and commonly developed according to a specified development process (Process I described below). Comparative photographic element (I) comprises a support bearing a layer unit sensitive to a region of the electromagnetic spectrum which layer unit comprises a binder, and a light sensitive silver halide emulsion and is like photographic element (II) except that the layer unit does not comprise in reactive association a developing-agent precursor that becomes unblocked during thermal development processing. By substantially identical density deposits is meant that: first, the λmax of the density deposits are in the ratio of 0.9 to 1.1 and preferably in the ratio of 0.95 to 1.05 and more preferably in the ratio of 0.97 to 1.03; and second, that the gammas at that λmax are in the ratio of 0.8 to 1.2, and preferably in the ratio of 0.9 to 1.1 and more preferably in the ratio of 0.95 to 1.05. The specified comparative development process (Process I) is one carried out by contacting the elements with a developer solution for 195 seconds, where the developer solution is at a temperature of 37.6 ° C., a pH of 10 and comprises 4.5 g/L of 4-amino-3-methyl-N-ethyl-N-(2-hydroxyethyl) aniline sulfate. It will be appreciated that the term substantially identical effectively means that the comparative and inventive element after the prescribed exposure and development processing form density deposits having a λmax within 10%, preferably within 5% and more preferably with 3% of each other. It will be further appreciated that the comparative and inventive element after the prescribed exposure and development processing form density deposits having a λmax and a gamma at that λmax within 20%, preferably within 10% and more preferably with 5% of each other.

One preferred embodiment the layer unit of the inventive element comprises in reactive association a chromogenic coupler that can react with the oxidized form of a color developing agent to form a colored dye density deposit and produces substantially identical density deposits according to the aforesaid test and criteria.

In another preferred embodiment the inventive photographic element comprises a red sensitive layer unit, a green sensitive layer unit and a blue sensitive layer unit, each of which comprises in reactive association a chromogenic coupler that can react with the oxidized form of a color developing agent to imagewise form distinctly colored dye density deposits. Here, each dye deposit is preferably substantially identical according to the aforesaid test and criteria. The imagewise-formed dye deposits can preferably be cyan, magenta and yellow colored dye deposits. Other layer sensitivities and mixed dye deposits can be employed as known in the art.

In yet another preferred embodiment the layer order arrangement, sensitization scheme and image processing scheme disclosed by Arakawa et al. at U.S. Pat. No. 5,962,205, the disclosures of which are incorporated by reference, can be employed.

In another embodiment, a panchromatic or white light sensitive layer unit can be employed so as to be imagewise exposed through a colored filter array as known in the art.

By red sensitive is meant sensitivity to light in the 600 to 700 nm region of the electromagnetic spectrum. By green sensitive is meant sensitivity to light in the 500 to 600 nm region of the electromagnetic spectrum. By blue sensitivity is meant sensitivity to light in the 400 to 500 nm region of the electromagnetic spectrum. By pan-chromatic or white sensitivity is meant sensitivity to light in the 400 to 700 nm region of the electromagnetic spectrum.

A photographic element according to the present invention, comprising a support bearing a layer unit sensitive to a region of the electromagnetic spectrum which layer unit comprises a binder and, in reactive association, at least one dye-forming coupler, blocked color developing agent that becomes unblocked during thermal processing, photosensitive silver halide, and an oxidation-reduction image forming combination comprising (a) at least one metallic salt or complex of an organic compound as an oxidizing agent, and (b) an organic reducing agent or developing agent. When thermal development (Processing II) is carried out, , the thermally processed product (the developed film), according to the specified process parameters for the film, preferably exhibits a differential density in each record after scanning, a useful exposure latitude of at least 2.7 log E, and a $D_{min}$ less than 4.0. This would apply to three color records in a multilayer pack. More preferably, each record exhibits a gamma between 0.3 and 0.75, a $D_{min}$ less than 3.0, and an exposure latitude greater than 3.0 log E.

After imagewise exposure of the photographic element, the developing-agent precursor, in the presence of an optional acid or base, in an aqueous environment (in the absence of an external developing agent) at a temperature in excess of 50° C., releases a developing agent in reactive association with the silver-halide emulsion, thereby forming a first imagewise density deposit. The photographic element is further defined by herein alternatively contacting said element with a developer solution to form a second imagewise density deposit; said developer solution comprising a developing agent and having a pH greater than about 9; and said contacting occurring for between 10 and 500 seconds at a temperature below 50° C.; and wherein said second imagewise density deposit has substantially no density contribution [no more than 20% difference at $\lambda_{max}$] formed by release of a developing agent by said developing-agent precursor.

Another aspect of the invention is directed to a method of processing a commercial quantity of color photographic film sold to camera users over a given period of time, which film has been imagewise exposed in a camera, said film having at least three light-sensitive units which have their individual sensitivities in different wavelength regions, each of the units comprising at least one light-sensitive silver-halide emulsion, binder, and dye-providing coupler. The commercial quantity involved will typically involved over one thousand rolls over a period of within 3 months to 1 year, more typically over one-hundred-thousand rolls of film, preferably. The geographical area, a contiguous area containing a plurality of kiosks for thermal film development, will involve greater than 10,000 persons, typically greater than 100,000 persons, preferably greater than 1,000,000 persons, and may involve politically determined geographical areas such as countries or divisions thereof, for example, counties, cities, states in the US, or comparable geographical entities in other countries. A geographical area is meant to include the place from where the film is actually submitted for development or the residence of the consumers submitting the film, rather than the place of film development, especially for film developed by a traditional wet-chemical process. Preferably, the commercial quantity of film developed according to the invention will eventually involve an entire state or country in which the developed film will be over one million rolls developed in a given quarter (three-month period) of the year. By the term "substantial portion" is meant at least 5% of rolls of film, according to the present invention, developed in the given time period, preferably at least 10%. Preferably at least 25 to 99%, more preferably at least 50 to 90% of the film rolls in a given area and time period will be developed by the thermal process.

Accordingly, a substantial portion of said quantity of film will be developed by each of two routes (Routes A and B, respectively). A first route (A), by which a substantial portion of said quantity of film will be processed, will involve a color development step without any externally applied developing agent, by thermal treatment of the film, by heating the film at a temperature greater than 80° C., preferably greater than 100° C., more preferably greater than 120° C., without liquid saturation of the film, preferably in an essentially dry process without the addition of any aqueous solutions, such that an internally located blocked developing agent in reactive association with each of said three light-sensitive units becomes unblocked to form a developing agent, whereby the unblocked developing agent is imagewise oxidized on development and this oxidized form reacts with the dye-providing couplers to form a dye and thereby a color negative image, which color image may be scanned, optionally without desilvering, to provide a digital electronic record of the color image capable of generating a positive color image in a display element. The printed color image may, for example, be generated by thermal-diffusion or ink-jet printing.

A second route (B) will involve a color development step comprising contacting the imagewise exposed color photographic film with a developing agent comprising a non-blocked p-phenylenediamine developing agent, under agitation at a temperature of less than 60° C., preferably 30 to 50° C. under aqueous alkaline conditions, in order to form a color negative image in the film by reaction of the non-blocked p-phenylenediamine developing agent with the dye-providing couplers, the dyes formed from the dye-providing couplers in the three light-sensitive units being different in hue, followed by desilvering said film in one or more desilvering solutions to remove unwanted silver and silver halide, thereby forming a color negative image; and thereafter forming a positive-image color print from the desilvered film.

Preferably, the development processing Route B is carried out (i) for from 60 to 220, preferably 150 seconds to 200 seconds, (ii) at the temperature of a color developing solution of from 35 to 40° C., and (iii) using a color developing solution containing from 10 to 20 mmol/liter of a phenylenediamine developing agent.

Preferably, the development processing Route A is carried out (i) less than 60 seconds, (ii) at the temperature from 120 to 180° C., and (iii) without the application of any aqueous solution.

In one embodiment of a method according to the present invention, the consumer who submits the film for development makes the choice of either color development route described above. The blocked developing agent, after being unblocked, may be the same compound as the non-blocked developing agent.

Indicia on the film package sold to the consumer can instruct or inform the consumer that the photographic film may be either (a) thermally developed at an automated kiosk that develops and scans the photographic film, before optionally printing it on a recording element, or alternatively, (b) developed in a wet-chemical process involving consecutively immersing the photographic film in multiple tanks, including at least one tank for developing the photographic film and at least one tank for desilvering the film. By kiosk is meant an automated free-standing machine, self-contained and (in exchange for certain payments) capable of developing a roll of imagewise exposed film on a roll-by-roll basis, without the intervention of technicians or other third-party persons such as necessary in wet-chemical laboratories. Typically, the customer will initiate and control the carrying out of film processing and optional printing by means of a computer interface. Such kiosks typically will be less than 6 cubic meters in dimension, preferably about 3 cubic meters or less in dimension, and hence commercially transportable to diverse locations. Such kiosks may optionally comprise a heater for color development, a scanner for digitally recording the color image, and a device for transferring the color image to a display element.

Thus, according to the present invention, the same photographic element can be developed by either of two alternative routes, either Route A or Route B, the choice of the route for a given roll of film preferably at the discretion of the consumer.

Route A: This route is referred to as dry thermal process, wherein film processing is initiated by exposure to heat in the absence of processing solutions to develop the image. Processing solutions, however, may be used for post-development processing (after image formation) to fix, bleach, or otherwise treat the imaged film for archive purposes and/or for scanning.

Route B: This route may be referred to as a chemical wet-process, typically a commercially standardized process, in which the film elements are processed by contact with processing solutions, and the volume of such solutions is usually very large in comparison to the volume of the photographic layer.

Accordingly, when distributed to the consumer, the photographic element according to the present invention will be contained within a package including indicia indicating that the film may be processed and developed by either of two kinds of routes, which happen to correspond to (1) a wet-chemical process such as C-41 or the like, and (2) a dry thermal process, involve essentially no aqueous solution and with the use of an externally applied developing agent.

Preferably, the package of the film indicates either implicitly or explicitly (to the consumer wishing to have the film developed) that the film, at the consumer's option, may be either (1) developed at an automated kiosk that thermally develops and scans the film, before optionally printing it on a paper material, or alternatively, (2) developed in a wet-chemical process, usually standardized to a large extent, involving consecutively immersing the photographic element in multiple tanks, including at least one tank for developing the photographic element and at least one tank for desilvering. These two types of processing, Routes A and B, will now be described in more detail, beginning with Route A, the dry photothermographic process systems. After imagewise exposure of the photographic element (in fact, a photothermographic element by this route), the resulting latent image can be developed by heating the film at a temperature greater than 80° C., preferably greater than 100° C., more preferably greater than 120° C., without liquid saturation of the film, preferably in an essentially dry process without the addition of any aqueous solutions. This heating merely involves heating the photothermographic element to a temperature within the range above 80° C., preferably about 100° C. to 180° C., until a developed image is formed, such as within about 0.5 to about 60 seconds. By increasing or decreasing the thermal processing temperature a shorter or longer time of processing is useful. Heating means known in the photothermographic arts are useful for providing the desired processing temperature for the exposed photothermographic element. The heating means is, for example, a simple hot plate, iron, roller, heated drum, microwave heating means, heated air, vapor or the like. Thermal processing is preferably carried out under ambient conditions of pressure and humidity. Conditions outside of normal atmospheric pressure and humidity are useful.

The components of the photothermographic element can be in any location in the element that provides the desired image. If desired, one or more of the components can be in one or more layers of the element. For example, in some cases, it is desirable to include certain percentages of the reducing agent, toner, thermal solvent, stabilizer and/or other addenda in the overcoat layer over the photothermographic image recording layer of the element. This, in some cases, reduces migration of certain addenda in the layers of the element.

It is necessary that the components of the photographic combination be "in association" with each other in order to produce the desired image. The term "in association" herein means that in the photothermographic element the photographic silver halide and the imageforming combination are in a location with respect to each other that enables the desired processing and forms a useful image. This may include the location of components in different layers.

Scanning:

The photothermographic element, following color development as discussed above, may serve as origination material for some of all of the following processes: image scanning to produce an electronic rendition of the capture image, and subsequent digital processing of that rendition to manipulate, store, transmit, output, or display electronically that image.

It is contemplated that the design of the processor for the photothermographic element can be linked to the design of the cassette or cartridge used for storage and use of the element. Further, data stored on the film or cartridge may be used to modify processing conditions or scanning of the element. Methods for accomplishing these steps in the imaging system are disclosed in commonly assigned, co-pending U.S. patent applications Ser. Nos. 09/206586, 09/206,612, and 09/206,583 filed Dec. 7, 1998, which are incorporated herein by reference. The use of an apparatus whereby the processor can be used to write information onto the element, information which can be used to adjust processing, scanning, and image display is also envisaged. This system is disclosed in U.S. patent applications Ser. Nos. 09/206,914 filed Dec. 7, 1998 and 09/333,092 filed Jun. 15, 1999, which are incorporated herein by reference.

Once yellow, magenta, and cyan dye image records have been formed in the processed photographic elements of the invention, conventional techniques can be employed for retrieving the image information for each color record and manipulating the record for subsequent creation of a color balanced viewable image. For example, it is possible to scan the photographic element successively within the blue, green, and red regions of the spectrum or to incorporate blue, green, and red light within a single scanning beam that is divided and passed through blue, green, and red filters to form separate scanning beams for each color record. A simple technique is to scan the photographic element point-by-point along a series of laterally offset parallel scan paths. The intensity of light passing through the element at a scanning point is noted by a sensor which converts radiation received into an electrical signal. Most generally this electronic signal is further manipulated to form a useful electronic record of the image. For example, the electrical signal can be passed through an analog-to-digital converter and sent to a digital computer together with location information required for pixel (point) location within the image. In another embodiment, this electronic signal is encoded with calorimetric or tonal information to form an electronic record that is suitable to allow reconstruction of the image into viewable forms such as computer monitor displayed images, television images, printed images, and so forth.

It is contemplated that many of imaging elements of this invention will be scanned prior to the removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, that employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering.

One of the challenges encountered in producing images from information extracted by scanning is that the number of pixels of information available for viewing is only a fraction of that available from a comparable classical photographic print. It is, therefore, even more important in scan imaging to maximize the quality of the image information available. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily.

The elements of the invention can have density calibration patches derived from one or more patch areas on a portion of unexposed photographic recording material that was subjected to reference exposures, as described by Wheeler et al U.S. Pat. No. 5,649,260, Koeng at al U.S. Pat. No. 5,563,717, and by Cosgrove et al U.S. Pat. No. 5,644,647.

Illustrative systems of scan signal manipulation, including techniques for maximizing the quality of image records, are disclosed by Bayer U.S. Pat. No. 4,553,156; Urabe et al U.S. Pat. No. 4,591,923; Sasaki et al U.S. Pat. No. 4,631,578; Alkofer U.S. Pat. No. 4,654,722; Yamada et al U.S. Pat. No. 4,670,793; Klees U.S. Pat. Nos. 4,694,342 and 4,962,542; Powell U.S. Pat. No. 4,805,031; Mayne et al U.S. Pat. No. 4,829,370; Abdulwahab U.S. Pat. No. 4,839,721; Matsunawa et al U.S. Pat. Nos. 4,841,361 and 4,937,662; Mizukoshi et al U.S. Pat. No. 4,891,713; Petilli U.S. Pat. No. 4,912,569; Sullivan et al U.S. Pat. Nos. 4,920,501 and 5,070,413; Kimoto et al U.S. Pat. No. 4,929,979; Hirosawa et al U.S. Pat. No. 4,972,256; Kaplan U.S. Pat. No. 4,977,521; Sakai U.S. Pat. No. 4,979,027; Ng U.S. Pat. No. 5,003,494; Katayama et al U.S. Pat. No. 5,008,950; Kimura et al U.S. Pat. No. 5,065,255; Osamu et al U.S. Pat. No. 5,051,842; Lee et al U.S. Pat. No. 5,012,333; Bowers et al U.S. Pat. No. 5,107,346; Telle U.S. Pat. No. 5,105,266; MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984 and Davis U.S. Pat. No. 5,541,645.

The digital color records once acquired are in most instances adjusted to produce a pleasingly color balanced image for viewing and to preserve the color fidelity of the image bearing signals through various transformations or renderings for outputting, either on a video monitor or when printed as a conventional color print. Preferred techniques for transforming image bearing signals after scanning are disclosed by Giorgianni et al U.S. Pat. No. 5,267,030, the disclosures of which are herein incorporated by reference. Further illustrations of the capability of those skilled in the art to manage color digital image information are provided by Giorgianni and Madden *Digital Color Management*, Addison-Wesley, 1998.

FIG. 1 shows, in block diagram form, the manner in which the image information provided by the color negative elements of the invention is contemplated to be used. An image scanner 2 is used to scan by transmission an image-wise exposed and photographically processed color negative element 1 according to the invention. The scanning beam is most conveniently a beam of white light that is split after passage through the layer units and passed through filters to create separate image records-red recording layer unit image record (R), green recording layer unit image record (G), and blue recording layer unit image record (B). Instead of splitting the beam, blue, green, and red filters can be sequentially caused to intersect the beam at each pixel location. In still another scanning variation, separate blue, green, and red light beams, as produced by a collection of light emitting diodes, can be directed at each pixel location. As the element 1 is scanned pixel-by-pixel using an array detector, such as an array charge-coupled device (CCD), or line-by-line using a linear array detector, such as a linear array CCD, a sequence of R, G, and B picture element signals are generated that can be correlated with spatial location information provided from the scanner. Signal intensity and location information is fed to a workstation 4, and the information is transformed into an electronic form R', G', and B', which can be stored in any convenient storage device 5.

In motion imaging industries, a common approach is to transfer the color negative film information into a video signal using a telecine transfer device. Two types of telecine transfer devices are most common: (1) a flying spot scanner using photomultiplier tube detectors or (2) CCD's as sensors. These devices transform the scanning beam that has passed through the color negative film at each pixel location into a voltage. The signal processing then inverts the electrical signal in order to render a positive image. The signal is then amplified and modulated and fed into a cathode ray tube monitor to display the image or recorded onto magnetic tape for storage. Although both analog and digital image signal manipulations are contemplated, it is preferred to place the signal in a digital form for manipulation, since the overwhelming majority of computers are now digital and this facilitates use with common computer peripherals, such as magnetic tape, a magnetic disk, or an optical disk.

A video monitor 6, which receives the digital image information modified for its requirements, indicated by R", G", and B", allows viewing of the image information received by the workstation. Instead of relying on a cathode ray tube of a video monitor, a liquid crystal display panel or any other convenient electronic image viewing device can be substituted. The video monitor typically relies upon a picture control apparatus 3, which can include a keyboard and cursor, enabling the workstation operator to provide image manipulation commands for modifying the video image displayed and any image to be recreated from the digital image information.

Any modifications of the image can be viewed as they are being introduced on the video display 6 and stored in the storage device 5. The modified image information R'", G'", and B'" can be sent to an output device 7 to produce a recreated image for viewing. The output device can be any convenient conventional element writer, such as a thermal dye transfer, inkjet, electrostatic, electrophotographic, electrostatic, thermal dye sublimation or other type of printer. CRT or LED printing to sensitized photographic paper is also contemplated. The output device can be used to control the exposure of a conventional silver halide color paper. The output device creates an output medium 8 that bears the recreated image for viewing. It is the image in the output medium that is ultimately viewed and judged by the end user for noise (granularity), sharpness, contrast, and color balance. The image on a video display may also ultimately be viewed and judged by the end user for noise, sharpness, tone scale, color balance, and color reproduction, as in the case of images transmitted between parties on the World Wide Web of the Internet computer network.

Using an arrangement of the type shown in FIG. 1, the images contained in color negative elements in accordance with the invention are converted to digital form, manipulated, and recreated in a viewable form. Color negative recording materials according to the invention can be used with any of the suitable methods described in U.S. Pat. No. 5,257,030. In one preferred embodiment, Giorgianni et al provides for a method and means to convert the R, G, and B image-bearing signals from a transmission scanner to an image manipulation and/or storage metric which corresponds to the trichromatic signals of a reference image-producing device such as a film or paper writer, thermal printer, video display, etc. The metric values correspond to those which would be required to appropriately reproduce the color image on that device. For example, if the reference image producing device was chosen to be a specific video display, and the intermediary image data metric was chosen to be the R', G', and B' intensity modulating signals (code values) for that reference video display, then for an input film, the R, G, and B image-bearing signals from a scanner would be transformed to the R', G', and B' code values corresponding to those which would be required to appropriately reproduce the input image on the reference video display. A data-set is generated from which the mathematical transformations to convert R, G, and B image-bearing signals to the aforementioned code values are derived. Exposure patterns, chosen to adequately sample and cover the useful exposure range of the film being calibrated, are created by exposing a pattern generator and are fed to an exposing apparatus. The exposing apparatus produces trichromatic exposures on film to create test images consisting of approximately 150 color patches. Test images may be created using a variety of methods appropriate for the application. These methods include: using exposing apparatus such as a sensitometer, using the output device of a color imaging apparatus, recording images of test objects of known reflectances illuminated by known light sources, or calculating trichromatic exposure values using methods known in the photographic art. If input films of different speeds are used, the overall red, green, and blue exposures must be properly adjusted for each film in order to compensate for the relative speed differences among the films. Each film thus receives equivalent exposures, appropriate for its red, green, and blue speeds. The exposed film is processed chemically. Film color patches are read by transmission scanner which produces R, G, and B image-bearing signals corresponding each color patch. Signal-value patterns of code value pattern generator produces RGB intensity-modulating signals which are fed to the reference video display. The R', G', and B' code values for each test color are adjusted such that a color matching apparatus, which may correspond to an instrument or a human observer, indicates that the video display test colors match the positive film test colors or the colors of a printed negative. A transform apparatus creates a transform relating the R, G, and B image-bearing signal values for the film's test colors to the R', G', and B' code values of the corresponding test colors.

The mathematical operations required to transform R, G, and B image-bearing signals to the intermediary data may consist of a sequence of matrix operations and look-up tables (LUT's).

Figure 2:
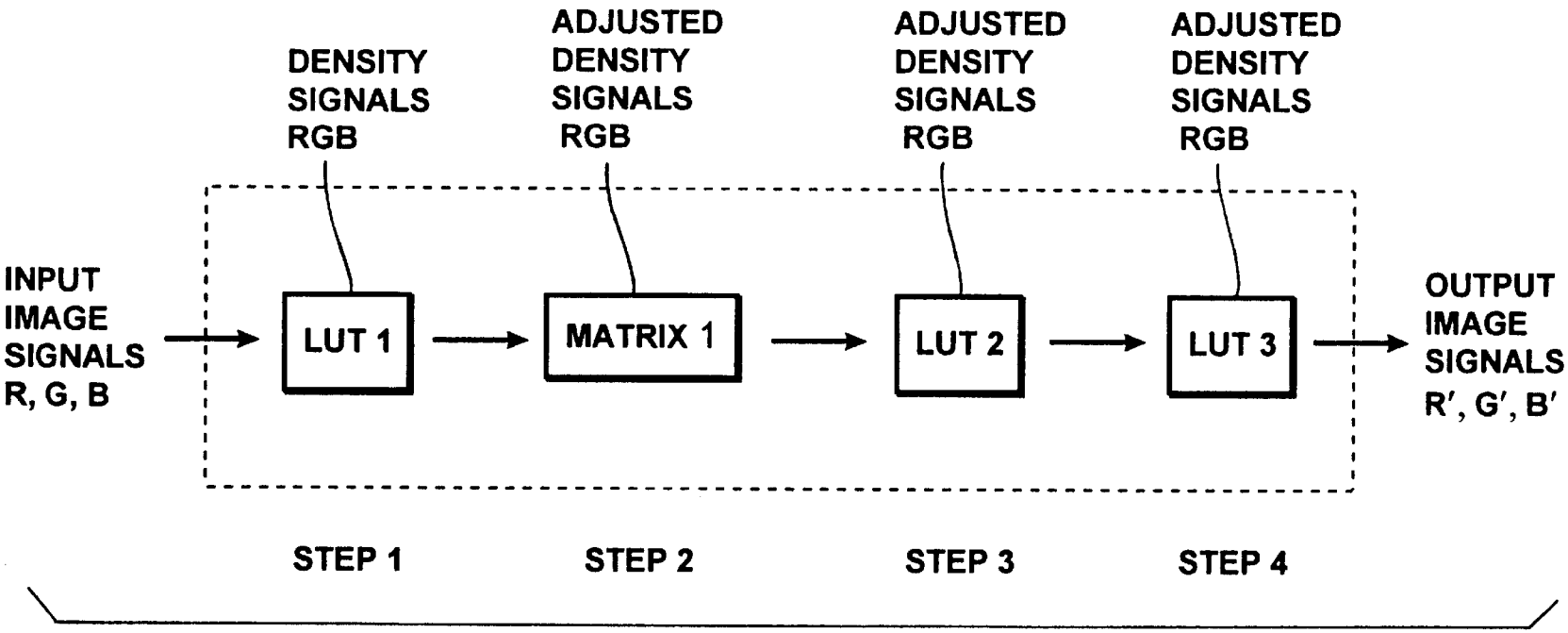
FIG. 2 shows a block diagram showing electronic signal processing of image bearing signals derived from scanning a developed color element according to the invention.

Referring to FIG. 2, in a preferred embodiment of the present invention, input image-bearing signals R, G, and B are transformed to intermediary data values corresponding to the R', G', and B' output image-bearing signals required to appropriately reproduce the color image on the reference output device as follows:

(1) The R, G, and B image-bearing signals, which correspond to the measured transmittances of the film, are converted to corresponding densities in the computer used to receive and store the signals from a film scanner by means of 1-dimensional look-up table LUT 1.

(2) The densities from step (1) are then transformed using matrix 1 derived from a transform apparatus to create intermediary image-bearing signals.

(3) The densities of step (2) are optionally modified with a 1-dimensional look-up table LUT 2 derived such that the neutral scale densities of the input film are transformed to the neutral scale densities of the reference.

(4) The densities of step (3) are transformed through a 1-dimensional look-up table LUT 3 to create corresponding R', G', and B' output image-bearing signals for the reference output device.

It will be understood that individual look-up tables are typically provided for each input color. In one embodiment, three 1-dimensional look-up tables can be employed, one for each of a red, green, and blue color record. In another embodiment, a multi-dimensional look-up table can be employed as described by D'Errico at U.S. Pat. No. 4,941,039. It will be appreciated that the output image-bearing signals for the reference output device of step 4 above may be in the form of device-dependent code values or the output image-bearing signals may require further adjustment to become device specific code values. Such adjustment may be accomplished by further matrix transformation or 1-dimensional look-up table transformation, or a combination of such transformations to properly prepare the output image-bearing signals for any of the steps of transmitting, storing, printing, or displaying them using the specified device.

In a second preferred embodiment of the invention, the R, G, and B image-bearing signals from a transmission scanner are converted to an image manipulation and/or storage metric which corresponds to a measurement or description of a single reference image-recording device and/or medium and in which the metric values for all input media correspond to the trichromatic values which would have been formed by the reference device or medium had it captured the original scene under the same conditions under which the input media captured that scene. For example, if the reference image recording medium was chosen to be a specific color negative film, and the intermediary image data metric was chosen to be the measured RGB densities of that reference film, then for an input color negative film according to the invention, the R, G, and B image-bearing signals from a scanner would be transformed to the R', G', and B' density values corresponding to those of an image which would have been formed by the reference color negative film had it been exposed under the same conditions under which the color negative recording material according to the invention was exposed.

Exposure patterns, chosen to adequately sample and cover the useful exposure range of the film being calibrated, are created by exposing a pattern generator and are fed to an exposing apparatus. The exposing apparatus produces trichromatic exposures on film to create test images consisting of approximately 150 color patches. Test images may be created using a variety of methods appropriate for the application. These methods include: using exposing apparatus such as a sensitometer, using the output device of a color imaging apparatus, recording images of test objects of known reflectances illuminated by known light sources, or calculating trichromatic exposure values using methods known in the photographic art. If input films of different speeds are used, the overall red, green, and blue exposures must be properly adjusted for each film in order to compensate for the relative speed differences among the films. Each film thus receives equivalent exposures, appropriate for its red, green, and blue speeds. The exposed film is processed chemically. Film color patches are read by a transmission scanner which produces R, G, and B image-bearing signals corresponding each color patch and by a transmission densitometer which produces R', G', and B' density values corresponding to each patch. A transform apparatus creates a transform relating the R, G, and B image-bearing signal values for the film's test colors to the measured R', G', and B' densities of the corresponding test colors of the reference color negative film. In another preferred variation, if the reference image recording medium was chosen to be a specific color negative film, and the intermediary image data metric was chosen to be the predetermined R', G', and B' intermediary densities of step 2 of that reference film, then for an input color negative film according to the invention, the R, G, and B image-bearing signals from a scanner would be transformed to the R', G', and B' intermediary density values corresponding to those of an image which would have been formed by the reference color negative film had it been exposed under the same conditions under which the color negative recording material according to the invention was exposed.

Thus, each input film calibrated according to the present method would yield, insofar as possible, identical intermediary data values corresponding to the R', G', and B' code values required to appropriately reproduce the color image which would have been formed by the reference color negative film on the reference output device. Uncalibrated films may also be used with transformations derived for similar types of films, and the results would be similar to those described.

The mathematical operations required to transform R, G, and B image-bearing signals to the intermediary data metric of this preferred embodiment may consist of a sequence of matrix operations and 1-dimensional LUTs. Three tables are typically provided for the three input colors. It is appreciated that such transformations can also be accomplished in other embodiments by employing a single mathematical operation or a combination of mathematical operations in the computational steps produced by the host computer including, but not limited to, matrix algebra, algebraic expressions dependent on one or more of the image-bearing signals, and n-dimensional LUTs. In one embodiment, matrix 1 of step 2 is a 3×3 matrix. In a more preferred embodiment, matrix 1 of step 2 is a 3×10 matrix. In a preferred embodiment, the 1-dimensional LUT 3 in step 4 transforms the intermediary image-bearing signals according to a color photographic paper characteristic curve, thereby reproducing normal color print image tone scale. In another preferred embodiment, LUT 3 of step 4 transforms the intermediary image-bearing signals according to a modified viewing tone scale that is more pleasing, such as possessing lower image contrast.

Due to the complexity of these transformations, it should be noted that the transformation from R, G, and B to R', G', and B' may often be better accomplished by a 3-dimensional LUT. Such 3-dimensional LUTs may be developed according to the teachings J. D'Errico in U.S. Pat. No. 4,941,039.

It is to be appreciated that while the images are in electronic form, the image processing is not limited to the specific manipulations described above. While the image is in this form, additional image manipulation may be used including, but not limited to, standard scene balance algorithms (to determine corrections for density and color balance based on the densities of one or more areas within the negative), tone scale manipulations to amplify film underexposure gamma, non-adaptive or adaptive sharpening via convolution or unsharp masking, red-eye reduction, and non-adaptive or adaptive grain-suppression. Moreover, the image may be artistically manipulated, zoomed, cropped, and combined with additional images or other manipulations known in the art. Once the image has been corrected and any additional image processing and manipulation has occurred, the image may be electronically transmitted to a remote location or locally written to a variety of output devices including, but not limited to, silver halide film or paper writers, thermal printers, electrophotographic printers, inkjet printers, display monitors, CD disks, optical and magnetic electronic signal storage devices, and other types of storage and display devices as known in the art.

The Route B process (wet-chemical process) will now be described in more detail. Photographic elements comprising the composition of the invention can be processed in any of a number of well-known photographic processes utilizing any of a number of well-known processing compositions, described, for example, in Research Disclosure II, or in T. H. James, editor, *The Theory of the Photographic Process*, 4th Edition, Macmillan, New York, 1977. The development process may take place for a specified length of time and temperature, with minor variations, which process parameters are suitable to render an acceptable image.

In the case of processing a negative working element, the element is treated with a color developing agent (that is one which will form the colored image dyes with the color couplers), and then with a oxidizer and a solvent to remove silver and silver halide. The developing agents are of the phenylenediamine type, as described below. Preferred color developing agents are p-phenylenediamines, especially any one of the following:

4-amino N,N-diethylaniline hydrochloride, 4-amino-3-methyl-N,N-diethylaniline hydrochloride, 4-amino-3-methyl-N-ethyl-N-(2-(methanesulfonamido) ethylaniline sesquisulfate hydrate, 4-amino-3-methyl-N-ethyl-N-(2-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

The color developer composition can be easily prepared by mixing a suitable color developer in a suitable solution. Water can be added to the resulting composition to provide the desired composition. And the pH can be adjusted to the desired value with a suitable base such as sodium hydroxide.

The color developer solution for wet-chemical development can include one or more of a variety of other addenda which are commonly used in such compositions, such as antioxidants, alkali metal halides such as potassium chloride, metal sequestering agents such as aminocarboxylic acids, buffers to maintain the pH from about 9 to about 13, such as carbonates, phosphates, and borates, preservatives, development accelerators, optical brightening agents, wetting agents, surfactants, and couplers as would be understood to the skilled artisan. The amounts of such additives are well known in the art.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, Research Disclosure, Vol. 116, December, 1973, Item 11660, and Bissonette Research Disclosure, Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development is followed by desilvering, such as bleach-fixing, in a single or multiple steps, typically involving tanks, to remove silver or silver halide, washing and drying. The desilvering in a wet-chemical process may include the use of bleaches or bleach fixes. Bleaching agents of this invention include compounds of polyvalent metal such as iron (III), cobalt (III), chromium (VI), and copper (II), persulfates, quinones, and nitro compounds. Typical bleaching agents are iron (III) salts, such as ferric chloride, ferricyanides, bichromates, and organic complexes of iron (III) and cobalt (III). Polyvalent metal complexes, such as ferric complexes, of aminopolycarboxylic acids and persulfate salts are preferred bleaching agents, with ferric complexes of aminopolycarboxylic acids being preferred for bleach-fixing solutions. Examples of useful ferric complexes include complexes of:

nitrilotriacetic acid, ethylenediaminetetraacetic acid, 3-propylenediamine tetraacetic acid, diethylenetriamine pentaacetic acid, ethylenediamine succinic acid, ortho-diamine cyclohexane tetraacetic acid ethylene glycol bis(aminoethyl ether)tetraacetic acid, diaminopropanol tetraacetic acid, N-(2-hydroxyethyl)ethylenediamine triacetic acid, ethyliminodipropionic acid, methyliminodiacetic acid, ethyliminodiacetic acid, cyclohexanediaminetetraacetic acid glycol ether diamine tetraacetic acid.

Preferred aminopolycarboxylic acids include 1,3-propylenediamine tetraacetic acid, methyliminodiactic acid and ethylenediamine tetraacetic acid. The bleaching agents may be used alone or in a mixture of two or more; with useful amounts typically being at least 0.02 moles per liter of bleaching solution, with at least 0.05 moles per liter of bleaching solution being preferred. Examples of ferric chelate bleaches and bleach-fixes, are disclosed in DE 4,031,757 and U.S. Pat. Nos. 4,294,914; 5,250,401; 5,250,402; EP 567,126; 5,250,401; 5,250,402 and U.S. patent application Ser. No. 08/128,626 filed Sep. 28, 1993.

Typical persulfate bleaches are described in Research Disclosure, December 1989, Item 308119, published by Kenneth Mason Publications, Ltd., Dudley Annex, 12a North Street, Emsworth, Hampshire P010 & DQ, England, the disclosures of which are incorporated herein by reference. This publication will be identified hereafter as Research Disclosure BL. Useful persulfate bleaches are also described in Research Disclosure, May, 1977, Item 15704; Research Disclosure, August, 1981, Item 20831; and DE 3,919,551. Sodium, potassium and ammonium persulfates are preferred, and for reasons of economy and stability, sodium persulfate is most commonly used.

A bleaching composition may be used at a pH of 2.0 to 9.0. The preferred pH of the bleach composition is between 3 and 7. If the bleach composition is a bleach, the preferred pH is 3 to 6. If the bleach composition is a bleach-fix, the preferred pH is 5 to 7. In one embodiment, the color developer and the first solution with bleaching activity may be separated by at least one processing bath or wash (intervening bath) capable of interrupting dye formation. This intervening bath may be an acidic stop bath, such as sulfuric or acetic acid; a bath that contains an oxidized developer scavenger, such as sulfite; or a simple water wash. Generally an acidic stop bath is used with persulfate bleaches.

Examples of counterions which may be associated with the various salts in these bleaching solutions are sodium, potassium, ammonium, and tetraalkylammonium cations. It may be preferable to use alkali metal cations (especially sodium and potassium cations) in order to avoid the aquatic toxicity associated with ammonium ion. In some cases, sodium may be preferred over potassium to maximize the solubility of the persulfate salt. Additionally, a bleaching solution may contain anti-calcium agents, such as 1-hydroxyethyl-1, 1-diphosphonic acid; chlorine scavengers such as those described in G. M. Einhaus and D. S. Miller, Research Disclosure, 1978, vol 175, p. 42, No. 17556; and corrosion inhibitors, such as nitrate ion, as needed.

Bleaching solutions may also contain other addenda known in the art to be useful in bleaching compositions, such as sequestering agents, sulfites, non-chelated salts of aminopolycarboxylic acids, bleaching accelerators, re-halogenating agents, halides, and brightening agents. In addition, water-soluble aliphatic carboxylic acids such as acetic acid, citric acid, propionic acid, hydroxyacetic acid, butyric acid, malonic acid, succinic acid and the like may be utilized in any effective amount. Bleaching compositions may be formulated as the working bleach solutions, solution concentrates, or dry powders. The bleach compositions of this invention can adequately bleach a wide variety of photographic elements in 30 to 240 seconds.

Bleaches may be used with any compatible fixing solution. Examples of fixing agents which may be used in either the fix or the bleach fix are water-soluble solvents for silver halide such as: a thiosulfate (e.g., sodium thiosulfate and ammonium thiosulfate); a thiocyanate (e.g., sodium thiocyanate and ammonium thiocyanate); a thioether compound (e.g., ethylenebisthioglycolic acid and 3,6-dithia-1,8-octanediol); or a thiourea. These fixing agents can be used singly or in combination. Thiosulfate is preferably used. The concentration of the fixing agent per liter is preferably about 0.2 to 2 mol. The pH range of the fixing solution is preferably 3 to 10 and more preferably 5 to 9. In order to adjust the pH of the fixing solution an acid or a base may be added, such as hydrochloric acid, sulfuric acid, nitric acid, acetic acid, bicarbonate, ammonia, potassium hydroxide, sodium hydroxide, sodium carbonate or potassium carbonate.

The fixing or bleach-fixing solution may also contain a preservative such as a sulfite (e.g., sodium sulfite, potassium sulfite, and ammonium sulfite), a bisulfite (e.g., ammonium bisulfite, sodium bisulfite, and potassium bisulfite), and a metabisulfite (e.g., potassium metabisulfite, sodium metabisulfite, and ammonium metabisulfite). The content of these compounds is about 0 to 0.50 mol/liter, and more preferably 0.02 to 0.40 mol/liter as an amount of sulfite ion. Ascorbic acid, a carbonyl bisulfite acid adduct, or a carbonyl compound may also be used as a preservative.

The above mentioned bleach and fixing baths may have any desired tank configuration including multiple tanks, counter current and/or co-current flow tank configurations. A stabilizer bath is commonly employed for final washing and hardening of the bleached and fixed photographic element prior to drying. Alternatively, a final rinse may be used. A bath can be employed prior to color development, such as a prehardening bath, or the washing step may follow the stabilizing step. Other additional washing steps may be utilized. Conventional techniques for processing are illustrated by Research Disclosure BL, Paragraph XIX.

Examples of how processing of a film according to the present invention in a wet-chemical process may occur are as follows:

(1) development→bleaching→fixing (2) development→bleach fixing (3) development→bleach fixing→fixing (4) development→bleaching→bleach fixing (5) development→bleaching→bleach fixing→fixing (6) development→bleaching→washing→fixing (7) development→washing or rinsing→bleaching→fixing (8) development→washing or rinsing→bleach fixing (9) development→fixing→bleach fixing

(10) development→stopping→bleaching→fixing

(11) development→stopping→bleach fixing

A photographic element according to the present invention, in order to enable option thermal processing includes a blocked developing agent. The blocked developer suitably releases a developing agent under thermal processing conditions while providing substantially no density to the image during alternate wet-chemical processing, for example, C-41 processing. A preferred blocked developer has the following group, wherein a linking group is attached to the 1-nitrogen of the aniline ring:

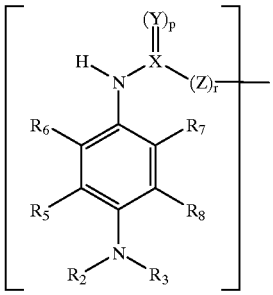

wherein $R_2$ and $R_3$ are independently hydrogen or a substituted or unsubstituted alkyl group or $R_2$ and $R_3$ are connected to form a ring. Substituents include, for example, hydroxy, halogen, halogenated alkyl, alkyl ether, alkylsulfonamido, sulfonamido groups, and other substitutions known in the art. The above structure includes the free base and neutral and photographically compatible salt forms thereof.

Furthermore, $R_5$, $R_6$, $R_7$, and $R_8$ are independently hydrogen, halogen, hydroxy, amino, alkoxy, carbonamido, sulfonamido, alkylsulfonamido or alkyl, or $R_5$ can connect with $R_2$ or $R_6$ and/or $R_8$ can connect to $R_3$ or $R_7$ to form a ring; and wherein X represents carbon or sulfur;

Y represents oxygen, sulfur or N—$R_1$, where $R_1$ is substituted or unsubstituted alkyl or substituted or unsubstituted aryl;

p is 1 or 2;

Z represents carbon, oxygen or sulfur;

r is 0 or 1;

with the proviso that when X is carbon, both p and r are 1, when X is sulfur, Y is oxygen, p is 2 and r is 0;

Illustrative linking groups include, for example,

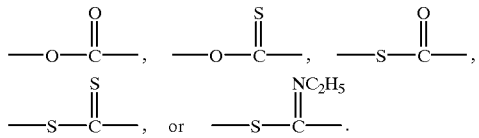

Preferably, the $t_{1/2}$ of the blocked developing agent is about 5.0 or less, preferably less than about 3.0 min, more preferably less than about 2 min, most preferably less than about 1.0, by the DMSO thermal stability test described in the examples below. The bond between the X and N atoms, in the above structure, provides a breakable linkage for unblocking of the developing agent during use.

More recently developed blocked developing agents are included in commonly assigned application U.S. Ser. No. 09/475,703, U.S. Pat. Nos. 6,426,179, 6,312,879, 6,306,551, 6,395,460, the disclosures of which are incorporated herein by reference in their entirety. Further improvements in blocked developers are disclosed in U.S. Ser. No. 09/718,014, U.S. Ser. No. 09/711,548 and U.S. Pat. Nos. 6,413,708, 6,319,640. Yet other improvements in blocked developers and their use in photothermographic elements are found in commonly assigned copending applications, filed concurrently herewith, U.S. Ser. No. 09/718,027, U.S. Ser. No. 09/717,742, and U.S. Ser. No. 09/710,348.

In any case, the developing agent, after unblocking should be a phenylenediamine compound, meaning the type of developing agent having two (para) substituted or unsubstituted amine groups on a six carbon aromatic ring, which compound preferably has the following structure:

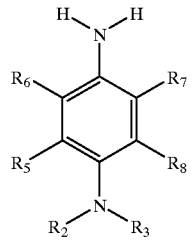

wherein $R_2$ and $R_3$ are independently hydrogen or a substituted or unsubstituted alkyl group or $R_2$ and $R_3$ are connected to form a ring. Substituents include, for example, hydroxy, halogen, halogenated alkyl, alkyl ether, alkylsulfonamido, sulfonamido groups, and other substitutions known in the art. The above structure includes the free base and neutral and photographically compatible salt forms thereof.

$R_5$, $R_6$, $R_7$, and $R_8$ are independently hydrogen, halogen, hydroxy, amino, alkoxy, carbonamido, sulfonamido, alkylsulfonamido or alkyl, or $R_5$ can connect with $R_2$ or $R_6$ and/or $R_8$ can connect to $R_3$ or $R_7$ to form a ring.

A variety of blocked phenylenediamine developing agents may be used in the present invention. The blocked developing agents should be selected so that the internal blocked developing agent does not react with dye-providing couplers in the photographic element during wet-chemical processing, for example during C-41 process conditions. Thus, the blocked developing agent should not competitively react with the dye-providing couplers inside the silver-halide emulsions during a C41 process or the like, before being washed out of the silver-halide emulsion. Preferably, during the C-41 process, less than 10 mole percent of the blocked developing agent reacts with the dye-providing couplers inside the silver-halide emulsions of the photographic element, preferably less than 5 mole percent. Typically the blocked developing agent is washed from the photographic element during wet-chemical processing.

Examples of blocked developers that can be used in photographic elements of the present invention include, but are not limited to, the blocked developing agents described in U.S. Pat. No. 3,342,599, to Reeves; *Research Disclosure* (129 (1975) pp. 27–30) published by Kenneth Mason Publications, Ltd., Dudley Annex, 12a North Street, Emsworth, Hampshire P010 7DQ, ENGLAND; U.S. Pat. No. 4,157,915, to Hamaoka et al.; U.S. Pat. No. 4,060,418, to Waxman and Mourning; and in U.S. Pat. No. 5,019,492. Particularly useful are those blocked developers described in U.S. application Ser. No. 09/476,234, filed Dec. 30, 1999, IMAGING ELEMENT CONTAINING A BLOCKED PHOTOGRAPICALLY USEFUL COMPOUND; U.S. application Ser. No. 09/475,691, filed Dec. 30, 1999, IMAGING ELEMENT CONTAINING A BLOCKED PHOTOGRAPHICALLY USEFUL COMPOUND; U.S. application Ser. No. 09/475,703, filed Dec. 30, 1999, IMAGING ELEMENT CONTAINING A BLOCKED PHOTOGRAPHICALLY USEFUL COMPOUND; U.S. application Ser. No. 09/475,690, filed Dec. 30, 1999, IMAGING ELEMENT CONTAINING A BLOCKED PHOTOGRAPHICALLY USEFUL COMPOUND; and U.S. application Ser. No. 09/476,233, filed Dec. 30, 1999, PHOTOGRAPHIC OR photothermographic ELEMENT CONTAINING A BLOCKED PHOTOGRAPHICALLY USEFUL COMPOUND. Further improvements in blocked developers are disclosed in U.S. Ser. No. 09/710,341, U.S. Ser. No. 09/718,014, U.S. Ser. No. 09/711,769, U.S. Ser. No. 09/711,548, and U.S. Ser. No. 09/710,348. Yet other improvements in blocked developers and their use in photothermographic elements are found in commonly assigned copending applications, filed concurrently herewith, U.S. Ser. No. 09/718,027 and U.S. Ser. No. 09/717,742.

In one embodiment of the invention blocked developer for use in the present invention may be represented by the following Structure I:

$$\text{DEV—(LINK 1)}_l\text{—(TIME)}_m\text{—(LINK 2)}_n\text{—B} \qquad \text{(I)}$$

wherein,

DEV is a silver-halide color developing agent;

LINK 1 and LINK 2 are linking groups;

TIME is a timing group;

l is 0 or 1;

m is 0, 1, or 2;

n is 0 or 1;

l+n is 1 or 2;

B is a blocking group or B is:

$$\text{B'—(LINK 2)}_n\text{—(TIME)}_m\text{—(LINK 1)}_l\text{—DEV}$$

wherein B' also blocks a second developing agent DEV.

In a preferred embodiment of the invention, LINK 1 or LINK 2 are of Structure II:

II

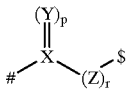

wherein

X represents carbon or sulfur;

Y represents oxygen, sulfur of N—$R_1$, where $R_1$ is substituted or unsubstituted alkyl or substituted or unsubstituted aryl;

p is 1 or 2;

Z represents carbon, oxygen or sulfur;

r is 0 or 1;

with the proviso that when X is carbon, both p and r are 1, when X is sulfur, Y is oxygen, p is 2 and r is 0;

# denotes the bond to PUG (for LINK 1) or TIME (for LINK 2):

$ denotes the bond to TIME (for LINK 1) or $T_{(t)}$ substituted carbon (for LINK 2).

Illustrative linking groups include, for example,

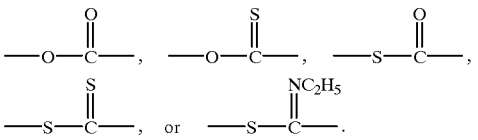

TIME is a timing group. Such groups are well-known in the art such as (1) groups utilizing an aromatic nucleophilic substitution reaction as disclosed in U.S. Pat. No. 5,262,291; (2) groups utilizing the cleavage reaction of a hemiacetal (U.S. Pat. No. 4,146,396, Japanese Applications 60-249148; 60-249149); (3) groups utilizing an electron transfer reaction along a conjugated system (U.S. Pat. No. 4,409,323; 4,421,845; Japanese Applications 57-188035; 58-98728; 58-209736; 58-209738); and (4) groups using an intramolecular nucleophilic substitution reaction (U.S. Pat. No. 4,248,962).

Illustrative timing groups are illustrated by formulae T-1 through T-4.

T-1

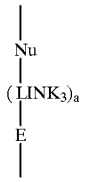

wherein:

Nu is a nucleophilic group;

E is an electrophilic group comprising one or more carbo- or hetero- aromatic rings, containing an electron deficient carbon atom;

LINK 3 is a linking group that provides 1 to 5 atoms in the direct path between the nucleopnilic site of Nu and the electron deficient carbon atom in E; and a is 0 or 1.

Such timing groups include, for example:

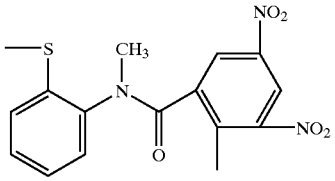

And

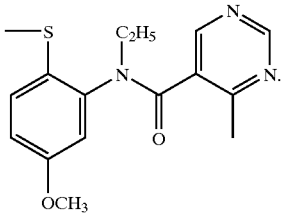

These timing groups are described more fully in U.S. Pat. No. 5,262,291, incorporated herein by reference.

T-2

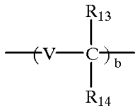

wherein

V represents an oxygen atom, a sulfur atom, or an

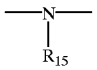

group;

$R_{13}$ and $R_{14}$ each represents a hydrogen atom or a substituent group;

$R_{15}$ represents a substituent group; and b represents 1 or 2.

Typical examples of $R_{13}$ and $R_{14}$, when they represent substituent groups, and $R_{15}$ include

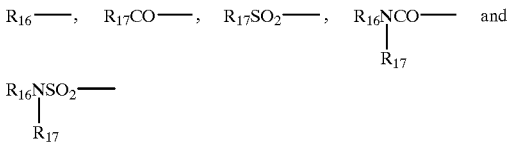

where, $R_{16}$ represents an aliphatic or aromatic hydrocarbon residue, or a heterocyclic group; and $R_{17}$ represents a hydrogen atom, an aliphatic or aromatic hydrocarbon residue, or a heterocyclic group, $R_{13}$, $R_{14}$ and $R_{15}$ each may represent a divalent group, and any two of them combine with each other to complete a ring structure. Specific examples of the group represented by formula (T-2) are illustrated below.

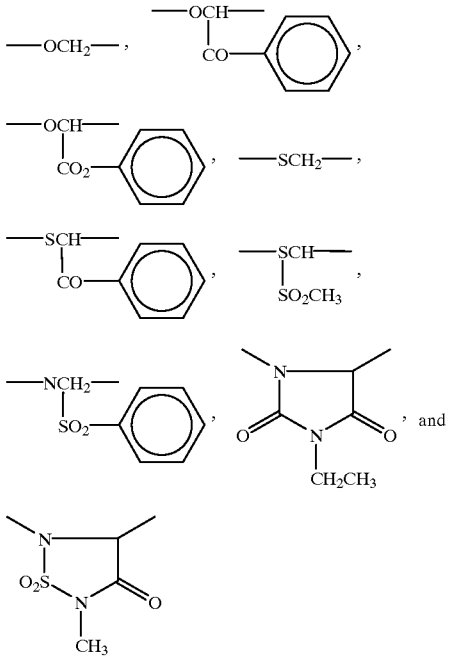

T-3 wherein Nu 1 represents a nucleophilic group, and an oxygen or sulfur atom can be given as an example of nucleophilic species; E1 represents an electrophilic group being a group which is subjected to nucleophilic attack by Nu 1; and LINK 4 represents a linking group which enables Nu 1 and E1 to have a steric arrangement such that an intramolecular nucleophilic substitution reaction can occur. Specific examples of the group represented by formula (T-3) are illustrated below.

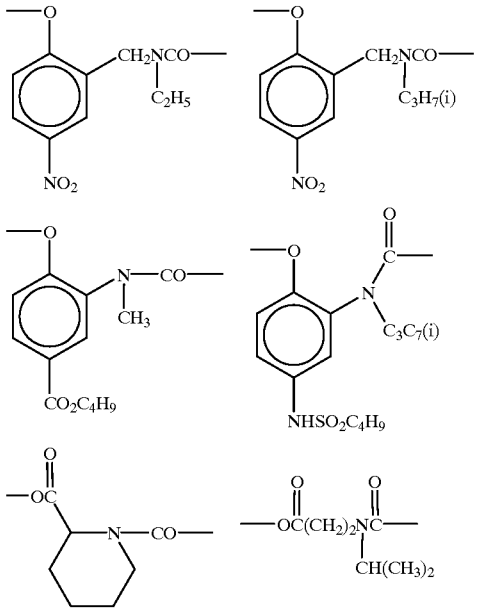

-continued

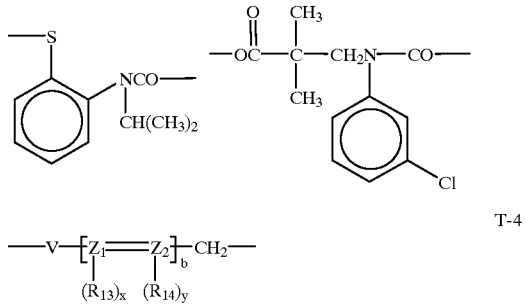

T-4 wherein V, $R_{13}$, $R_{14}$ and b all have the same meaning as in formula (T-2), respectively. In addition, $R_{13}$ and $R_{14}$ may be joined together to form a benzene ring or a heterocyclic ring, or V may be joined with $R_{13}$ or $R_{14}$ to form a benzene or heterocyclic ring. $Z_1$ and $Z_2$ each independently represents a carbon atom or a nitrogen atom, and x and y each represents 0 or 1.

Specific examples of the timing group (T-4) are illustrated below.

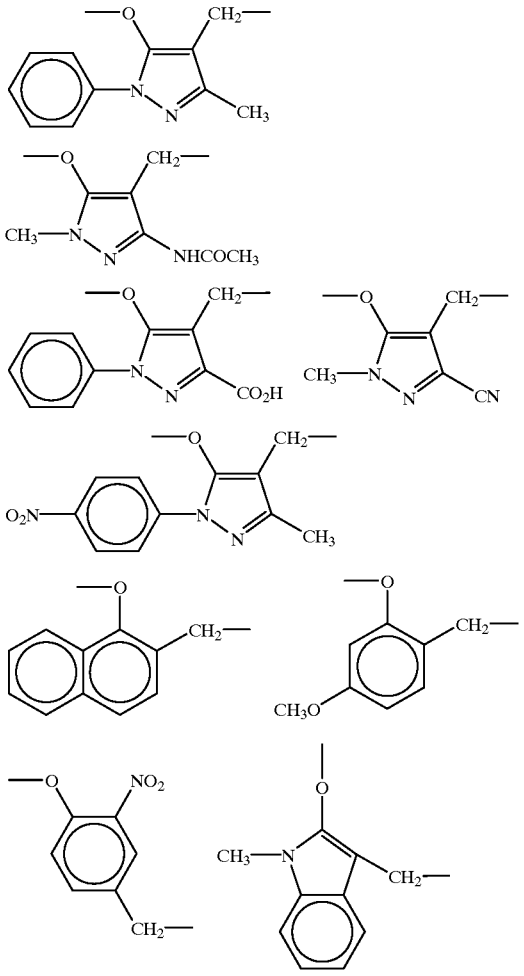

-continued

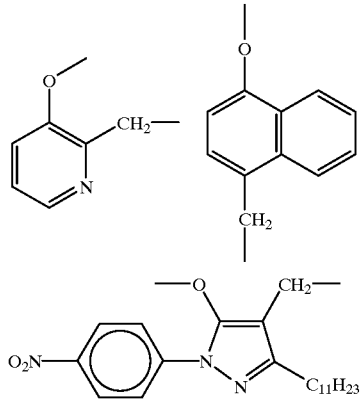

In a preferred embodiment of the invention, the color photothermographic element of the present invention comprises a blocked developer having a half life of less than or equal to 20 minutes and a peak discrimination, at a temperature of at least 60° C., of at least 2.0, which blocked developer is represented by the following Structure III:

III

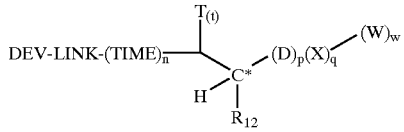

wherein:

DEV is a developing agent;

LINK is a linking group;

TIME is a timing group;

n is 0, 1, or 2;

t is 0, 1, or 2, and when t is not 2, the necessary number of hydrogens (2-t) are present in the structure;

C* is tetrahedral ($sp^3$ hybridized) carbon;

p is 0 or 1;

q is 0 or 1;

w is 0 or 1;

p+q=1 and when p is 1, q and w are both 0; when q is 1, then w is 1;

$R_{12}$ is hydrogen, or a substituted or unsubstituted alkyl, cycloalkyl, aryl or heterocyclic group or $R_{12}$ can combine with W to form a ring;

T is independently selected from a substituted or unsubstituted (referring to the following T groups) alkyl group, cycloalkyl group, aryl, or heterocyclic group, an inorganic monovalent electron withdrawing group, or an inorganic divalent electron withdrawing group capped with at least one C1 to C10 organic group (either an $R_{13}$ or an $R_{13}$ and $R_{14}$ group), preferably capped with a substituted or unsubstituted alkyl or aryl group; or T is joined with W or $R_{12}$ to form a ring; or two T groups can combine to form a ring;

T is an activating group when T is an (organic or inorganic) electron withdrawing group, an aryl group substituted with one to seven electron withdrawing groups, or a substituted or unsubstituted heteroaromatic group. Preferably, T is an inorganic group such as halogen, —$NO_2$, —CN; a halogenated alkyl group, for example —$CF_3$, or an inorganic electron withdrawing group capped by $R_{13}$ or by $R_{13}$ and $R_{14}$, for example, —$SO_2R_{13}$, —$OSO_2R_{13}$, —$NR_{14}(SO_2R_{13})$, —$CO_2R_{13}$, —$COR_{13}$, —$NR_{14}(COR_{13})$, etc. A particularly preferred T group is an aryl group substituted with one to seven electron withdrawing groups.

D is a first activating group selected from substituted or unsubstituted (referring to the following D groups) heteroaromatic group or aryl group or monovalent electron withdrawing group, wherein the heteroaromatic can optionally form a ring with T or $R_{12}$;

X is a second activating group and is a divalent electron withdrawing group. The X groups comprise an oxidized carbon, sulfur, or phosphorous atom that is connected to at least one W group. Preferably, the X group does not contain any tetrahedral carbon atoms except for any side groups attached to a nitrogen, oxygen, sulfur or phosphorous atom. The X groups include, for example, —CO—, —$SO_2$—, —$SO_2O$—, —COO—, —$SO_2N(R_{15})$—, —$CON(R_{15})$—, —OPO $(OR_{15})$—, —$PO(OR_{15})N(R_{16})$—, and the like, in which the atoms in the backbone of the X group (in a direct line between the C* and W) are not attached to any hydrogen atoms.

W is W' or a group represented by the following Structure IIIA:

IA

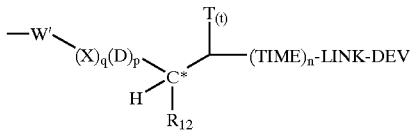

W' is independently selected from a substituted or unsubstituted (referring to the following W' groups) alkyl (preferably containing 1 to 6 carbon atoms), cycloalkyl (including bicycloalkyls, but preferably containing 4 to 6 carbon atoms), aryl (such as phenyl or naphthyl) or heterocyclic group; and wherein W' in combination with T or $R_{12}$ can form a ring (in the case of Structure IIIA, W' comprises a least one substituent, namely the moiety to the right of the W' group in Structure IIIA, which substituent is by definition activating, comprising either X or D);

W is an activating group when W has structure IIIA or when W' is an alkyl or cycloalkyl group substituted with one or more electron withdrawing groups; an aryl group substituted with one to seven electron withdrawing groups, a substituted or unsubstituted heteroaromatic group; or a non-aromatic heterocyclic when substituted with one or more electron withdrawing groups. More preferably, when W is substituted with an electron withdrawing group, the substituent is an inorganic group such as halogen, —$NO_2$, or —CN; or a halogenated alkyl group, e.g., —$CF_3$, or an inorganic group capped by $R_{13}$ (or by $R_{13}$ and $R_{14}$), for example —$SO_2R_{13}$, —$OSO_2R_{13}$, —$NR_{13}(SO_2R_{14})$, —$CO_2R_{13}$, —$COR_{13}$, —$NR_{13}(COR_{14})$, etc.

$R_{13}$, $R_{14}$, $R_{15}$, and $R_{16}$ can independently be selected from substituted or unsubstituted alkyl, aryl, or heterocyclic group, preferably having 1 to 6 carbon atoms, more preferably a phenyl or C1 to C6 alkyl group.

Any two members (which are not directly linked) of the following set: $R_{12}$, T, and either D or W, may be joined to form a ring, provided that creation of the ring will not interfere with the functioning of the blocking group.

In one embodiment of the invention, the blocked developer is selected from Structure III with the proviso that when t is 0, then D is not —CN or substituted or unsubstituted aryl and X is not —$SO_2$— when W is substituted or unsubstituted aryl or alkyl; and when t is not an activating group, then X is not —$SO_2$— when W is a substituted or unsubstituted aryl.

As indicated above, the specified half-life can be obtained by the use of activating groups in certain positions in the blocking moiety of the blocked developer of Structure III. More specifically, it has been found that the specified half-life can be obtained by the use of activating groups in the D or X position. Further activation to achieve the specified half-life may be obtained by the use of activating groups in one or more of the T and/or W positions in Structure III. As indicated above, the activating groups is herein meant electron withdrawing groups, heteroaromatic groups, or aryl groups substituted with one or more electron withdrawing groups. In one embodiment of the invention, the specified half life is obtained by the presence of activating groups, in addition to D or X, in at least one of the T or W groups.

By the term inorganic is herein meant a group not containing carbon excepting carbonates, cyanides, and cyanates. The term heterocyclic herein includes aromatic and non-aromatic rings containing at least one (preferably 1 to 3) heteroatoms in the ring. If the named groups for a symbol such as T in Structure III apparently overlap, the narrower named group is excluded from the broader named group solely to avoid any such apparent overlap. Thus, for example, heteroaromatic groups in the definition of T may be electron withdrawing in nature, but are not included under monovalent or divalent electron withdrawing groups as they are defined herein.

In has further been found that the necessary half-life can be obtained by the use of activating groups in the D or X position, with further activation as necessary to achieve the necessary half-life by the use of electron withdrawing or heteroaromatic groups in the T and/or W positions in Structure III. By the term activating groups is meant electron withdrawing groups, heteroaromatic groups, or aryl groups substituted with one or more electron withdrawing groups. Preferably, in addition to D or X, at least one of T or W is an activating group.

When referring to electron withdrawing groups, this can be indicated or estimated by the Hammett substituent constants ($\delta_p$, $\delta_m$) as described by L. P. Hammett in Physical Organic Chemistry (McGraw-Hill Book Co., N.Y., 1940), or by the Taft polar substituent constants ($\delta_I$) as defined by R. W. Taft in Steric Effects in Organic Chemistry (Wiley and Sons, N.Y., 1956), and in other standard organic textbooks. The $\delta_p$ and $\delta_m$ parameters, which were used first to characterize the ability of benzene ring-substituents (in the para or meta position) to affect the electronic nature of a reaction site, were originally quantified by their effect on the pKa of benzoic acid. Subsequent work has extended and refined the original concept and data, and for the purposes of prediction and correlation, standard sets of $\delta_p$ and $\delta_m$ are widely available in the chemical literature, as for example in C. Hansch et al., J. Med. Chem., 17, 1207 (1973). For substituents attached to a tetrahedral carbon instead of aryl groups, the inductive substituent constant $\delta_I$ is herein used to characterize the electronic property. Preferably, an electron withdrawing group on an aryl ring has a $\delta_p$ or $\delta_m$ of greater than zero, more preferably greater than 0.05, most preferably greater than 0.1. The $\delta_p$ is used to define electron withdrawing groups on aryl groups when the substituent is neither para nor meta. Similarly, an electron withdrawing group on a tetrahedral carbon preferably has $\delta_I$ of greater than zero, more preferably greater than 0.05, and most preferably greater than 0.1. In the event of a divalent group such as —$SO_2$—, the $\delta_I$ used is for the methyl substituted analogue such as —$SO_2CH_3$ ($\delta_I$=0.59). When more than one electron withdrawing group is present, then the summation of the substituent constants is used to estimate or characterize the total effect of the substituents.

Illustrative developing agents that are useful as developers are:

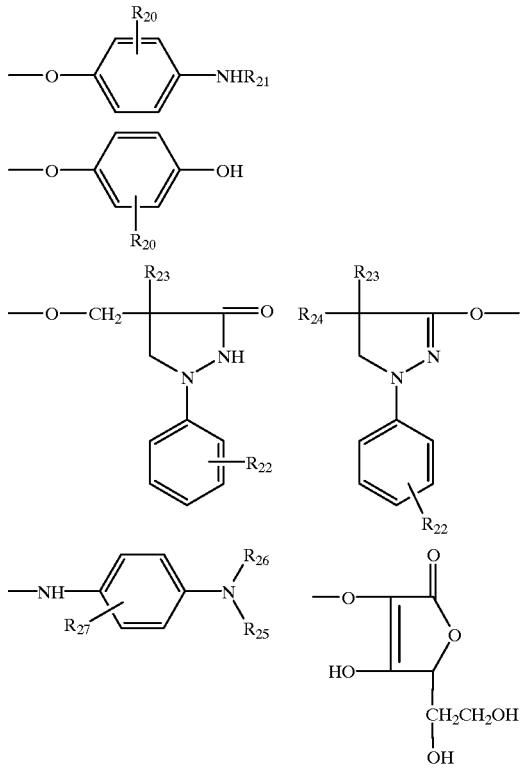

wherein $R_{20}$ is hydrogen, halogen, alkyl or alkoxy;

$R_{21}$ is a hydrogen or alkyl;

$R_{22}$ is hydrogen, alkyl, alkoxy or alkenedioxy; and $R_{23}$, $R_{24}$, $R_{25}$ $R_{26}$ and $R_{27}$ are hydrogen alkyl, hydroxyalkyl or sulfoalkyl.

More preferably, the blocked developers used in the present invention is within Structure I above, but represented by the following narrower Structure IIIB:

Structure IIIB

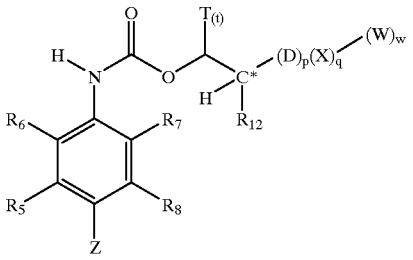

wherein:

Z is OH or $NR_2R_3$, where $R_2$ and $R_3$ are independently hydrogen or a substituted or unsubstituted alkyl group or $R_2$ and $R_3$ are connected to form a ring;

$R_5$, $R_6$, $R_7$, and $R_8$ are independently hydrogen, halogen, hydroxy, amino, alkoxy, carbonamido, sulfonamido, alkylsulfonamido or alkyl, or $R_5$ can connect with $R_3$ or $R_6$ and/or $R_8$ can connect to $R_2$ or $R_7$ to form a ring;

W is either W' or a group represented by the following Structure IIIC:

Structure IIIC

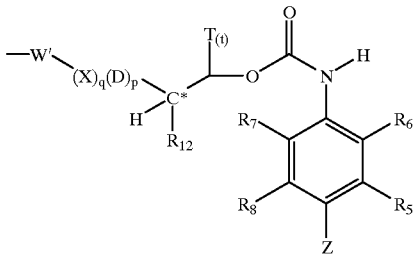

wherein T, t, C*, $R_{12}$, D, p, X, q, W' and w are as defined above, including, but not limited to, the preferred groups.

Again, the present invention includes photothermographic elements comprising blocked developers according to Structure III or IIIC which blocked developers have a half-life ($t_{1/2}$)≦20 min (as determined below).

When referring to heteroaromatic groups or substituents, the heteroaromatic group is preferably a 5- or 6-membered ring containing one or more hetero atoms, such as N, O, S or Se. Preferably, the heteroaromatic group comprises a substituted or unsubstituted benzimidazolyl, benzothiazolyl, benzoxazolyl, benzothienyl, benzofuryl, furyl, imidazolyl, indazolyl, indolyl, isoquinolyl, isothiazolyl, isoxazolyl, oxazolyl, picolinyl, purinyl, pyranyl, pyrazinyl, pyrazolyl, pyridyl, pyrimidinyl, pyrrolyl, quinaldinyl, quinazolinyl, quinolyl, quinoxalinyl, tetrazolyl, thiadiazolyl, thiatriazolyl, thiazolyl, thienyl, and triazolyl group. Particularly preferred are: 2-imidazolyl, 2-benzimidazolyl, 2-thiazolyl, 2-benzothiazolyl, 2-oxazolyl, 2-benzoxazolyl, 2-pyridyl, 2-quinolinyl, 1-isoquinolinyl, 2-pyrrolyl, 2-indolyl, 2-thiophenyl, 2-benzothiophenyl, 2-furyl, 2-benzofuryl, 2-,4-, or 5-pyrimidinyl, 2-pyrazinyl, 3-,4-, or 5-pyrazolyl, 3-indazolyl, 2- and 3-thienyl, 2-(1,3,4-triazolyl), 4-or 5-(1,2,3-triazolyl), 5-(1,2,3,4-tetrazolyl). The heterocyclic group may be further substituted. Preferred substituents are alkyl and alkoxy groups containing 1 to 6 carbon atoms.

When reference in this application is made to a particular moiety or group, "substituted or unsubstituted" means that the moiety may be unsubstituted or substituted with one or more substituents (up to the maximum possible number), for example, substituted or unsubstituted alkyl, substituted or unsubstituted benzene (with up to five substituents), substituted or unsubstituted heteroaromatic (with up to five substituents), and substituted or unsubstituted heterocyclic (with up to five substituents). Generally, unless otherwise specifically stated, substituent groups usable on molecules herein include any groups, whether substituted or unsubstituted, which do not destroy properties necessary for the photographic utility. Examples of substituents on any of the mentioned groups can include known substituents, such as: halogen, for example, chloro, fluoro, bromo, iodo; alkoxy, particularly those "lower alkyl" (that is, with 1 to 6 carbon atoms), for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as any of those described below; and others known in the art. Alkyl substituents may specifically include "lower alkyl" (that is, having 1–6 carbon atoms), for example, methyl, ethyl, and the like. Cycloalkyl when appropriate includes bicycloalkyl. Further, with regard to any alkyl group or alkylene group, it will be understood that these can be branched, unbranched, or cyclic.

The following are representative examples of photographically useful blocked developers for use in the invention:

D-1

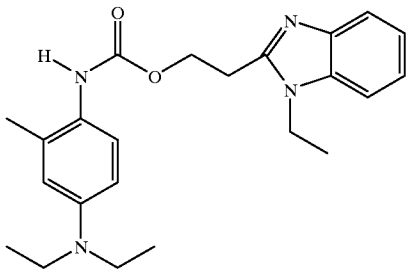

D-2

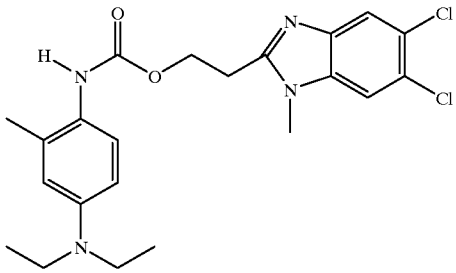

D-3

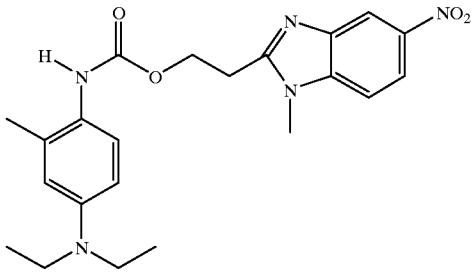

D-4

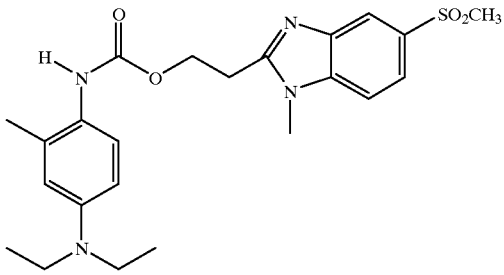

-continued

D-5

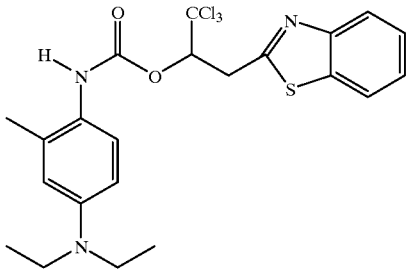

D-6

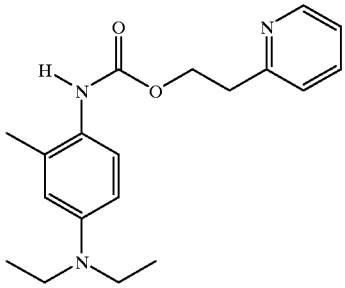

D-7

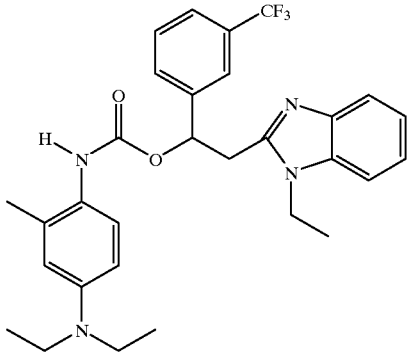

D-8

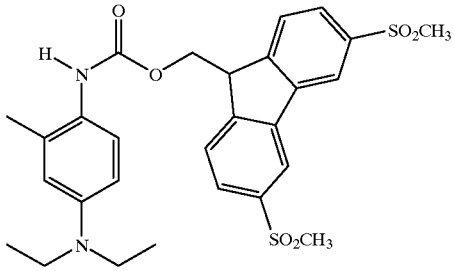

D-9

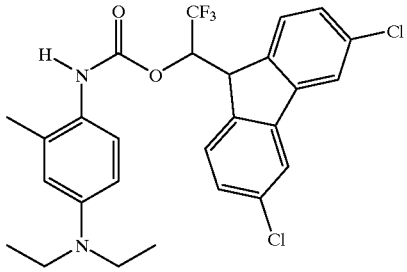

-continued
D-10
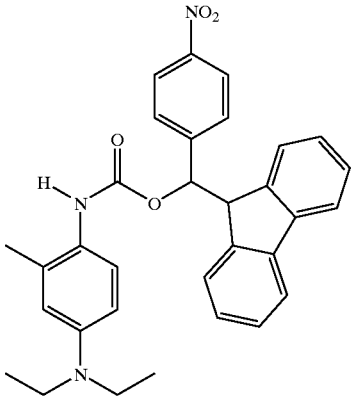
D-11
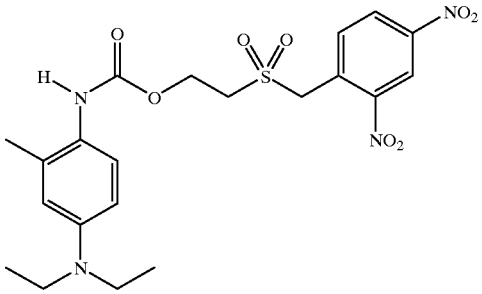
D-12
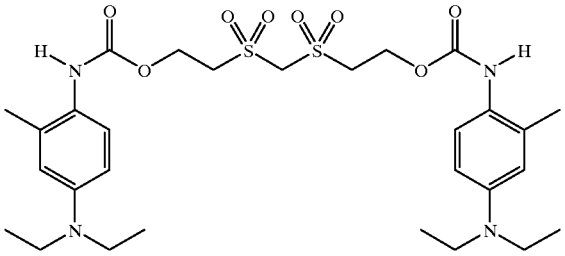
D-13
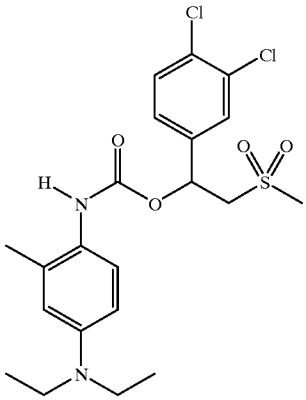
-continued
D-14
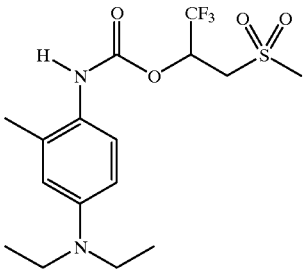
D-15
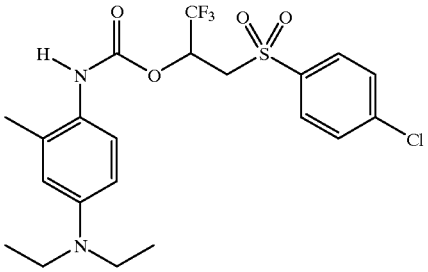
D-16
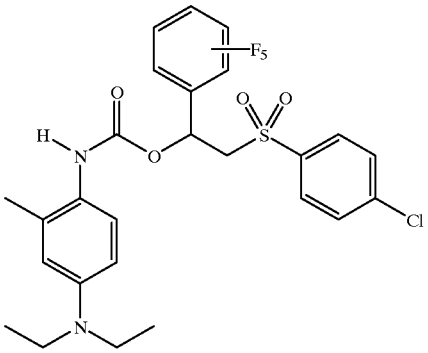
D-17
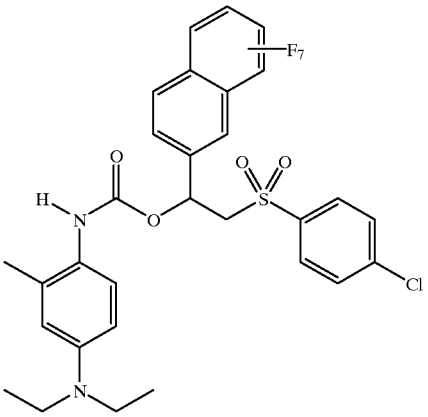

D-18
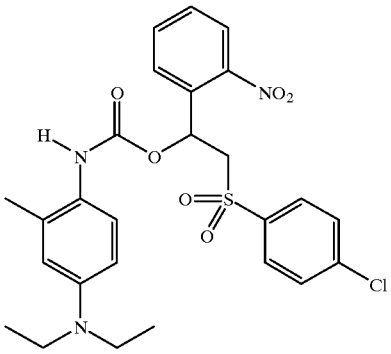
D-19
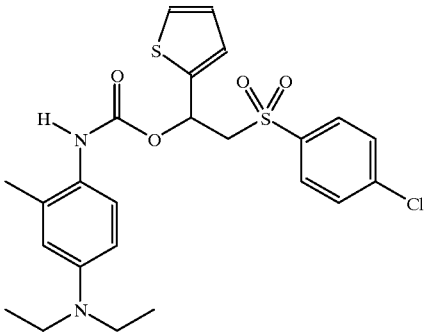
D-20
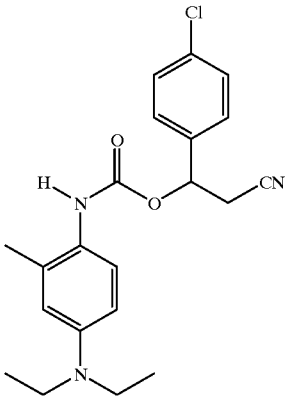
D-21
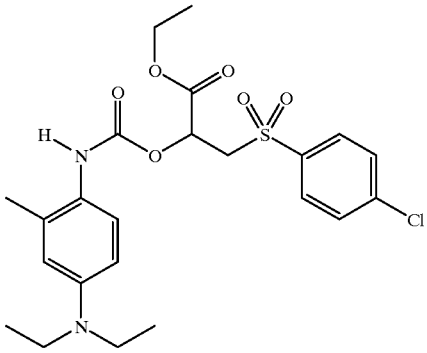
D-22
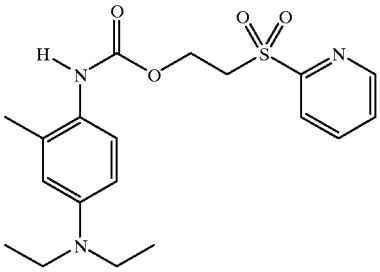
D-23
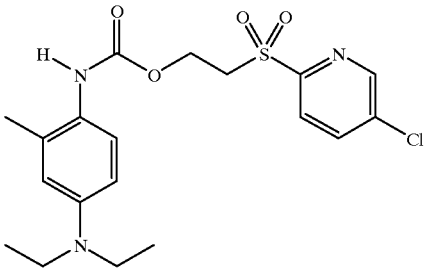
D-24
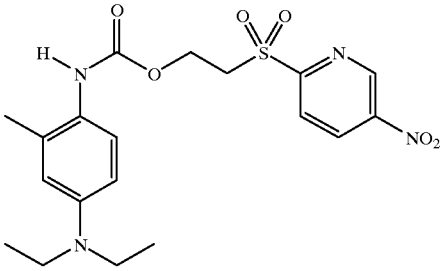
D-25
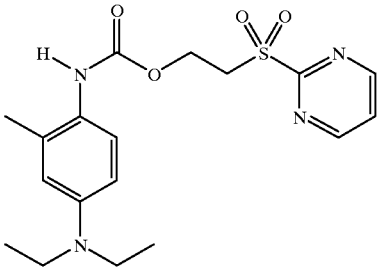
D-26
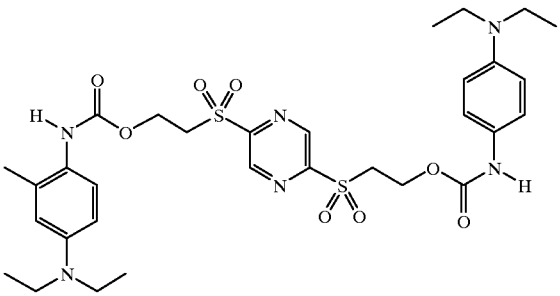

-continued
D-27
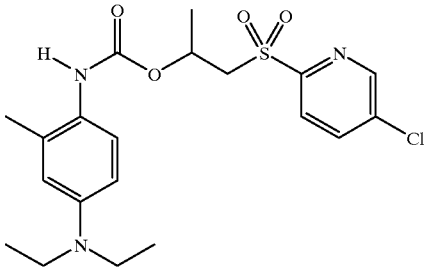
D-28
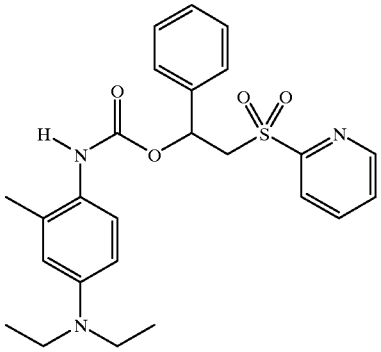
D-29
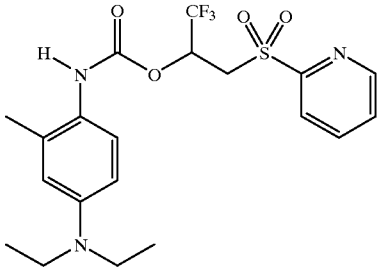
D-30
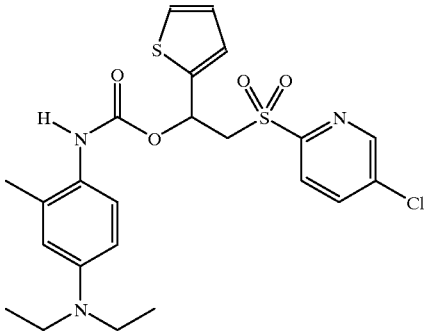
D-31
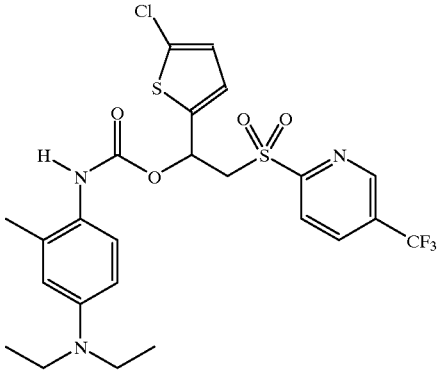
-continued
D-32
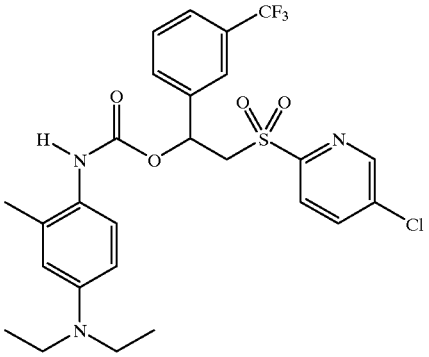
D-33
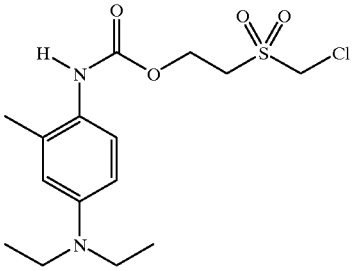
D-34
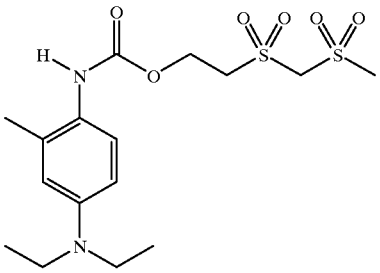
D-35
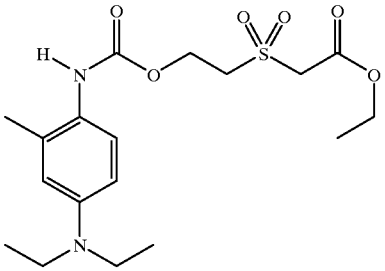
D-36
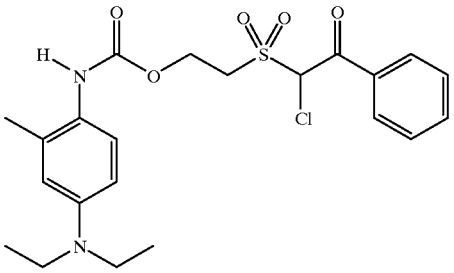

-continued
D-37
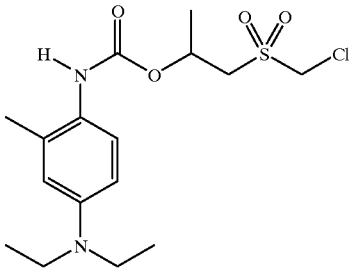
D-38
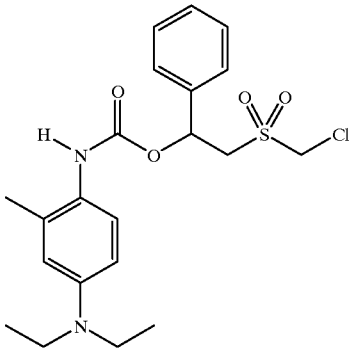
D-39
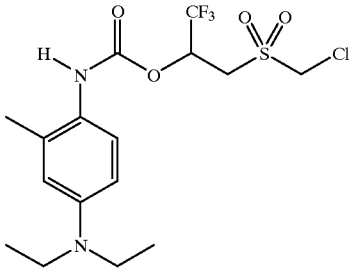
D-40
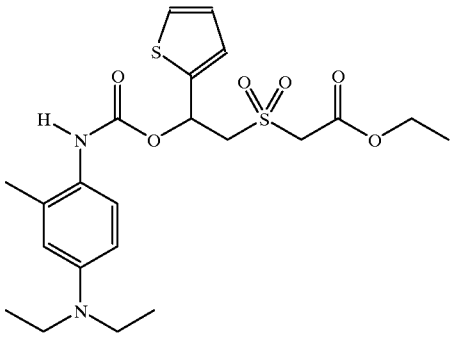
D-41
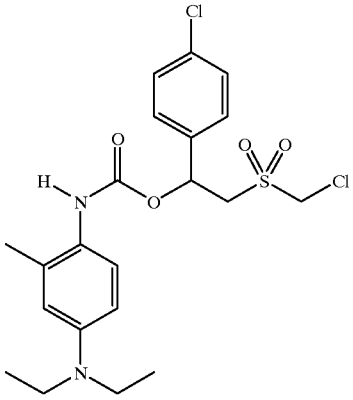
-continued
D-42
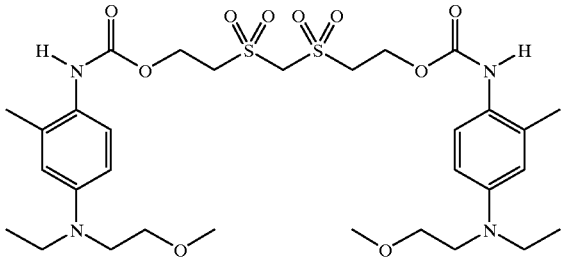
D-43
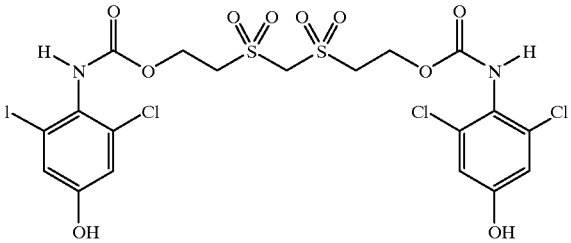
D-44
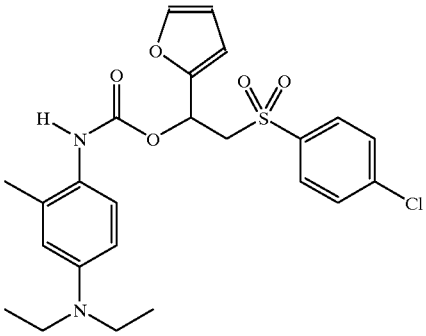
D-45
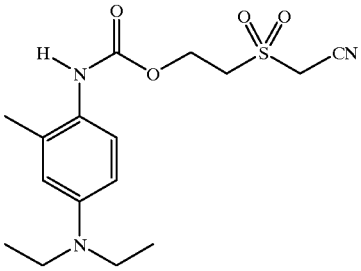
D-46
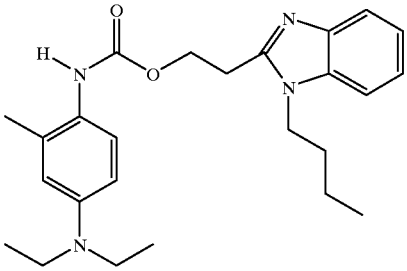
The blocked developing agent is preferably incorporated in one or more of the imaging layers of the imaging element. The amount of blocked developing agent used is preferably 0.01 to 5 g/m$^2$, more preferably 0.1 to 2 g/m$^2$ and most preferably 0.3 to 2 g/m$^2$ in each layer to which it is added.

These may be color forming or non-color forming layers of the element. After image-wise exposure of the imaging element, the blocked developing agent can be activated during processing of the imaging element by heating the imaging element during processing of the imaging element as explained above.

Optionally further processing of the film can be accomplished by placing the imaged film in contact with a separate element, such as a laminate sheet, during processing. The laminate sheet optionally contains additional processing chemicals such as those disclosed in *Research Disclosure* I, Sections XIX and XX. Such chemicals include, for example, fixing agents, bleaching agents, sequestering agents such as an organic acids, and other additives such as buffering agents, sulfonated polystyrene, stain reducing agents, biocides, desilvering agents, stabilizers and the like.

In the photographic element of the present invention, the blocked developing agent is incorporated in a photothermographic element which can be one of various types. In reference to Research Disclosure 17029 (Research Disclosure I), the photothermographic element may be of Type B, which disclosure is incorporated by reference in its entirety.

The photographic element can comprise one or more light sensitive (photographic) layers and one or more non-photographic layers. Multicolor elements typically contain dye image-forming units sensitive to various regions of the electromagnetic spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to various regions of the electromagnetic spectrum can be disposed as a single segmented layer.

A typical multicolor photographic element comprises a support bearing a dye image-forming unit comprised of at least one red-sensitive silver halide emulsion layer having associated therewith at least one dye-forming coupler, a dye image-forming unit comprising at least one green-sensitive silver halide emulsion layer having associated therewith at least one dye-forming coupler, and a dye image-forming unit comprising at least one blue-sensitive silver halide emulsion layer having associated therewith at least one dye-forming coupler. The element can contain additional layers, such as filter layers, inter-layers, overcoat layers, subbing layers, and the like. All of these can be coated on a support which can be transparent or reflective (for example, a paper support).

Photographic elements of the present invention may also usefully include a magnetic recording material as described in Research Disclosure, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

It is also contemplated that, in alternative embodiments, the photographic element of this invention may be used with non-conventional sensitization schemes. For example, instead of using imaging layers sensitized to the red, green, and blue regions of the spectrum, the light-sensitive material may have one white-sensitive layer to record scene luminance, and two color-sensitive layers to record scene chrominance. Following development, the resulting image can be scanned and digitally reprocessed to reconstruct the full colors of the original scene as described in U.S. Pat. No. 5,962,205. The imaging element may also comprise a pan-sensitized emulsion with accompanying color-separation exposure. In this embodiment, the developers of the invention would give rise to a colored or neutral image which, in conjunction with the separation exposure, would enable full recovery of the original scene color values. In such an element, the image may be formed by either developed silver density, a combination of one or more conventional couplers, or "black" couplers such as resorcinol couplers. The separation exposure may be made either sequentially through appropriate filters, or simultaneously through a system of spatially discreet filter elements (commonly called a "color filter array").

When conventional yellow, magenta, and cyan image dyes are formed to read out the recorded scene exposures following chemical development of conventional exposed color photographic materials, the response of the red, green, and blue color recording units of the element can be accurately discerned by examining their densities. Densitometry is the measurement of transmitted light by a sample using selected colored filters to separate the imagewise response of the RGB image dye forming units into relatively independent channels. It is common to use Status M filters to gauge the response of color negative film elements intended for optical printing, and Status A filters for color reversal films intended for direct transmission viewing. In integral densitometry, the unwanted side and tail absorptions of the imperfect image dyes leads to a small amount of channel mixing, where part of the total response of, for example, a magenta channel may come from off-peak absorptions of either the yellow or cyan image dyes records, or both, in neutral characteristic curves. Such artifacts may be negligible in the measurement of a film's spectral sensitivity. By appropriate mathematical treatment of the integral density response, these unwanted off-peak density contributions can be completely corrected providing analytical densities, where the response of a given color record is independent of the spectral contributions of the other image dyes. Analytical density determination has been summarized in the *SPSE Handbook of Photographic Science and Engineering*, W. Thomas, editor, John Wiley and Sons, New York, 1973, Section 15.3, Color Densitometry, pp. 840–848.

Image noise can be reduced, where the images are obtained by scanning exposed and processed color negative film elements to obtain a manipulatable electronic record of the image pattern, followed by reconversion of the adjusted electronic record to a viewable form. Image sharpness and colorfulness can be increased by designing layer gamma ratios to be within a narrow range while avoiding or minimizing other performance deficiencies, where the color record is placed in an electronic form prior to recreating a color image to be viewed. Whereas it is impossible to separate image noise from the remainder of the image information, either in printing or by manipulating an electronic image record, it is possible by adjusting an electronic image record that exhibits low noise, as is provided by color negative film elements with low gamma ratios, to improve overall curve shape and sharpness characteristics in a manner that is impossible to achieve by known printing techniques. Thus, images can be recreated from electronic image records derived from such color negative elements that are superior to those similarly derived from conventional color negative elements constructed to serve optical printing applications. The excellent imaging characteristics of the described element are obtained when the gamma ratio for each of the red, green and blue color recording units is less than 1.2. In a more preferred embodiment, the red, green, and blue light sensitive color forming units each exhibit gamma ratios of less than 1.15. In an even more preferred embodiment, the red and blue light sensitive color forming units each exhibit gamma ratios of less than 1.10. In a most preferred embodiment, the red, green, and blue light sensitive color forming units each exhibit gamma ratios of less than 1.10. In all cases, it is preferred that the individual color unit(s) exhibit gamma ratios of less than 1.15, more preferred that they exhibit gamma ratios of less than 1.10 and even more preferred that they exhibit gamma ratios of less than 1.05. The gamma ratios of the layer units need not be equal. These low values of the gamma ratio are indicative of low levels of interlayer interaction, also known as interlayer interimage effects, between the layer units and are believed to account for the improved quality of the images after scanning and electronic manipulation. The apparently deleterious image characteristics that result from chemical interactions between the layer units need not be electronically suppressed during the image manipulation activity. The interactions are often difficult if not impossible to suppress properly using known electronic image manipulation schemes.

Elements having excellent light sensitivity are best employed in the practice of this invention. The elements should have a sensitivity of at least about ISO 50, preferably have a sensitivity of at least about ISO 100, and more preferably have a sensitivity of at least about ISO 200. Elements having a sensitivity of up to ISO 3200 or even higher are specifically contemplated. The speed, or sensitivity, of a color negative photographic element is inversely related to the exposure required to enable the attainment of a specified density above fog after processing. Photographic speed for a color negative element with a gamma of about 0.65 in each color record has been specifically defined by the American National Standards Institute (ANSI) as ANSI Standard Number PH 2.27–1981 (ISO (ASA Speed)) and relates specifically the average of exposure levels required to produce a density of 0.15 above the minimum density in each of the green light sensitive and least sensitive color recording unit of a color film. This definition conforms to the International Standards Organization (ISO) film speed rating. For the purposes of this application, if the color unit gammas differ from 0.65, the ASA or ISO speed is to be calculated by linearly amplifying or deamplifying the gamma vs. log E (exposure) curve to a value of 0.65 before determining the speed in the otherwise defined manner.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed. Cameras may contain a built-in processing capability, for example a heating element.

In the following discussion of suitable materials for use in elements of this invention, reference will be made to Research Disclosure, September 1996, Number 389, Item 38957, which will be identified hereafter by the term "Research Disclosure II." The Sections hereafter referred to, in the following description, are Sections of the Research Disclosure II unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference. Elements suitable for use in the proposed system are also found in Research Disclosure I and Research Disclosure, June 1978, Item No. 17643. These references are also incorporated herein by reference.

The silver halide emulsions employed in the photographic elements of the present invention may be negative-working, such as surface-sensitive emulsions or unfogged internal latent image forming emulsions, or positive working emulsions of the internal latent image forming type (that are fogged during processing) Suitable emulsions and their preparation as well as methods of chemical and spectral sensitization are described in Research Disclosure II, Sections I through V. Color materials and development modifiers are described in Research disclosure II, Sections V through XX. Vehicles which can be used in the photographic elements are described in Research disclosure II, Section II, and various additives such as brighteners, antifoggants, stabilizers, light absorbing and scattering materials, hardeners, coating aids, plasticizers, lubricants and matting agents are described, for example, in Research disclosure II, Sections VI through XIII. Manufacturing methods are described in all of the sections, layer arrangements particularly in Research disclosure II, Section XI, exposure alternatives in Research disclosure II, Section XVI, and processing methods and agents in Research disclosure II, Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-1 13935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); development inhibitors and their precursors (U.S. Pat. No. 5,460,932; U.S. Pat. No. 5,478,711); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or anti-halation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

The silver halide used in the photographic elements may be silver iodobromide, silver bromide, silver chloride, silver chlorobromide, silver chloroiodobromide, and the like.

The type of silver halide grains preferably include polymorphic, cubic, and octahedral. The grain size of the silver halide may have any distribution known to be useful in photographic compositions, and may be either polydipersed or monodispersed.

Tabular grain silver halide emulsions may also be used. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$) >25 and ECD and t are both measured in micrometers ($\mu$m). The tabular grains can be of any thickness compatible with achieving an aim average aspect ratio and/or average tabularity of the tabular grain emulsion. Preferably the tabular grains satisfying projected area requirements are those having thicknesses of <0.3 $\mu$m, thin (<0.2 $\mu$m) tabular grains being specifically preferred and ultrathin (<0.07 $\mu$m) tabular grains being contemplated for maximum tabular grain performance enhancements. When the native blue absorption of iodohalide tabular grains is relied upon for blue speed, thicker tabular grains, typically up to 0.5 $\mu$m in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in Research Disclosure II, Section I.B.(3) (page 503).

The silver halide grains to be used in the invention may be prepared according to methods known in the art, such as those described in Research Disclosure II and James, The Theory of the Photographic Process. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in Research Disclosure, Item 38957, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing photographic speed by forming a shallow electron trap (hereinafter also referred to as a SET) as discussed in Research Disclosure Item 36736 published November 1994, here incorporated by reference.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in Research Disclosure II. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in Research Disclosure II. The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in Research Disclosure II and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as described in Research Disclosure II, Section IV (pages 510–511) and the references cited therein.

The silver halide may be sensitized by sensitizing dyes by any method known in the art, such as described in Research Disclosure II. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

The photothermographic element can comprise a toning agent, also known as an activator-toner or toner-accelerator. Combinations of toning agents are also useful in the photothermographic element. Examples of useful toning agents and toning agent combinations are described in, for example, Research Disclosure, June 1978, Item No. 17029 and U.S. Pat. No. 4,123,282. Examples of useful toning agents include, for example, phthalimide, N-hydroxyphthalimide, N-potassium-phthalimide, succinimide, N-hydroxy-1,8-naphthalimide, phthalazine, 1-(2H)-phthalazinone, 2-acetylphthalazinone.

The present invention utilizes a thermal solvent to enhance the formation of the dye image, for example by serving as a solvent for the incorporated blocked developer, agents, or otherwise facilitate the resulting development or silver diffusion processes without itself chemically reacting. Thermal solvents for use in dry photothermographic or thermographic systems are generally known, for example, as described in U.S. Pat. Nos. 3,429,706 (Shepard et al.) and 3,442,682 (Fukawa et al.). Other dry processing thermographic systems are described in U.S. Pat. Nos. 3,152,904 (Sorenson et al.) and 3,457,075 (Morgan and Shely). Acid amides and carbamates are known as such thermal solvents as disclosed by Henn and Miller (U.S. Pat. No. 3,347,675) and by Yudelson (U.S. Pat. No. 3,438,776). Bojara and de Mauriac (U.S. Pat. No. 3,667,959) disclose the use of nonaqueous polar solvents containing thione, —$SO_2$- and—CO-groups as thermal solvents and carriers in such photographic elements. Similarly, La Rossa (U.S. Pat. No. 4,168,980) discloses the use of imidazoline-2-thiones as processing addenda in heat developable photographic materials. Takahashi (U.S. Pat. No. 5,107,454) discloses a microencapsulated base activated heat developable photographic polymerization element containing silver halide, a reducing agent, a polymerizable compound, contained in a microcapsule and separate from a base or base precursor. In addition the element contains a sulfonamide compound as a development accelerator. Thermal solvents for use in substantially dry color photothermographic systems have been disclosed by Komamura et al. (U.S. Pat. No. 4,770,981), Komamura (U.S. Pat. No. 4,948,698), Aomo and Nakamaura (U.S. Pat. No. 4,952,479), and Ohbayashi et al. (U.S. Pat. No. 4,983,502). The terms "heat solvent" and "thermal solvent" in these disclosures refer to a non-hydrolyzable organic material which is a liquid at ambient temperature or a solid at an ambient temperature but melts together with other components at a temperature of heat treatment or below but higher than 40° C. Such solvents may also be solids at temperatures above the thermal processing temperature. Their preferred examples include compounds which can act as a solvent for the developing agent and compounds having a high dielectric constant which accelerate physical development of silver salts. Alkyl and aryl amides are disclosed as "heat solvents" by Komamura et al. (U.S. Pat. No. 4,770,981), and a variety of benzamides have been disclosed as "heat solvents" by Ohbayashi et al. (U.S. Pat. No. 4,983,502). Polyglycols, derivatives of polyethylene oxides, beeswax, monostearin, high dielectric constant compounds having an —$SO_2$ -or—CO-group such as acetamide, ethylcarbamate, urea, methylsulfonamide, polar substances described in U.S. Pat. No. 3,667,959, lactone of 4-hydroxybutanoic acid, methyl anisate, and related compounds are disclosed as thermal solvents in such systems. The role of thermal solvents in these systems is not clear, but it is believed that such thermal solvents promote the diffusion of reactants at the time of thermal development. Masukawa and Koshizuka disclose (U.S. Pat. No. 4,584,267) the use of similar components (such as methyl anisate) as "heat fusers" in thermally developable light-sensitive materials. Baxendale and Wood in the Defensive Publication corresponding to U.S. application Ser. No. 825,478 filed Mar. 17, 1969 disclose water soluble lower-alkyl hydroxybenzoates as preprocessing stabilizers in silver salt heat-developable photographic elements. Preferred thermal solvents in the present invention include salicylanilide and other phenolic compounds or derivatives.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The photothermographic elements preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly(vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly (methylmethacrylate), poly(vinylpyrrolidone), ethyl cellulose, polystyrene, poly(vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates.

Phototbermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure,* December 1978, Item No. 17643 and *Research Disclosure,* June 1978, Item No. 17029.

The photothermographic element can comprise a variety of supports. Examples of useful supports are poly (vinylacetal) film, polystyrene film, poly (ethyleneterephthalate) film, poly(ethylene naphthalate) film, polycarbonate film, and related films and resinous materials, as well as paper, cloth, glass, metal, and other supports that withstand the thermal processing temperatures.

The layers of the photothermographic element are coated on a support by coating procedures known in the photographic art, including dip coating, air knife coating, curtain coating or extrusion coating using hoppers. If desired, two or more layers are coated simultaneously.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethyl sulfonyl)benzothiazole; and 6-substituted-2,4-bis (tribromomethyl)-s-triazines, such as 6-methyl or 6-phenyl-2,4-bis(tribromomethyl)-s-triazine.

Photographic elements of the present invention are preferably imagewise exposed using any of the known techniques, including those described in *Research Disclosure II,* section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like). The photothermographic elements are also exposed by means of various forms of energy, including ultraviolet and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide. Imagewise exposure is preferably for a time and intensity sufficient to produce a developable latent image in the photothermographic element.

The present invention will be better understood with reference to the following examples, which are for illustrative purposes only, not to be construed to limit the claims.

EXAMPLE 1

This Example illustrates the preparation of compound D-1, useful as a blocked developer in the present invention which is prepared according to the following reaction scheme:

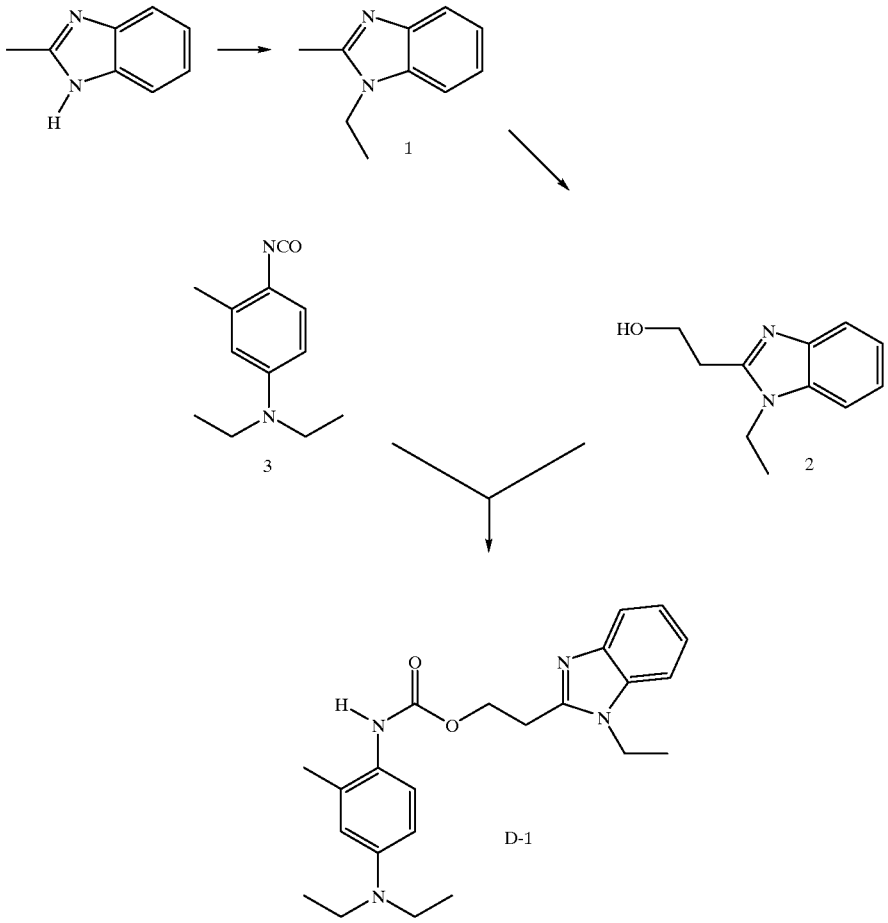

Preparation of Intermediate 1

To a mixture of KOH (85%) (7.3 g, 110 mmol), $K_2CO_3$ (6.8 g, 50 mmol), 2-methylbenzimidazole (Aldrich, 13.2 g, 100 mmol) and THF (70 mL) was added at ca. 15° C. diethyl sulfate (11.3 mL, 102 mmol) in 10 mL of THF. After stirring for four hours, 50 mL of ethyl acetate was added, and then the reaction mixture was filtered to remove solid materials. The filtrate was concentrated under reduced pressure to yield 15.5 g (97%) of 1 as a yellow oil.

Preparation of Intermediate 2

A pressure bottle was charged with compound 1 (8.0 g, 50 mmol), a 38% solution of formaldehyde (12 mL), pyridine (6 mL) and propanol (20 mL) and the reaction mixture was heated at 130° C. for 9 hours. The excess solvent was removed under reduced pressure and the residue recrystallized from ethyl acetate to yield compound 2 (14.5 g, 73%) as a solid; $^1$H NMR (300 MHz, $CDCl_3$): 1.40 (t, 3H, J=7.3 Hz), 3.04 (t, 2H, J=5.3 Hz), 4.10–4.20 (m, 5H), 7.18–7.34 (m, 3H), 7.65–7.72(m, 1H).

Preparation of D-1

To a mixture of 2 (5.7 g, 30 mmol), dichloromethane (30 mL) and two drops of dibutyltin diacetate was added compound 3, namely 4-(N,N-diethylamino)-2-methylphenyl isocyanate, the latter prepared as described in Brit. Pat. 1,152,877, ( 6.1 g, 30 mmol). After being stirred at room temperature for 14 hours the reaction mixture was concentrated under reduced pressure and diluted with ligroin. The precipitated solid material was isolated by filtration to yield D-1 (9.6 g, 81%); $^1$H NMR (300 MHz, $CDCl_3$): 1.12 (t, 6H, J=7.3 Hz), 1.30–1.46 (m,3H), 2.18 (s, 3H), 3.20–3.35 (m, 6H), 4.10–4.35 (m, 3H), 4.60–4.68 (m,3H), 6.18 (bs, 1H), 6.40–6.55 (m, 2H), 7.20-7-44 (m, 4H), 7.69–7.75 (m, 1H).

EXAMPLE 2

This Example illustrates the preparation of compound D-12, useful as a blocked developer in the present invention, which is prepared according to the following reaction scheme:

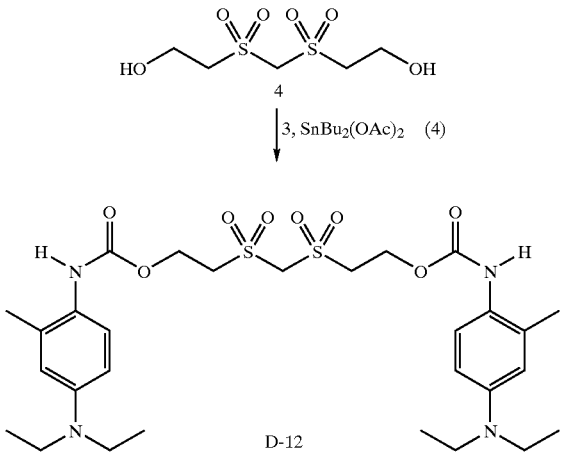

Preparation of D-12

A solution of the diol 4 (15.0 g, 64 mmol), compound 3 (27.0 g, 130 mmol) and dibutyltin diacetate ( 0.05 mL) in 150 mL of tetrahydrofuran was stirred at room temperature for 18 h. The reaction mixture was then filtered through a pad of Celite and the filtrate concentrated in vacuo, giving a solid, which was recrystallized from methanol. The yield of D-12 was 25.0 g (40 mmol, 61%), m.p. 131° C.

EXAMPLE 3

This Example illustrates the preparation of compound D-15, useful as a blocked developer in the present invention, which is prepared according to the following reaction scheme:

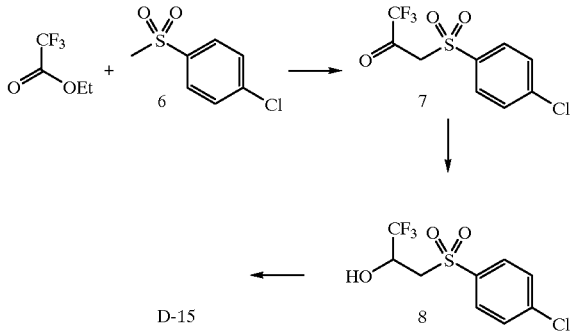

Preparation of Intermediate 7

A solution of sulfone 6 (19.07 g, 100 mmol) in 50 mL of N,N-dimethylformamide was added to a suspension of 60% sodium hydride (6.00 g, 150 mmol) in 100 mL of N,N-dimethylformamide, the mixture was stirred at 40° C. for 90 min and then cooled to 5° C. Neat ethyl trifluoroacetate (36 mL, 300 mmol) was added at 5° C. and then the reaction mixture stirred at room temperature for 30 min. The mixture was diluted with 1000 mL of brine and extracted with ether, giving an oil which was purified by column chromatography on silica gel. A solid was obtained which was further purified by crystallization from hexane-isopropyl ether. The yield of 7 was 18.47 g (64 mmol, 64%).

Preparation of Intermediate 8

Solid sodium borohydride (1.89 g, 50 mmol) was added in portions to a solution of 7 (14.33 g, 50 mmol) in 100 mL of methanol and the mixture stirred for 30 min. Water (200 mL) was then added and methanol distilled off. Extraction with ether and removal of the solvent gave 13.75 g (48 mmol, 95%) of 8.

Preparation of D-15

A solution of 7 (13.75 g, 48 mmol, 4-(N,N-diethylamino)-2-methylphenyl isocyanate (3,10.21 g, 50 mmol) and dibutyltin diacetate (0.01 mL) in 50 mL of dichloromethane was stirred at room temperature for 4 days. The solvent was distilled off and the crude product washed with hexane and dried. The yield of D-15 was 21.00 g (43 mmol, 85%), m.p. 140–143° C.

EXAMPLE 4

This Example illustrates the preparation of compound D-23, useful in the present invention, which is prepared according to the following reaction scheme:

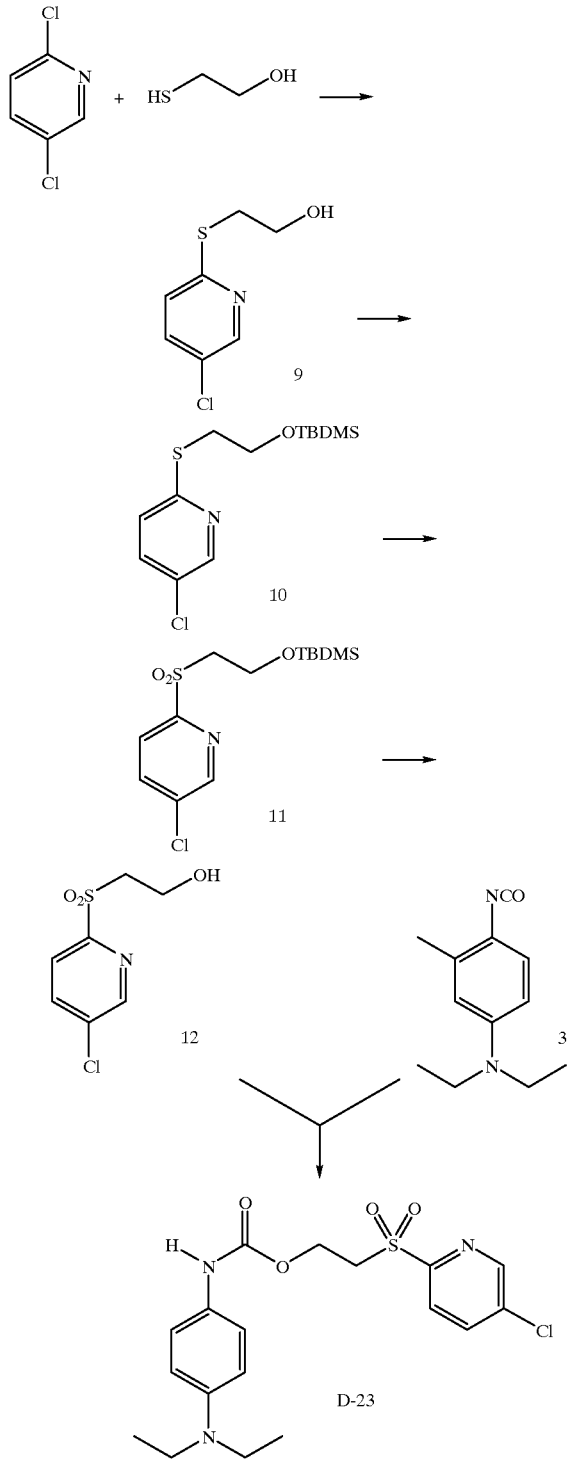

Preparation of Intermediate 9

A mixture consisting of 2,5-dichloropyridine (Aldrich, 14.80 g, 100 mmol), 2-mercaptoethanol (Fluka, 9.36 g, 120 mmol), potassium carbonate (19.34 g, 140 mmol), and acetone (200 mL) was refluxed for 36 h, cooled to room temperature and filtered. The filtrate was concentrated in vacuo, dissolved in ether (300 mL) and washed with brine 2×100 mL). The organic solution was concentrated and the crude product purified by column chromatography on silica gel with heptane/ethyl acetate. The yield of 9 was 12.05 g (64 mmol, 64%).

Preparation of Intermediate 10

Solid tert-butyldimethylsilyl chloride (Aldrich, TBDMSCI, 11.34 g, 75 mmol) was added in one portion to a solution of 9 (11.86 g, 62.5 mmol) and imidazole (5.97 g, 87.5 mmol) in tetrahydrofuran (160 mL), stirred at 5° C. Following the addition, the mixture was stirred at room temperature for 20 h and then worked up with saturated aqueous sodium bicarbonate and ether. The product was purified by column chromatography on silica gel with heptane/ethyl acetate. The yield of 10 was 17.69 g (58 mmol, 93%).

Preparation of Intermediate 11

A solution of meta-chloroperbenzoic acid (mCPBA, 77%, 27.01 g, 120 mmol) in dichloromethane (150 mL) was added in drops over a period of 30 min to a solution of 10 in dichloromethane (200 mL), stirred at 5° C. Following the addition the mixture was stirred at room temperature for 22 h and quenched with saturated aqueous sodium bicarbonate, followed by extraction with dichloromethane and column chromatography (silica, heptane/dichloromethane) which gave 11.67 g (35 mmol, 87%) of 11.

Preparation of Intermediate 12

A solution of 11 (10.08 g, 30 mmol) in tetrahydrofuran (90 mL)/water (90 mL) / acetic acid (270 mL) was kept at room temperature for 4 days. The solvents were distilled off and the residue crystallized from heptane/isopropyl ether. The yield of 12 was 6.41 g (29 mmol, 96%).

Preparation of D-23

A solution of 12 (4.43 g, 20 mmol) and compound 3, namely 4-(N,N-diethylamino)-2-methylphenyl isocyanate, the latter prepared as described in Brit. Pat. 1,152,877 (4.08 g, 20 mmol), and dibutyltin diacetate (0.01 mL) was stirred in 35 mL of tetrahydrofuran at room temperature for 24 hours. The solvent was distilled off and the crude oily product stirred with 50 mL of isopropyl ether, giving colorless crystals of D-23 (8.18 g, 19.2 mmol, 96%), m.p. 84–85° C.

EXAMPLE 5

This Example illustrates the preparation of compound D-33, useful in the present invention, which is prepared according to the following reaction scheme:

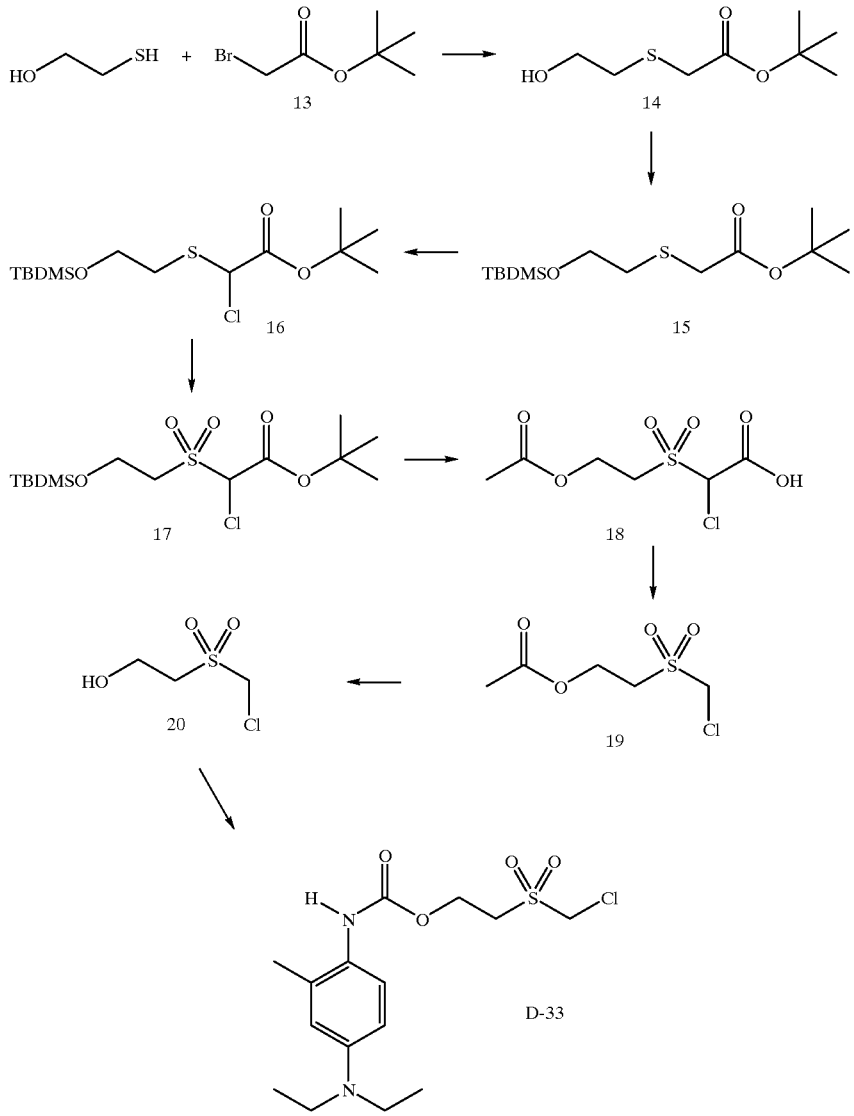

Preparation of Intermediate 14

A solution of t-butyl bromoacetate 13 (Aldrich, 19.51 g, 100 mmol) in 100 mL of acetonitrile was added in drops over a period of 30 min to a cooled (5° C.) solution of 2-mercaptoethanol (8.19 g, 105 mmol) in 100 mL of acetonitrile, containing potassium carbonate (15.20 g, 110 mmol). Following the addition the mixture was stirred at room temperature for 3 h and filtered. The filtrate was diluted with 200 mL of ether and washed with brine (50 mL). The ethereal solution was dried over sodium sulfate and concentrated in vacuo to give 19.24 g of 14 (100 mmol, 100%).

Preparation of Intermediate 15

Solid tert-butyldimethylsilyl chloride (TBDMSCI, 18.09 g, 120 mmol) was added in one portion to a solution of 14 (19.24 g, 100 mmol) and imidazole (9.55 g, 140 mmol) in 250 mL of tetrahydrofuran, stirred under nitrogen. After 2 h at room temperature the mixture was quenched with 200 mL of saturated aqueous sodium bicarbonate and extracted with ether. The crude product was filtered through silica gel (ether/heptane) giving 29.21 g (95 mmol, 95%) of 15.

Preparation of Intermediate 16

Solid N-chlorosuccinimide (6.68 g, 50 mmol) was added in portions over a period of 30 min to a solution of 15 (15.33 g, 50 mmol) in 100 mL of carbon tetrachloride that was stirred at 5° C. The reaction was run for 2 h and filtered. Removal of the solvent left 17.44 g of 16 as an oil (50 mmol, 100%).

Preparation of Intermediate 17

A solution of m-chloroperbenzoic acid (mCPBA, 77%, 24.75 g, 110 mmol) in 200 mL of dichloromethane was added in drops over a period of 30 min to a solution of 16 (17.44 g, 50 mmol) in 100 mL of dichloromethane, stirred at 5° C. Following the addition, the mixture was stirred at 5° C. for 2 h and then at room temperature for 1 h. The reaction was quenched with saturated aqueous sodium bicarbonate (250 mL) and the organic layer was dried and concentrated giving 18.66 g of 17 as an oil (50 mmol, 100%).

Preparation of Intermediate 18

A solution of 17 (11.26 g, 30.2 mmol), acetic anhydride (5 mL) and p-toluenesulfonic acid monohydrate (100 mg) in acetic acid (150 mL) was refluxed for 1 h. The solution was cooled to room temperature, diluted with 100 mL of water and stirred for 2 h. A solid was filtered off and the filtrate was concentrated in vacuo to produce 18 as a colorless oil.

Preparation of Intermediate 19

A solution of crude 18 and sodium acetate (2.46 g, 30 mmol) in acetic acid (30 mL) was refluxed for 15 min, cooled to room temperature and the solvent was distilled off. The residue was worked up with water and ethyl acetate, giving 5.66 g of 19 as an oil.

Preparation of Intermediate 20

A solution of crude 19 and concentrated hydrochloric acid (0.5 mL) in 75 mL of methanol was stirred at room temperature for 3 days. The solvent was distilled off leaving 4.61 g of 20 (29 mmol, 96% based on 17).

Preparation of D-33

A solution of 20 (1.59 g, 10 mmol), 3 (2.25 g, 11 mmol) and dibutyltin diacetate (0.02 mL) in acetonitrile (10 mL) was kept at room temperature in a stoppered flask for 24 h. The solvent was removed giving an oil which crystallized when stirred with isopropyl ether. The solid was collected, washed with isopropyl ether and dried. The yield of D-33 was 3.03 g (8.3 mmol, 83%), m.p. 96–98° C., ESMS: $ES^+$, m/z 363 (M+1, 95%).

PHOTOGRAPHIC EXAMPLES

EXAMPLE 6

This Example illustrates a method of determining the half life ($t_{1/2}$) or thermal activity of the blocked developers employed in the present invention. Except for blocked developers in which a heteroaromatic D group in Structure III above is present (see below), the blocked developers are tested for thermal activity as follows: The blocked developer was dissolved at a concentration of ~$1.6\times10^{-5}$ M in a solution consisting of 33% (v/v) EtOH in deionized water at 60° C. and pH 7.87 and ionic strength 0.125 in the presence of Coupler-1 (0.0004 M) and $K_3Fe(CN)_6$ (0.00036 M). The reaction was followed by measurement of the magenta dye formed at 568 nm with a spectrophotometer (for example, a Hewlett-Packard 8451A Spectrophotometer or an equivalent). The reaction rate constant (k) is obtained from a fit of the following equation to the data:

$$A=A_0+A_{28}\,(1-e^{-kt})$$

where A is the absorbance at 568 nm at time t, and the subscripts denote time 0 and infinity (∞). The half-lives are calculated accordingly from $t_{1/2}=0.693/k$.

Coupler-1

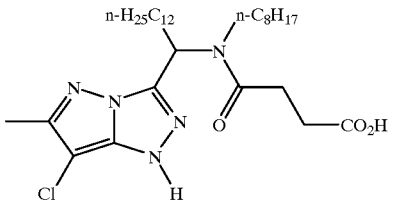

Results from such measurement for some comparative blocked color developers are given below.

TABLE 4-1

| Developer | $t_{½}$, min |
|---|---|
| DC-1 | >500 |
| DC-2 | 50.8 |
| DC-3 | 127 |
| DC-5 | 72.2 |
| DC-6 | 74.6 |
| DC-7 | 36.5 |
| DC-4 | 362 |
| D-12 | 0.86 |
| D-42 | 1.47 |
| D-15 | 3.03 |
| D-18 | 13.7 |
| D-44 | 8.27 |
| D-19 | 13.8 |
| D-25 | 2.80 |
| D-22 | 17.9 |
| D-23 | 10.1 |
| D-45 | 0.37 |

The comparative blocked developers have the following structures:

DC-1

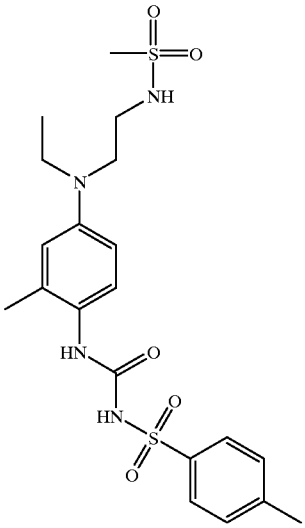

DC-2

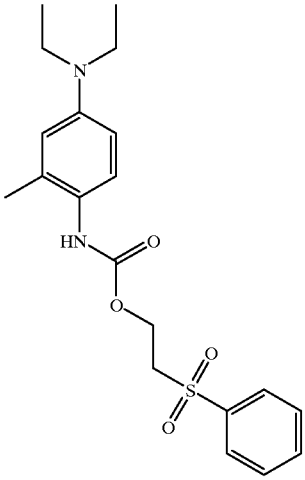

DC-3

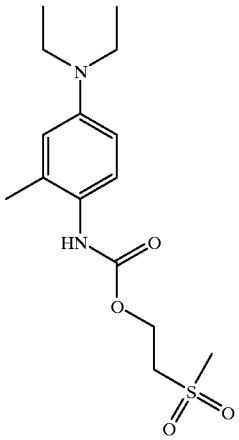

DC-4

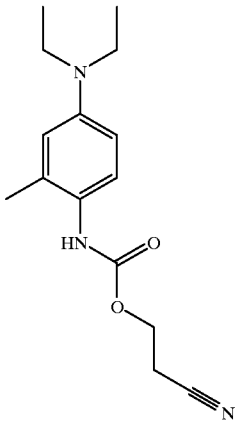

DC-5

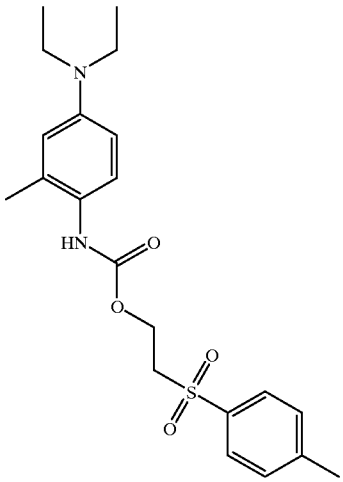

DC-6

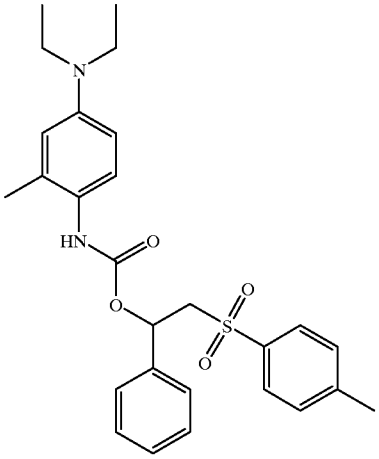

DC-7

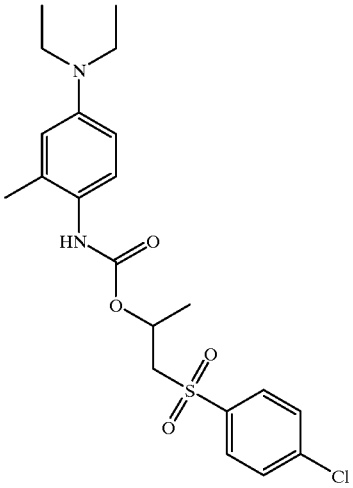

In comparison with the comparative compounds, lower onset temperatures are achieved with the inventive blocked compounds that show half-lives of 30 min or less. Preferably the half-lives are 25 min or less, more preferably 20 min or less.

To determine the half-lives of blocked developing agents of Structure I in which D is a heteroaromatic group, the blocked developer was dissolved at a concentration of ~$1.6\times10^{-5}$ M in a solution consisting dimethylsulfoxide (DMSO) solvent at 130° C. in the presence of 0.05 M of salicylanilide, which was first mixed with the DMSO solvent. The reaction kinetics was followed by high pressure liquid chromatography (HPLC) analysis of the reaction mixture, for example using a Hewlett-Packard LC 1100 System or an equivalent. The half-life measured for D-46 was 14.8, which shows apparently a high reactivity under the conditions.

EXAMPLE 7

This example shows the advantages of a photothermographic element according to the present invention. The following components are used in the photographic element of this example.

Emulsion E-1

The silver halide emulsion used in this example was composed of 95.5% AgBr and 4.5 % AgI. The grains had an effective circular diameter of 1.06 microns and a thickness of 0.126 microns. The emulsion was sensitized to magenta light by application of sensitizing dyes SM1 and SM2, and was chemically sensitized to optimum imaging performance as known in the art.

SM-1

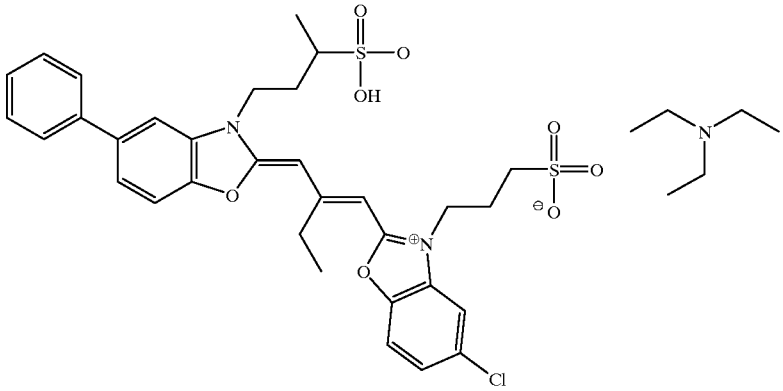

SM-2

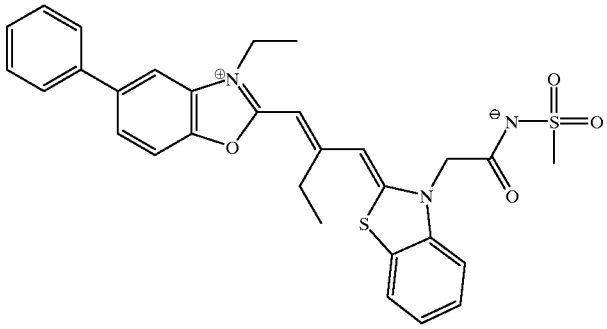

Silver Salt Dispersion SS-1

A stirred reaction vessel was charged with 431 g of lime processed gelatin and 6569 g of distilled water. A solution containing 214 g of benzotriazole, 2150 g of distilled water, and 790 g of 2.5 molar sodium hydroxide was prepared (Solution B). The mixture in the reaction vessel was adjusted to a pAg of 7.25 and a pH of 8.00 by additions of Solution B, nitric acid, and sodium hydroxide as needed. A 4 L solution of 0.54 molar silver nitrate was added to the kettle at 250 cc/minute, and the pAg was maintained at 7.25 by a simultaneous addition of solution B. This process was continued until the silver nitrate solution was exhausted, at which point the mixture was concentrated by ultrafiltration. The resulting silver salt dispersion contained fine particles of silver benzotriazole.

AgPMT Dispersion AF-1

A stirred reaction vessel was charged with 9.7 g of lime processed gelatin and 300 g of distilled water. A solution containing 14.1 g of phenylmercaptotetrazole, 90.2 g of distilled water, 16.0 g of acetone and 31.7 g of 2.5 molar sodium hydroxide was prepared (Solution C). The mixture in the reaction vessel was adjusted to a pAg of 7.25 and a pH of 5.8 by additions of Solution C, nitric acid, and sodium hydroxide as needed. A 200 cc solution of 0.54 molar silver nitrate was added to the kettle at 11 cc/minute, and the pAg was maintained at 7.25 by a simultaneous addition of solution C. This process was continued until the silver nitrate solution was exhausted, at which point 27 g of a 20% gelatin solution were added. The resulting silver salt dispersion contained fine particles of silver phenylmercaptotetrazole.

AgPMT/PMT Co-Dispersion AF-2

These materials were ball-milled in an aqueous mixture, for 4 days using Zirconia beads in the following formula. For 1 g of phenylmercaptotetrazole, sodium triisopropylnaphthalene sulfonate (0.1 g), water (to 10 g), and beads (25 ml), were used. The beads were removed by filtration. Fifty percent of the phenylmercaptotetrazole was converted to silver-phenylmercaptotetrazole by addition of 0.5 moles silver nitrate per mole of phenylmercaptotetrazole.

Coatings were prepared according to the standard format listed below in Table 1-1, with variations consisting of changing the phenylmercaptotetrazole source. The melt pH was adjusted to 3.5. All coatings were prepared on a 7 mil thick poly(ethylene terephthalate) support.

TABLE 7-1

| Component | Laydown |
|---|---|
| Silver (from emulsion E-1) | 0.54 $g/m^2$ |
| Silver (from silver salt SS-1) | 0.65 $g/m^2$ |
| Coupler M-1 (from coupler dispersion CDM-1) | 0.43 $g/m^2$ |
| Developer DEV-1 | 0.65 $mmol/m^2$ |
| Benzamide | 0.22 $g/m^2$ |
| Antifoggant (as defined in Table 7-2) | 0.32 $g/m^2$ |
| Lime processed gelatin | 4.75 $g/m^2$ |

Coupler Dispersion CDM-1

An oil based coupler dispersion was prepared by conventional means containing coupler M-1 (224EV) and tricresyl phosphate at a weight ratio of 1:0.5.

Structure

Coupler M-1

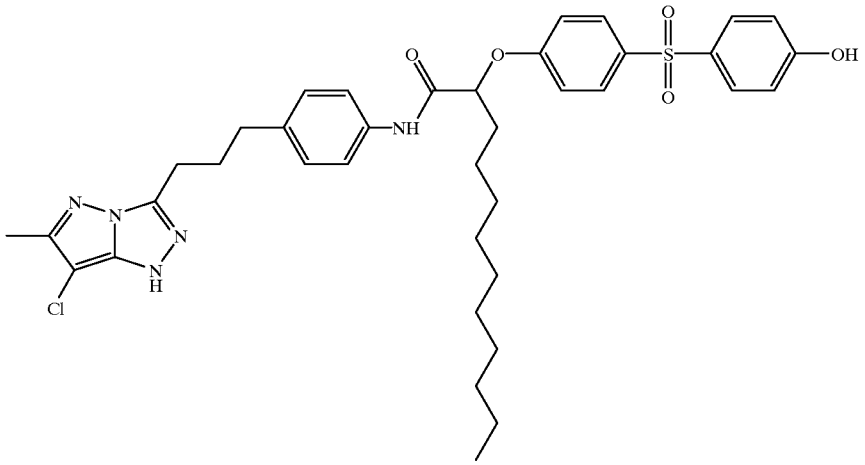

DEV-1

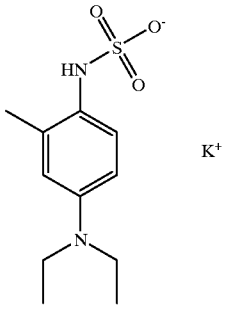

Comparative Examples

Comparative Coatings were made using the standard coating format with blocked developer DEV-1, without antifoggant.

Inventive Examples

Two inventive coatings were made using the standard coating format with blocked developer DEV-1 and, respectively antifoggant preparations AF-1 and AF-2.

Coating Evaluation

The resulting coatings were exposed through a step wedge to a 3.04 log lux light source at 3000K filtered by a Daylight 5A filter. The exposure time was 1/10 second. After exposure, the coating was thermally processed by contact with a heated platen for 20 seconds.

The coatings listed above performed as shown in the table below. A number of strips were processed at a variety of platen temperatures in order to yield an optimum strip process condition. From these data, the image discrimination was calculated. The image discrimination corresponds to the value:

$$D_p = \frac{D_{max} - D_{min}}{D_{min}}$$

Higher values of $D_p$ indicate antifoggants producing enhanced signal to noise, which are desirable.

The coatings listed above performed as shown in the Table 1-2 below.

TABLE 7-2

| Coating | Antifoggant | D-min | D-max | Dp |
|---|---|---|---|---|
| C-7-1 | None | 0.68 | 0.68 | 0.0 |
| I-7-1 | AF-1 | 0.24 | 0.80 | 2.3 |
| I-7-2 | AF-2 | 0.23 | 0.63 | 1.7 |

This table shows that the inventive antifoggants substantially improved peak discrimination compared to the comparison coating.

EXAMPLE 8

To demonstrate the advantage of using a combination of silver salts of benzotriazole and 5-phenyl-1-mercaptotetrazole in photothermographic films, coatings containing the components in Table 8-1 were prepared on 7 mil poly(ethylene terephthalate) support.

Silver Salt Dispersion AF-3 (Silver 1-Phenyl-5-Mercapto Tetrazole)

A stirred reaction vessel was charged with 431 g of lime processed gelatin and 6569 g of distilled water. A solution containing 320 g of 1-phenyl-5-mercaptotetrazole, 2044 g of distilled water, and 790 g of 2.5 molar sodium hydroxide was prepared (Solution D). The mixture in the reaction vessel was adjusted to a pAg of 7.25 and a pH of 8.00 by additions of Solution D, nitric acid, and sodium hydroxide as needed.

A 41 solution of 0.54 molar silver nitrate was added to the kettle at 250 cc/minute, and the pAg was maintained at 7.25 by a simultaneous addition of solution D. This process was continued until the silver nitrate solution was exhausted, at which point the mixture was concentrated by ultrafiltration. The resulting silver salt dispersion contained fine particles of the silver salt of 1-phenyl-5-mercaptotetrazole.

Coupler Dispersion CDM-2

A coupler dispersion was prepared by conventional means containing coupler M-2 without any additional permanent solvents.

In addition to these common components, silver salts SS-1 and AF-3 were added to each coating in the amounts specified in Table 8-2 (amounts based on silver). The resulting coatings were exposed for one-tenth of a second through a step wedge to a 3.04 log lux light source at 3000K, filtered by a Daylight 5A filter. Following exposure, the coatings were thermally processed by contact with a heated platen for 20 seconds at 150 degrees Celsius. The coatings were then fixed in a solution Kodak Flexicolor® Fix to remove the silver halide. For each coating, the Status M red density at maximum exposure (red Dmax) was measured with an X-Rite® densitometer. The red Dmax values are reported in the last column of Table 8-2.

TABLE 8-1

| Component | Laydown g/m$^2$ |
|---|---|
| Silver (from emulsion E-1) | 0.86 |
| Coupler M-2 (from dispersion CDM-2) | 0.75 |
| Developer DEV-2 | 0.86 |
| Salicylanilide | 0.86 |
| Lime Processed Gelatin | 3.24 |

Structure

DEV-2

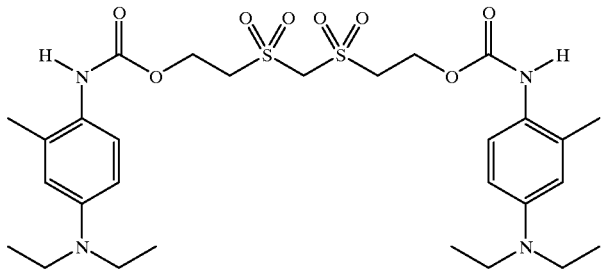

M-2

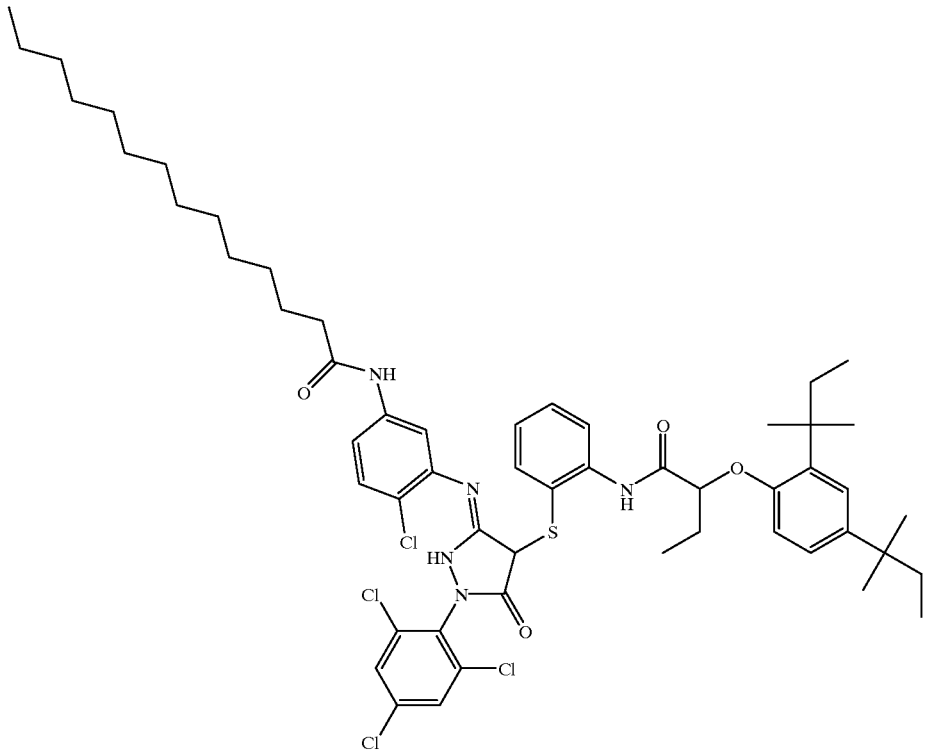

TABLE 8-2

| Coating | SS-1 ($g/m^2$) | AF-3 ($g/m^2$) | Red Dmax |
|---|---|---|---|
| C-8-1 | 0.00 | 0.65 | 0.33 |
| C-8-2 | 0.00 | 0.32 | 0.40 |
| C-8-3 | 0.32 | 0.00 | 0.54 |
| C-8-4 | 0.65 | 0.00 | 0.60 |
| I-8-1 | 0.32 | 0.32 | 1.39 |

The data in Table 8-2 clearly show that using a mixture of a silver salt from a benzotriazole and a silver salt from a mercaptotetrazole is necessary to achieve high maximum density in a thermally processed film.

EXAMPLE 9

A further advantage of using a silver salt of a mercaptotetrazole compared to its free, uncomplexed form is demonstrated in the following experiment. Photothermographic coatings were prepared on 7 mil poly(ethylene terephthalate) support containing the common components listed in Table 9-1.

Dispersion AD-1 (1-Phenyl-5-Mercapto Tetrazole (PMT))

A mixture was made up containing 9.6 grams of PMT, 0.96 grams of polyvinylpyrolidone, 0.96 grams of Triton X-200 surfactant, and 84.5 grams of distilled water. To this mixture was added 240 cc of 1.8 mm zirconium oxide beads and the dispersion was milled for three days on a roller mill to yield a fine particle dispersion of PMT.

TABLE 9-1

| Component | Laydown $g/m^2$ |
|---|---|
| Silver (from emulsion E-1) | 0.86 |
| Coupler M-2 (from dispersion CDM-2) | 0.75 |
| Developer DEV-2 | 0.86 |
| Salicylanilide | 0.86 |
| Lime Processed Gelatin | 3.24 |

In addition to these components, silver salts SS-1 and AF-3 and free 5-phenyl-1-mercaptetrazole (AD-1) were added to each coating in the amounts listed in Table 9-2. The resulting coatings were exposed for one-tenth of a second through a step wedge to a 3.04 log lux light source at 3000K, filtered by Daylight 5A and Wratten 2B filters. Following exposure, the coatings were thermally processed by contact with a heated platen for 20 seconds at 150 degrees Celsius. These coatings were then fixed in a solution of Kodak Flexicolor Fix to remove the silver halide. Another set of exposed coatings was processed through a standard KODAK FLEXICOLOR® (C-41) process as described in *British Journal of Photography Annual,* 1988, pp. 196–198. For each coating, the Status M green density at maximum exposure (green Dmax) was measured with an X-Rite densitometer. The green Dmax values for the thermally processed and for the C-41 processed coatings are presented in Table 3-2 below. The last column in Table 9-2 shows the percent loss in green Dmax exhibited by coatings that went through a standard C-41 process compared to the same coating formulation processed thermally at 150° C. A smaller percent loss is desirable because it signifies that a photographic element exhibits similar sensitometric behavior whether processed thermally or under standard C-41 conditions.

TABLE 9-2

| Coating | SS-1 ($g/m^2$) | AF-3 ($g/m^2$) | AD-1 ($g/m^2$) | Green Dmax (Thermal) | Green Dmax (C-41) | Percent Loss in Dmax in C-41 Process |
|---|---|---|---|---|---|---|
| I-9-1 | 0.32 | 0.32 | 0.00 | 2.02 | 0.79 | 60.9 |
| C-9-1 | 0.32 | 0.32 | 0.05 | 1.98 | 0.65 | 67.4 |
| C-9-2 | 0.32 | 0.32 | 0.11 | 2.02 | 0.53 | 74.0 |
| C-9-3 | 0.32 | 0.32 | 0.22 | 1.79 | 0.35 | 80.6 |
| C-9-4 | 0.32 | 0.32 | 0.32 | 2.32 | 0.43 | 81.4 |
| C-9-5 | 0.65 | 0 | 0.32 | 1.20 | 0.24 | 80.0 |

As the data in Table 9-2 demonstrate, coatings that contain the free phenylmercaptotetrazole AD-1 show greater maximum density loss when processed in standard C-41 conditions.

EXAMPLE 10

Processing conditions are as described in the example. Unless otherwise stated, the silver halide was removed after development by immersion in KODAK Flexicolor Fix solution. In general, an increase of approximately 0.2 in the measured density would be obtained by omission of this step. The following components are used in the examples. Also included is a list of all of the chemical structures.

All coatings contained the common elements as shown in Table 10-1. In addition, the levels of silver salts SS-1, AF-3, and PMT are as listed in Table 10-2 as a function of coating. The comparative example contains the PMT incorporated as the pure compound, while the inventive examples show the PMT incorporated as the silver salt.

TABLE 10-1

| Component | Laydown $g/m^2$ |
|---|---|
| Silver (from emulsion E-1) | 0.864 |
| Coupler M-1 (as dispersion CDM-1) | 0.54 |
| Developer DEV-2 | 0.864 |
| Salicylanilide | 0.864 |
| Lime Processed Gelatin | 3.24 |

TABLE 10-2

| Coating | SS-1 (silver) $g/m^2$ | AF-3 (silver) $g/m^2$ | AD-1 $g/m^2$ |
|---|---|---|---|
| C-10-1 | 0.648 | — | 0.324 |
| I-10-1 | 0.486 | 0.162 | — |
| I-10-2 | 0.324 | 0.324 | — |
| I-10-3 | 0.162 | 0.486 | — |

The use of the silver salt of PMT as opposed to incorporation of the PMT organic acid shows 2 main advantages. In the first place, coatings with silver-PMT show increased speed over coatings that do not contain silver-PMT as shown in Table 10-3 below. To measure speed, the coatings of Table 10-2 were exposed through a step tablet to a light source filtered to simulate a color temperature of 5500 K. The light source was further filtered by a Wratten #9 filter to allow only red and greed portions of the visible light spectrum to expose the film. The light source has an intensity of 2.4 log(lux), and an exposure time of 0.1 seconds was used.

After exposure, the coating was processed at 145 C for 20 seconds to yield a visible image. Densitometry was performed on this image to produce an H&D curve from which speed was measured using a contrast normalized speed metric. Table 10-3 shows the measured speeds of these coatings, all normalized to the speed of the control coating.

TABLE 10-3

| Coating | Relative Speed (log(E)) |
|---|---|
| C-10-1 | 0 |
| I-10-1 | 0.16 |
| I-10-2 | 0.09 |
| I-10-3 | 0.21 |

Table 10-3 shows that moderate speed increases can be obtained by incorporation of PMT as a silver salt as opposed to incorporation of the PMT organic acid.

In addition to the fresh processes coatings exemplified in Table 10-3, the same coatings were exposure to a condition of 38 C and a relative humidity of 60% for 1 week in order to study the stability of the coatings to aging. Table 10-4 below shows the results of this testing, where the parameter Δ-Speed refers the difference in photographic speed of the coating after simulated aging to that of the coating prior to simulated aging. Negative numbers represent a speed loss upon aging.

TABLE 10-4

| Coating | Δ-Speed (log(E)) |
|---|---|
| C-10-1 | −0.68 |
| I-10-1 | −0.08 |
| I-10-2 | −0.30 |
| I-10-3 | +0.14 |

Although there is some loss of speed upon aging with several of the inventive coatings, it is clear from Table 10-4 that the speed losses upon aging are much less severe for coatings employing the silver salt of PMT as opposed to the comparative coating that was constructed using the PMT organic acid.

EXAMPLE 11

Processing conditions are as described in the inventive multilayer example that follows. The following components are used in the example. Also included is a list of all of the chemical structures.

Silver Salt Dispersion SS-2

A stirred reaction vessel was charged with 431 g of lime processed gelatin and 6569 g of distilled water. A solution containing 214 g of benzotriazole, 2150 g of distilled water, and 790 g of 2.5 molar sodium hydroxide was prepared (Solution E). The mixture in the reaction vessel was adjusted to a pAg of 7.25 and a pH of 8.00 by additions of Solution E, nitric acid, and sodium hydroxide as needed.

A 41 solution of 0.54 molar silver nitrate was added to the kettle at 250 cc/minute, and the pAg was maintained at 7.25 by a simultaneous addition of solution E. This process was continued until the silver nitrate solution was exhausted, at which point the mixture was concentrated by ultrafiltration. The resulting silver salt dispersion contained fine particles of silver benzotriazole.

Antifogging Silver Salt Dispersion AF-4

A stirred reaction vessel was charged with 431 g of lime processed gelatin and 6569 g of distilled water. A solution containing 320 g of 1-phenyl-5-mercaptotetrazole, 2044 g of distilled water, and 790 g of 2.5 molar sodium hydroxide was prepared (Solution F). The mixture in the reaction vessel was adjusted to a pAg of 7.25 and a pH of 8.00 by additions of Solution F, nitric acid, and sodium hydroxide as needed.

A 41 solution of 0.54 molar silver nitrate was added to the kettle at 250 cc/minute, and the pAg was maintained at 7.25 by a simultaneous addition of solution F. This process was continued until the silver nitrate solution was exhausted, at which point the mixture was concentrated by ultrafiltration. The resulting silver salt dispersion contained fine particles of the silver salt of 1-phenyl-5-mercaptotetrazole.

Silver Halide Emulsions

The emulsions employed in these examples are all silver iodobromide tabular grains precipitated by conventional means as known in the art. Table 11-1 below lists the various emulsions, along with their iodide content (the remainder assumed to be bromide), their dimensions, and the sensitizing dyes used to impart spectral sensitivity. All of these emulsions have been given chemical sensitizations as known in the art to produce optimum sensitivity.

TABLE 11-1

| | Spectral sensitivity | Iodide content (%) | Diameter (μm) | Thickness (μm) | Dyes |
|---|---|---|---|---|---|
| EY-1 | yellow | 1.3 | 0.54 | 0.084 | SY-1 |
| EY-2 | yellow | 4.1 | 1.25 | 0.137 | SY-1 |
| EY-3 | yellow | 2 | 1.23 | 0.125 | SY-1 |
| EY-4 | yellow | 2 | 0.45 | 0.061 | SY-1 |
| EY-5 | yellow | 2 | 0.653 | 0.093 | SY-1 |
| EM-1 | magenta | 1.3 | 0.55 | 0.084 | SM-1 + SM-3 |
| EM-2 | magenta | 4.1 | 1.22 | 0.111 | SM-1 + SM-2 |
| EM-3 | magenta | 2 | 1.23 | 0.125 | SM-1 + SM-2 |
| EM-4 | magenta | 2 | 0.45 | 0.061 | SM-1 + SM-2 |
| EM-5 | magenta | 2 | 0.653 | 0.093 | SM-1 + SM-2 |
| EC-1 | cyan | 1.3 | 0.55 | 0.084 | SC-1 |
| EC-2 | cyan | 4.1 | 1.2 | 0.11 | SC-1 |
| EC-3 | cyan | 2 | 1.23 | 0.125 | SC-1 + SC-2 |
| EC-4 | cyan | 2 | 0.45 | 0.061 | SC-1 + SC-2 |
| EC-5 | cyan | 2 | 0.653 | 0.093 | SC-1 + SC-2 |

Coupler Dispersion CDM-2

An oil based coupler dispersion was prepared by conventional means containing coupler M-2 and tricresyl phosphate at a weight ratio of 1:0.5.

Coupler Dispersion CDC-1

An oil based coupler dispersion was prepared by conventional means containing coupler C-1 and dibutyl phthalate at a weight ratio of 1:2.

Coupler Dispersion CDY-1

An oil based coupler dispersion was prepared by conventional means containing coupler Y-1 and dibutyl phthalate at a weight ratio of 1:0.5.

M-2
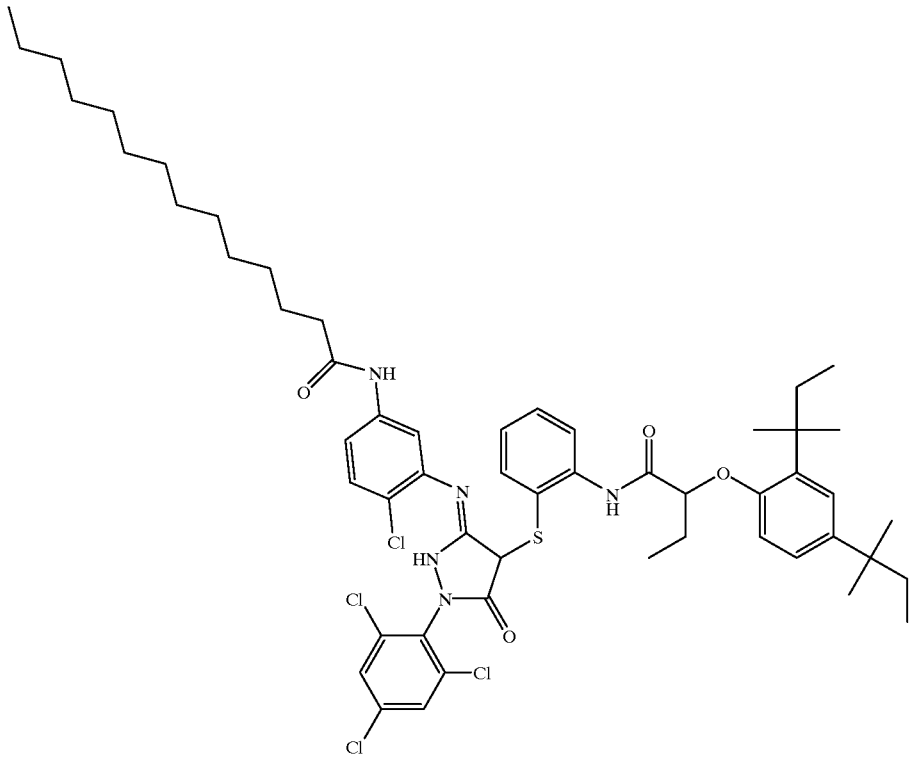
C-1
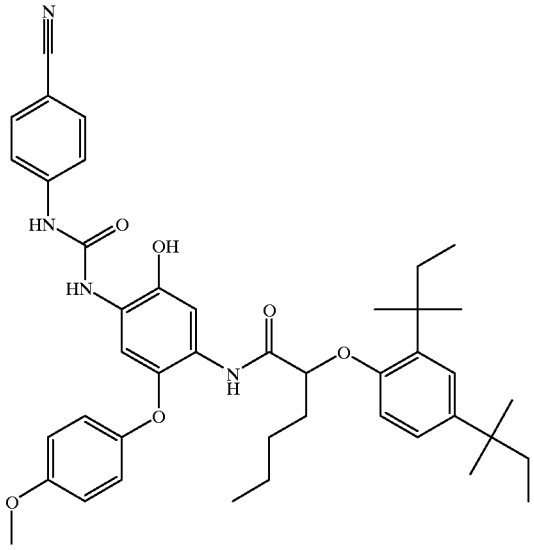

-continued
Y-1
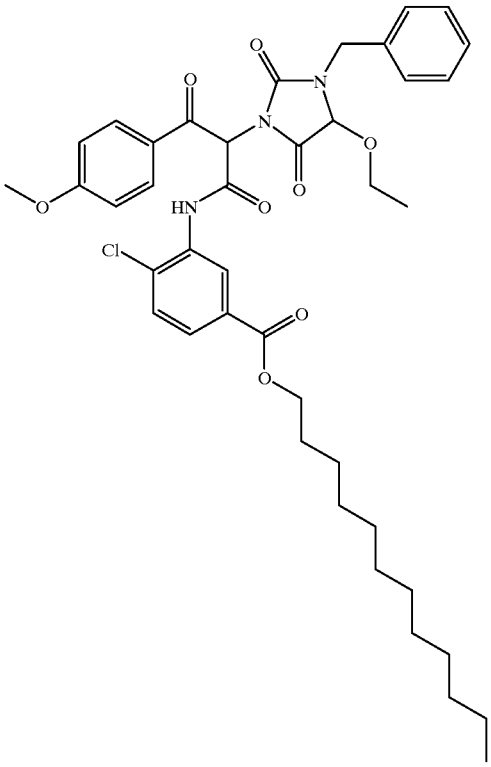
SY-1
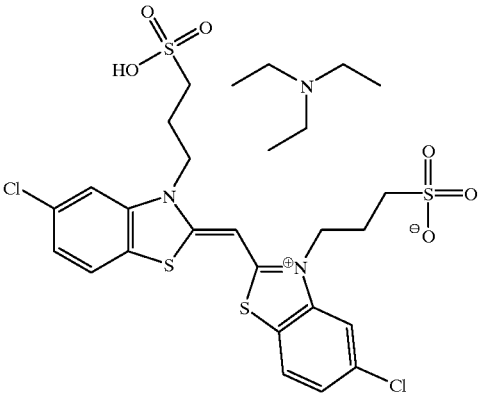
SY-2
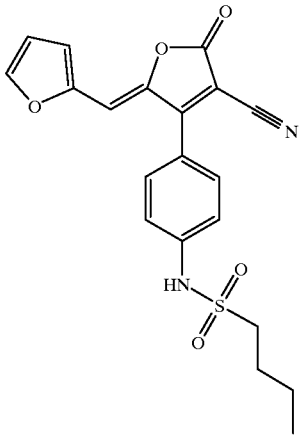

-continued
SM-1
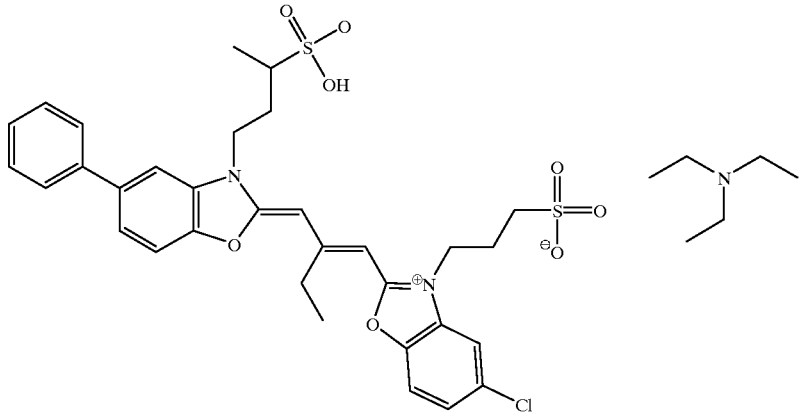
SM-2
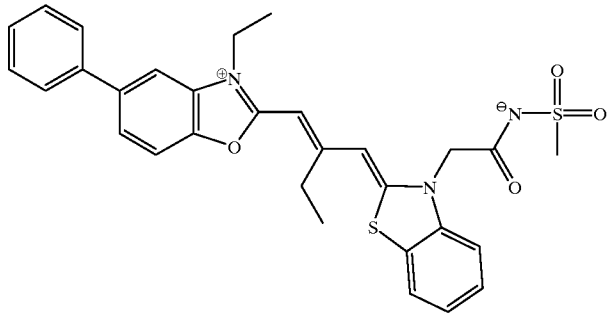
SM-3
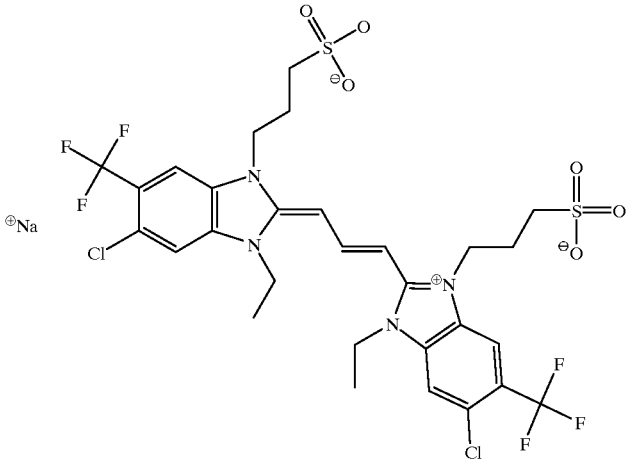
SC-1
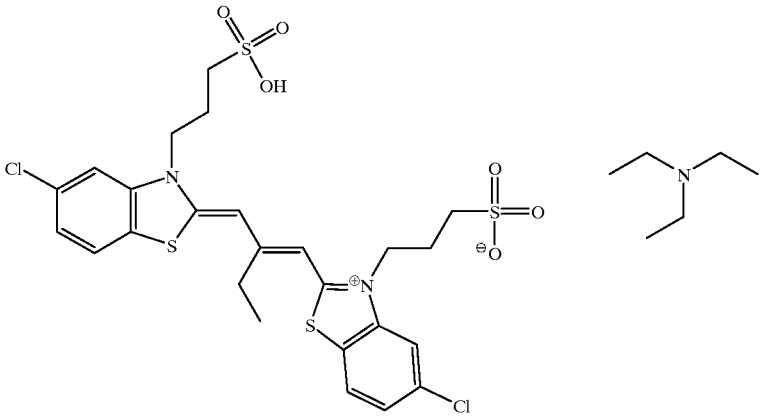

-continued

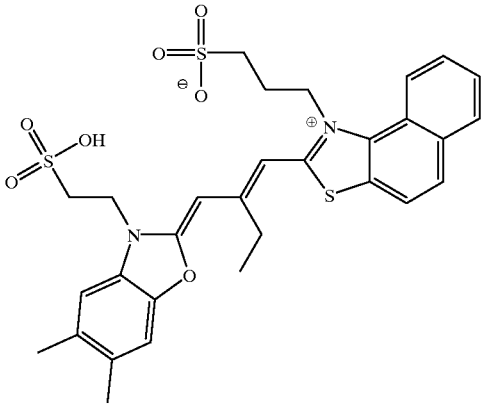

SC-2

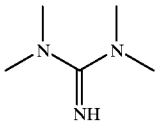

HAR-1

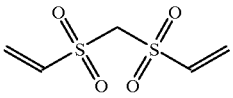

A multilayer imaging element as described in Table 11-2 was created to allow for use in full color photothermographic elements intended for capturing live scenes. The multilayer element of this example was capable of producing an image with no wet processing steps.

TABLE 11-2

| | | |
|---|---|---|
| Overcoat | 1.1 g/m$^2$ | Gelatin |
| | 0.32 g/m$^2$ | HAR-1 |
| Fast Yellow | 0.54 g/m$^2$ | AgBrI from emulsion EY-3 |
| | 0.17 g/m$^2$ | silver benzotriazole from SS-2 |
| | 0.17 g/m$^2$ | silver-1-phenyl-5-mercaptotetrazole from AF-4 |
| | 0.29 g/m$^2$ | coupler Y-1 from dispersion CDY-1 |
| | 0.46 g/m$^2$ | Developer DEV-2 |
| | 0.46 g/m$^2$ | Salicylanilide |
| | 2.3 g/m$^2$ | Gelatin |
| Slow Yellow | 0.27 g/m$^2$ | AgBrI from emulsion EY-4 |
| | 0.16 g/m$^2$ | AgBrI from emulsion EY-5 |
| | 0.15 g/m$^2$ | silver benzotriazole from SS-2 |
| | 0.15 g/m$^2$ | silver-1-phenyl-5-mercaptotetrazole from AF-4 |
| | 0.25 g/m$^2$ | coupler Y-1 from dispersion CDY-1 |
| | 0.40 g/m$^2$ | Developer DEV-2 |
| | 0.40 g/m$^2$ | Salicylanilide |
| | 2.0 g/m$^2$ | Gelatin |
| Yellow Filter | 0.08 g/m$^2$ | SY-2 |
| | 1.07 g/m$^2$ | Gelatin |
| Fast Magenta | 0.54 g/m$^2$ | AgBrI from emulsion EM-3 |
| | 0.17 g/m$^2$ | silver benzotriazole from SS-2 |
| | 0.17 g/m$^2$ | silver-1-phenyl-5-mercaptotetrazole from AF-4 |
| | 0.29 g/m$^2$ | coupler M-2 from dispersion CDM-2 |
| | 0.46 g/m$^2$ | Developer DEV-2 |
| | 0.46 g/m$^2$ | Salicylanilide |
| | 2.3 g/m$^2$ | Gelatin |
| Slow Magenta | 0.27 g/m$^2$ | AgBrI from emulsion EM-4 |
| | 0.16 g/m$^2$ | AgBrI from emulsion EM-5 |
| | 0.15 g/m$^2$ | silver benzotriazole from SS-2 |
| | 0.15 g/m$^2$ | silver-1-phenyl-5-mercaptotetrazole from AF-4 |
| | 0.25 g/m$^2$ | coupler M-2 from dispersion CDM-2 |
| | 0.40 g/m$^2$ | Developer DEV-2 |
| | 0.40 g/m$^2$ | Salicylanilide |
| | 2.0 g/m$^2$ | Gelatin |
| Interlayer | 1.07 g/m$^2$ | Gelatin |
| Fast Cyan | 0.54 g/m$^2$ | AgBrI from emulsion EC-3 |
| | 0.17 g/m$^2$ | silver benzotriazole from SS-2 |
| | 0.17 g/m$^2$ | silver-1-phenyl-5-mercaptotetrazole from AF-4 |
| | 0.29 g/m$^2$ | coupler C-1 from dispersion CDC-1 |
| | 0.46 g/m$^2$ | Developer DEV-2 |
| | 0.46 g/m$^2$ | Salicylanilide |
| | 2.3 g/m$^2$ | Gelatin |

TABLE 11-2-continued

| | | |
|---|---|---|
| Slow Cyan | 0.27 g/m$^2$ | AgBrI from emulsion EC-4 |
| | 0.16 g/m$^2$ | AgBrI from emulsion EC-5 |
| | 0.15 g/m$^2$ | silver benzotriazole from SS-2 |
| | 0.15 g/m$^2$ | silver-1-phenyl-5-mercaptotetrazole from AF-4 |
| | 0.25 g/m$^2$ | coupler C-1 from dispersion CDC-1 |
| | 0.40 g/m$^2$ | Developer DEV-2 |
| | 0.40 g/m$^2$ | Salicylanilide |
| | 2.0 g/m$^2$ | Gelatin |
| Antihalation Layer | 0.05 g/m$^2$ | Carbon |
| | 1.6 g/m$^2$ | Gelatin |
| Support | Polyethylene terephthalate support (7 mil thickness) | |

The resulting coating was exposed through a step wedge to a 1.8 log lux light source at 5500K and Wratten 2B filter. The exposure time was 0.1 seconds. After exposure, the coating was thermally processed by contact with a heated platen for 20 seconds at 145° C. Cyan, magenta, and yellow densities were read using status M color profiles, to yield the densities listed in Table 11-3 below. It is clear from these densities that the coating serves as a useful photographic element capturing multicolor information.

TABLE 11-3

| Record | Dmin | Dmax |
|---|---|---|
| Cyan | 0.38 | 1.47 |
| Magenta | 0.72 | 2.65 |
| Yellow | 0.68 | 1.80 |

The film element of Example 11 was further loaded into a single lens reflex camera equipped with a 50 mm/f 1.7 lens. The exposure control of the camera was set to ASA 100 and a live scene indoors without the use of a flash was captured on the above element. The element was developed by heating for 20 seconds at 145 C and no subsequent processing was done to the element.

The resulting image was scanned with a Nikon LS2000 film scanner. The digital image file thus obtained was loaded into Adobe Photoshop (version 5.0.2) where corrections were made digitally to modify tone scale and color saturation, thus rendering an acceptable image. The image was viewed as softcopy by means of a computer monitor. The image file was then sent to a Kodak 8650 dye sublimation printer to render a hardcopy output of acceptable quality. This demonstrates the use of a photothermographic element in a complete imaging chain.

EXAMPLE 12

The film of the invention from Example 11 will be labeled IMF-1 for the present example. A comparative film example CMF-1 was a product coating of Kodak Gold 100, emulsion number 5281. This is a film element suitable for processing according to Process C-41 as described in the British Journal of Photography Annual for 1988 at pages 196–198 but with a modified bleach solution having 1,3-propylenediamine tetraacecetic acid. The processed film element exhibited ISO sensitivity of ISO 100 and formed excellent density in all color records.

The C-41 process was used in the processing that follows. The process consists of the following steps at 37.8° C.:

Flexicolor™ development for 3'15"

Flexicolor™ bleach for 4'00"

Water wash for 3'00"

Flexicolor™ fix for 4'00"

Water wash for 3'00"

Flexicolor™ stabilizer for 1'00"

Air dry

Film examples IMF-1 and CMF-1 above were exposed through a step wedge to a 1.8 log lux light source at 5500K and Wratten 2B filter. The exposure time was 0.1 seconds.

The processes below were performed on the film samples. After processing, the sensitometric response of red, green, and blue density were read using Status M color profiles.

Process 1—heat development on a heated platen for 10 seconds, 160° C.

Process 2—heat development as per Process 1 followed by exposure to light, then bleach and fix as per C-41 process Process 3—C-41 development followed by water wash Process 4—C-41 development followed by water wash, exposure to light, then bleach and fix as per C-41 process For the purposes of these experiments, the exposure to light steps intermediate in Processes 2 and 4 was accomplished by laying the film samples onto an illumination box for 30 minutes. In a practical system, this exposure could well be the exposure received from a scanner illumination source during a scanning operation. The sensitometry was read at the end of all processes as well as after heat development in Process 2 and after the water wash in Process 4. These intermediate sensitometric reads in processes 2 and 4 will be designated as Process 2A and 4A respectively, while the final process sensitometric reads will be designated as 2B and 4B respectively.

The process of the invention is to be able to heat process and trade process the inventive photothermographic film. A secondary process of the invention is to then be able to stabilize the image and improve the signal to noise by remediating the film with the bleach and fix steps of the C-41 trade process. This following examples demonstrate this by focusing in on the green layer density that is produced by the above four processes. It is understood that the same principles apply equally well to the red and blue layers of both multicolor film elements.

Table 12-1 contains information on the minimum and maximum density of the image after heat processing. In this table, discrimination is defined as $D_{max}-D_{min}/D_{min}$. It is clear from the results that only the inventive photothermographic film element IMF-1 can be developed in this manner, while the comparative film cannot.

TABLE 12-1

| film | process | green $D_{min}$ | green $D_{max}$ | $green_{discrim.}$ |
|---|---|---|---|---|
| IMF-1 | 1 | 1.31 | 3.56 | 1.72 |
| IMF-1 | 2A | 1.29 | 3.56 | 1.76 |
| CMF-1 | 1 | 1.98 | 1.98 | 0.00 |
| CMF-1 | 2A | 1.98 | 1.98 | 0.00 |

A key aspect of the current invention is to be able to dual process the photothermographic film. Table 12-2 contains information on the minimum and maximum density of the image after C-41 development. The definition of image discrimination is the same as before. The densitometer had difficulty measuring density above about 5.0, so there is high noise in some of the density measurements. It is clear from the results that the inventive photothermographic film element IMF-1 can be efficaciously developed through the wet C-41 process. Combined with the results of Table 12-1, film IMF-1 is capable of being developed by both dry and wet processes whereas film CMF-1 is only capable of being developed by the trade wet process.

TABLE 12-2

| film | process | green $D_{min}$ | green$D_{max}$ | $green_{discrim.}$ |
|---|---|---|---|---|
| IMF-1 | 3 | 1.69 | 2.33 | 0.38 |
| IMF-1 | 4A | 1.69 | 2.36 | 0.40 |
| CMF-1 | 3 | 2.10 | 6.55 | 2.12 |
| CMF-1 | 4A | 2.22 | 6.11 | 1.75 |

The above 4A samples went through an incomplete C-41 wet process. Table 12-3 contains the data for when the samples were bleached and fixed via the trade process.

TABLE 12-3

| film | process | green $D_{min}$ | green $D_{max}$ | $green_{discrim.}$ |
|---|---|---|---|---|
| IMF-1 | 4B | 0.70 | 0.96 | 0.37 |
| CMF-1 | 4B | 0.83 | 2.96 | 2.57 |

The following table shows that the inventive photothermographic film can be remediated through the C-41 bleach and fix steps after thermal development. We did not carry film sample CMF-1 to completion in this example because the heat development process did not produce useful images.

TABLE 12-4

| film | process | green $D_{min}$ | green $D_{max}$ | $Green_{discrim.}$ |
|---|---|---|---|---|
| IMF-1 | 2B | 0.45 | 2.50 | 4.56 |

The remediation process for the inventive photothermographic film is useful to stabilize the film against continued development, printout, and staining. In addition, the remediation process lowers the ultimate film density (designated as $D_{max}$) such that more efficient scanning can occur. This is indicated in Table 12-5.

TABLE 12-5

| film | process | State | green $D_{max}$ | image stability |
|---|---|---|---|---|
| IMF-1 | 1 | unremediated | 3.56 | unstable |
| IMF-1 | 2A | unremediated | 3.56 | unstable |
| IMF-1 | 2B | remediated | 2.50 | stable |

EXAMPLE 13

Processing conditions are as described below. Unless otherwise stated, the silver halide was removed after development by immersion in Kodak Flexicolor Fix solution. In general, an increase of approximately 0.2 in the measured density would be obtained by omission of this step.

The inventive coating examples were prepared as indicated in the Table 13-1 below on a 7 mil thick poly(ethylene terephthalate) support and comprised an emulsion containing layer (contents shown below) with an overcoat layer of gelatin (0.22 g/$m^2$) and 1,1'-(methylenebis(sulfonyl))bisethene hardener (at 2% of the total gelatin concentration). Both layers contained spreading aids to facilitate coating.

TABLE 13-1

| Component | Laydown |
|---|---|
| Silver (from emulsion EM-1) | 0.54 g/$m^2$ |
| Silver (from emulsion EM-2) | 0.22 g/$m^2$ |
| Silver (from emulsion EM-3) | 0.16 g/$m^2$ |
| Silver (from emulsion EM-4) | 0.11 g/$m^2$ |
| Silver (from silver salt SS-3) | 0.32 g/$m^2$ |
| Silver (from silver salt AF-5) | 0.32 g/$m^2$ |
| Coupler M-2 (from dispersion CDM-3) | 0.54 g/$m^2$ |
| Developer DEV-2 | 0.86 g/$m^2$ |
| Salicylanilide | 0.86 g/$m^2$ |
| Blocked Inhibitor | Various, see tables |
| Lime processed gelatin | 4.3 g/$m^2$ |

Silver Salt Dispersion SS-3

A stirred reaction vessel was charged with 431 g of lime processed gelatin and 6569 g of distilled water. A solution containing 214 g of benzotriazole, 2150 g of distilled water, and 790 g of 2.5 molar sodium hydroxide was prepared (Solution G). The mixture in the reaction vessel was adjusted to a pAg of 7.25 and a pH of 8.00 by additions of Solution G, nitric acid, and sodium hydroxide as needed. A 4 L solution of 0.54 molar silver nitrate was added to the kettle at 250 cc/minute, and the pAg was maintained at 7.25 by a simultaneous addition of solution G. This process was continued until the silver nitrate solution was exhausted, at which point the mixture was concentrated by ultrafiltration. The resulting silver salt dispersion contained fine particles of silver benzotriazole.

Silver Antifogging Salt Dispersion AF-5

A stirred reaction vessel was charged with 431 g of lime processed gelatin and 6569 g of distilled water. A solution containing 320 g of 1 -phenyl-5-mercaptotetrazole, 2044 g of distilled water, and 790 g of 2.5 molar sodium hydroxide was prepared (Solution H). The mixture in the reaction vessel was adjusted to a pAg of 7.25 and a pH of 8.00 by additions of Solution H, nitric acid, and sodium hydroxide as needed. A 41 solution of 0.54 molar silver nitrate was added to the kettle at 250 cc/minute, and the pAg was maintained at 7.25 by a simultaneous addition of solution H. This process was continued until the silver nitrate solution was exhausted, at which point the mixture was concentrated by ultrafiltration. The resulting silver salt dispersion contained fine particles of the silver salt of 1-phenyl-5-mercaptotetrazole.

Emulsions

Silver halide emulsions were prepared by conventional means to have the following morphologies and compositions. . The emulsions were spectrally sensitized to green light by addition of sensitizing dyes and then chemically sensitized for optimum performance.

EM-1: A tabular emulsion with composition of 96% silver bromide and 4% silver iodide and an equivalent circular diameter of 1.2 microns and a thickness of 0.12 microns EM-2: A tabular emulsion with composition of 98% silver bromide and 2% silver iodide and an equivalent circular diameter of 0.45 microns and a thickness of 0.006 microns.

EM-3: A tabular emulsion with composition of 98% silver bromide and 2% silver iodide and an equivalent circular diameter of 0.79 microns and a thickness of 0.009 microns.

EM-4: A cubic emulsion with composition of 97% silver bromide and 3% silver iodide and size of 0.16 microns.

Coupler Dispersion CDM-3

An oil based coupler dispersion was prepared containing coupler M-2, tricresyl phosphate and 2-butoxy-N,N-dibutyl-5-(1,1,3,3-tetramethylbutyl)-benzenamine, at aweight ratio of 1:0.8:0.2.

Coupler M-2

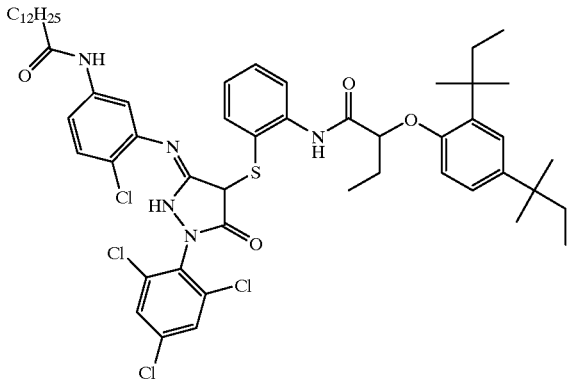

Incorporated Developer (DEV-1)

This material was ball-milled in an aqueous mixture, for 4 days using Zirconia beads in the following formula. For 1 g of Incorporated developer, sodium tri-isopropylnaphthalene sulfonate (0.1 g ), water ( to 10 g), and beads (25 The filtrate (with or without gelatin addition) was stored in a refrigerator prior to use.

DEV-1

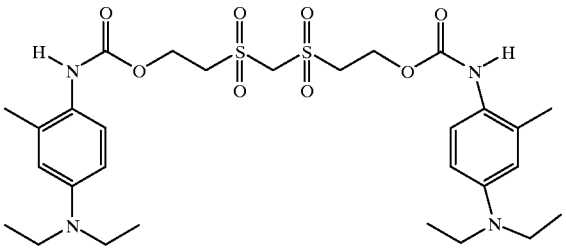

Blocked Inhibitors

These materials were ball-milled in an aqueous mixture, for 4 days using Zirconia beads in the following formula. For 1 g of blocked inhibitor, sodium tri-isopropylnaphthalene sulfonate (0.1 g), water (to 10 g), and beads (25 ml), were used. In some cases, after milling, the slurry was diluted with warmed (40° C.) gelatin solution (12.5%, 10 g) before the beads were removed by filtration. The filtrate (with or without gelatin addition) was stored in a refrigerator prior to use.

BI-1

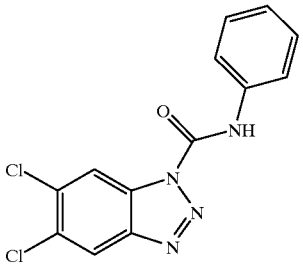

BI-2

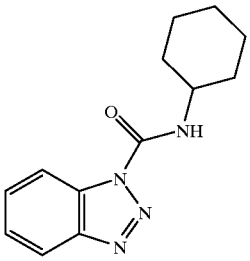

BI-3

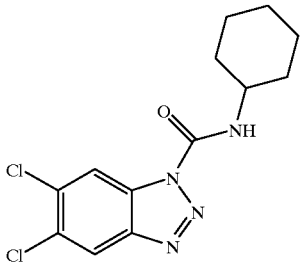

-continued

BI-4

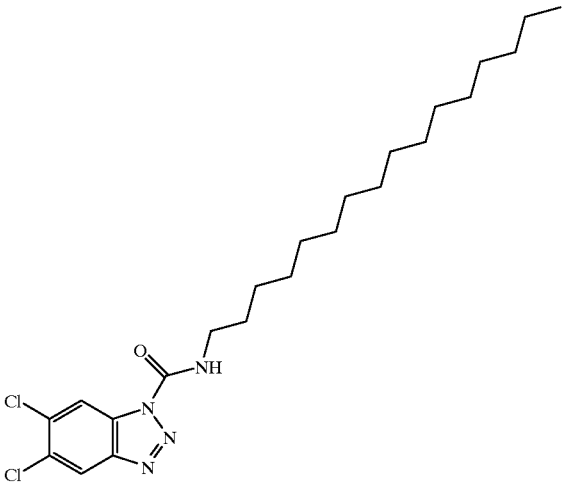

BI-5

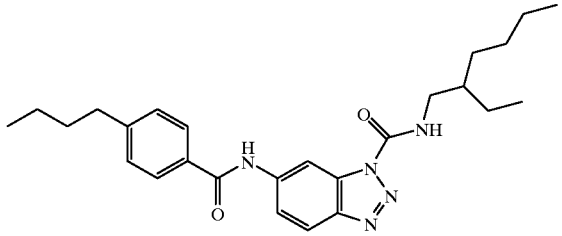

Coating Evaluation

The resulting coatings were exposed through a step wedge to a 3.04 log lux light source at 3000K filtered by Daylight 5A, 0.6 Inconel and Wratten 9 filters. The exposure time was 0.1 seconds. After exposure, the coating was processed in one of two ways: (a) thermally processed by contact with a heated platen for 20 seconds. A number of strips were processed at a variety of platen temperatures in order to check the generality of the effects that were seen: (b) processed using the KODAK C-41 protocol.

From the density readings at each step, the photographic gamma was assessed by using the maximum two-point contrast between any two measured density steps that are separated by one intervening density step, as the measure. The degree of gamma reduction is a measure of the effectiveness of the blocked inhibitor.

The coatings of blocked developer compounds shown above performed as shown in the Table 13-2 below below, which is for strips processed at 145° C. They are very effective in controlling the gamma in the thermal but some, where the compound has very little water solubility (BI-4 and BI-5) and so is not sufficiently active towards hydrolysis, or where the compound releases an inhibitor that is effective in a thermal process but not in an aqueous process (BI-2), show little gamma reduction in aqueous KODAK C-41 type processing. Thus, these compounds can control the higher thermal gamma but not reduce significantly the aqueous process gamma, enabling a film processed by either method to have an improved density range for scanning.

TABLE 13-2

| Blocked Inhibitor | Quantity | Thermal Process Gamma | % Gamma Reduction | KODAK C-41 Aqueous Process Gamma | % Gamma Reduction |
|---|---|---|---|---|---|
| None | | 0.63 | | 0.52 | |
| BI-1 | 0.35 mMole/m$^2$ | 0.57 | 10 | 0.4 | 23 |
| | 0.71 mMole/m$^2$ | 0.44 | 30 | 0.35 | 33 |
| | 1.06 mMole/m$^2$ | 0.39 | 38 | 0.33 | 37 |
| BI-2 | 0.35 mMole/m$^2$ | 0.56 | 11 | 0.47 | 10 |
| | 0.71 mMole/m$^2$ | 0.44 | 30 | 0.46 | 12 |
| | 1.06 mMole/m$^2$ | 0.37 | 41 | 0.46 | 12 |
| BI-3 | 0.35 mMole/m$^2$ | 0.39 | 38 | 0.42 | 19 |
| | 0.71 mMole/m$^2$ | 0.43 | 32 | 0.41 | 21 |
| | 1.06 mMole/m$^2$ | 0.22 | 65 | 0.41 | 21 |
| BI-4 | 0.35 mMole/m$^2$ | 0.43 | 32 | 0.48 | 8 |
| | 0.71 mMole/m$^2$ | 0.44 | 30 | 0.47 | 10 |
| | 1.06 mMole/m$^2$ | 0.29 | 54 | 0.46 | 12 |
| BI-5 | 0.35 mMole/m$^2$ | 0.61 | 3 | 0.49 | 6 |
| | 0.71 mMole/m$^2$ | 0.51 | 19 | 0.47 | 10 |
| | 1.06 mMole/m$^2$ | 0.51 | 19 | 0.46 | 12 |

The invention has been described in detail with particular reference to preferred embodiments, but it will be understood that variations and modifications can be effected within the spirit and scope of the invention.

What is claimed is:

1. A method of processing color photographic film that has been imagewise exposed in a camera, said film having at least three light-sensitive unit which have their individual sensitivities in different wavelength regions, each of the units comprising at least one light-sensitive silver-halide emulsion, binder, and dye-providing coupler, which method comprises:

(a) a color development step comprising contacting the imagewise exposed color photographic film with a non-blocked developing agent, under agitation at a temperature of between 30 to 60° C., in order to form a color negative image in the film by reaction of the non-blocked developing agent with the dye-providing couplers inside the silver-halide emulsions, the dyes formed from the dye-providing couplers in the three light-sensitive units being different in hue, (b) desilvering said film in one or more desilvering solutions to remove unwanted silver and silver halide, thereby forming a color negative image; and (c) forming a positive-image color print from the desilvered film;

wherein said film further comprises an internally located blocked developing agent, at least one silver salt or complex of an organic compound as an oxidizing agent, and a silver salt of a mercapto-functional organic compound having C1 to C12 carbon atoms, wherein the mercapto functional organic compound is present in the range of 5 to 3,000 g/mol of imaging silver, to effectively inhibit fog during thermal processing of the chromogenic photothermographic film; and wherein the blocked developing agent is substantially unreactive in the color development step (a) above, but wherein color development of the same imagewise exposed film is capable of being alternatively and comparatively obtained, without any externally applied developing agent, by heating said film to a temperature above about 80° C. essentially in the absence of aqueous solutions conditions, such that the blocked developing agent then becomes unblocked to form a developing agent, whereby the unblocked developing agent forms dyes by reacting with the dye-providing couplers inside the silver-halide emulsions, the dyes thus formed from the dye-providing couplers in the three light-sensitive units being different in hue.

2. The method of claim 1 wherein the mercapto-functional compound has a pKsp of 10 to 21 and a clogP of 0.1 to 10.

3. The method of claim 1 wherein the silver donor is silver benzotriazole.

4. The method of claim 1 wherein the mercapto-functional compound is silver PMT and is present in the amount of 5 to 3,000 g of PMT/mol imaging silver.

5. The method of processing a commercial quantity of color photographic film sold to camera users over a given period of time, which film has been imagewise exposed in a camera, said film having at least three light-sensitive units which have their individual sensitivities in different wavelength regions, each of the units comprising at least one light-sensitive silver-halide emulsion, binder, and dye-providing coupler, wherein the method comprises:

(a) processing a substantial portion of said quantity of film in a color development step comprising contacting the imagewise exposed color photographic film with a developing agent comprising a non-blocked p-phenylenediamine developing agent, under agitation at a temperature of 30 to 50° C. under aqueous alkaline conditions, in order to form a color negative image in the film by reaction of the non-blocked p-phenylenediamine developing agent with the dye-providing couplers inside the silver-halide emulsions, the dyes formed from the dye-providing couplers in the three light-sensitive units being different in hue, followed by desilvering said film in one or more desilvering solutions to remove unwanted silver and silver halide, thereby forming a color negative image; and thereafter forming a positive-image color print from the desilvered film;

(b) processing a substantial portion of said quantity of film in a color development step without any externally applied developing agent, comprising thermal treatment of the film, by heating the film at a temperature greater than 80° C. in an essentially dry process, or wherein less than 0.1 times the volume of solution required to swell the film is used during thermal development;

such that an internally located blocked developing agent in reactive association with each of said three light-sensitive units becomes unblocked to form a developing agent, whereby the unblocked developing agent forms dyes by reacting with the dye-providing couplers to form a comparable color negative image, which color image may be scanned, without desilvering, to provide a digital electronic record of the color image capable of generating a positive color image in a display element.

6. The method of claim 5, wherein the color image is generated by thermal-diffusion or ink-jet printing.

7. The method of claim 5, wherein the consumer who submits the film for development makes the choice of either color development (a) or (b) to be used by the film processor.

8. The method of claim 5, wherein less than 0.1 times the volume of solution required to swell the film is used during thermal development.

9. The method of claim 5, wherein the internally located blocked developing agent remains substantially blocked in the presence of the non-blocked developing agent and under the process conditions of step (a) such that the blocked developing agent does not competitively react with the dye-providing couplers inside the silver-halide emulsions.

10. The method of claim 1, wherein the blocked developing agent comprises a group having the following structure:

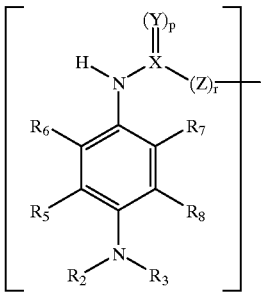

wherein $R_2$ and $R_3$ are independently hydrogen or a substituted or unsubstituted alkyl group or $R_2$ and $R_3$ are connected to form a ring;

$R_5$, $R_6$, $R_7$, and $R_8$ are independently hydrogen, halogen, hydroxy, amino, alkoxy, carbonamido, sulfonamido, alkylsulfonamido or alkyl, or $R_5$ can connect with $R_2$ or $R_6$ and/or $R_8$ can connect to $R_3$ or $R_7$ to form a ring;

X represents carbon or sulfur;

Y represents oxygen, sulfur or N—$R_1$, where $R_1$ is substituted or unsubstituted alkyl or substituted or unsubstituted aryl;

p is 1 or 2;

Z represents carbon, oxygen or sulfur;

r is 0 or 1;

with the proviso that when X is carbon, both p and r are 1, when X is sulfur, Y is oxygen, p is 2 and r is 0.

11. The method of claim 5, wherein the non-blocked developing agent is a compound, or a photographically compatible salt form thereof, selected from the group consisting of:

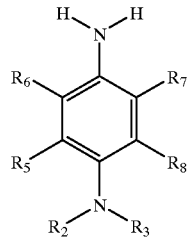

wherein $R_2$ and $R_3$ are independently hydrogen or a substituted or unsubstituted alkyl group or $R_2$ and $R_3$ are connected to form a ring;

$R_5$, $R_6$, $R_7$, and $R_8$ are independently hydrogen, halogen, hydroxy, amino, alkoxy, carbonamido, sulfonamido, alkylsulfonamido or alkyl, or $R_5$ can connect with $R_2$ or $R_6$ and/or $R_8$ can connect to $R_3$ or $R_7$ to form a ring.

12. The method of claim 5, wherein the blocked developing agent, after being unblocked, is the same compound as the non-blocked developing agent.

13. The method of claim 5 further comprising forming an electronic representation of an image comprising the step of scanning the imagewise exposed and developed photographic element.

14. The method of claim 5 comprising the steps of:

developing an imagewise exposed photographic element to form a developed image;

scanning said developed image to form an analog electronic representation of said developed image;

digitizing said analog electronic representation to form a digital image;

digitally modifying said digital image; and storing, transmitting, printing, or displaying said modified digital image.

* * * * *